US008926411B2

(12) United States Patent
Schwappach et al.

(10) Patent No.: US 8,926,411 B2
(45) Date of Patent: Jan. 6, 2015

(54) ABRASIVE ARTICLE WITH ARRAY OF COMPOSITE POLISHING PADS

(75) Inventors: Karl G. Schwappach, North Oaks, MN (US); Zine-Eddine Boutaghou, North Oaks, MN (US)

(73) Assignee: RDC Holdings, LLC, North Oaks, MN (US)

( * ) Notice: Subject to any disclaimer, the term of this patent is extended or adjusted under 35 U.S.C. 154(b) by 72 days.

(21) Appl. No.: 13/284,631

(22) Filed: Oct. 28, 2011
(Under 37 CFR 1.47)

(65) Prior Publication Data

US 2012/0149279 A1 Jun. 14, 2012

Related U.S. Application Data

(60) Division of application No. 12/784,908, filed on May 21, 2010, now Pat. No. 8,801,497, which is a continuation-in-part of application No. 12/766,473, filed on Apr. 23, 2010, now abandoned.

(60) Provisional application No. 61/174,472, filed on Apr. 30, 2009, provisional application No. 61/187,658, filed on Jun. 16, 2009, provisional application No. 61/220,149, filed on Jun. 24, 2009, provisional application No. 61/221,554, filed on Jun. 30, 2009, provisional application No. 61/232,425, filed on Aug. 8, 2009, provisional application No. 61/232,525, filed on Aug. 10, 2009, provisional application No. 61/248,194, filed on Oct. 2, 2009, provisional application No. 61/267,031, filed on Dec. 5, 2009, provisional application No. 61/267,030, filed on Dec. 5, 2009.

(51) Int. Cl.
*B24D 11/02* (2006.01)
*B24D 11/00* (2006.01)

(52) U.S. Cl.
CPC ..... *B24D 11/00* (2013.01)
USPC ..... 451/550; 451/340

(58) Field of Classification Search
USPC ..... 451/28, 64, 70, 340, 548, 550
See application file for complete search history.

(56) References Cited

U.S. PATENT DOCUMENTS 3,683,562 A 8/1972 Day
3,921,342 A 11/1975 Day (Continued)

FOREIGN PATENT DOCUMENTS

CN 1222431 A 7/1999
DE 102004058797 A1 1/2006

(Continued)

OTHER PUBLICATIONS

Application and File history for U.S. Appl. No. 12/424,441, filed Apr. 15, 2009. Inventors: Boutaghou et al.

(Continued)

*Primary Examiner* — Dung Van Nguyen

(57) ABSTRACT

An abrasive article for polishing a substrate surface. The abrasive article includes a holder pad assembly and an abrasive member held in place with respect to a holder pad. The abrasive member further includes a first surface engaged with the holder pad assembly, and a second surface including an abrasive. A preload mechanism is positioned to bias the second surfaces of the abrasive member toward the substrate surface. One or more fluid bearing features on the second surface of the abrasive member is configured to generate lift forces during relative motion between the abrasive article and the substrate surface.

24 Claims, 59 Drawing Sheets

(56) References Cited

U.S. PATENT DOCUMENTS 4,821,461 A 4/1989 Holmstrand
4,980,536 A 12/1990 Asch et al.
5,024,968 A 6/1991 Engelsberg
5,099,557 A 3/1992 Engelsberg
5,152,917 A 10/1992 Pieper et al.
5,212,873 A 5/1993 McMurtry
5,304,223 A 4/1994 Pieper et al.
5,386,666 A 2/1995 Cole
5,435,816 A 7/1995 Spurgeon
5,437,754 A 8/1995 Calhoun
5,454,844 A 10/1995 Hibbard et al.
5,456,736 A 10/1995 Waki et al.
5,489,235 A 2/1996 Gagliardi et al.
5,494,473 A 2/1996 Dupuis et al.
5,591,073 A 1/1997 Turgeon
5,632,669 A 5/1997 Azarian et al.
5,643,343 A 7/1997 Selifanov et al.
5,725,617 A 3/1998 Hagiwara et al.
5,774,305 A 6/1998 Boutaghou
5,827,112 A 10/1998 Ball
5,849,135 A 12/1998 Selwyn
5,856,896 A 1/1999 Berg et al.
5,858,474 A 1/1999 Meyer et al.
5,877,088 A 3/1999 Samitsu et al.
5,885,131 A 3/1999 Azarian et al.
5,958,794 A 9/1999 Bruxvoort et al.
5,991,113 A 11/1999 Meyer et al.
6,069,771 A 5/2000 Boutaghou et al.
6,092,253 A 7/2000 Moinpour et al.
6,118,426 A 9/2000 Albert et al.
6,120,588 A 9/2000 Jacobson
6,121,143 A 9/2000 Messner et al.
6,123,612 A 9/2000 Goers
6,135,856 A 10/2000 Tjaden et al.
6,153,281 A * 11/2000 Meyer et al. ..... 428/848.5
6,157,515 A 12/2000 Boutaghou
6,177,921 B1 1/2001 Comiskey et al.
6,194,317 B1 2/2001 Kaisaki et al.
6,209,411 B1 4/2001 McMurtry
6,252,564 B1 6/2001 Albert et al.
6,270,392 B1 8/2001 Hayashi et al.
6,273,793 B1 8/2001 Liners et al.
6,312,971 B1 11/2001 Amundson et al.
6,334,229 B1 1/2002 Moinpour et al.
6,358,123 B1 3/2002 Liners et al.
6,406,504 B1 6/2002 Lise et al.
6,413,790 B1 7/2002 Duthaler et al.
6,422,687 B1 7/2002 Jacobson
6,459,260 B1 10/2002 Bonin et al.
6,459,418 B1 10/2002 Comiskey et al.
6,493,192 B2 12/2002 Crane et al.
6,521,489 B2 2/2003 Duthaler et al.
6,543,299 B2 4/2003 Taylor
6,545,291 B1 4/2003 Amundson et al.
6,568,992 B1 5/2003 Angelo et al.
6,612,917 B2 9/2003 Bruxvoort
6,634,929 B1 10/2003 Visser
6,639,578 B1 10/2003 Comiskey et al.
6,652,075 B2 11/2003 Jacobson
6,652,354 B2 11/2003 Hayashi et al.
6,669,745 B2 12/2003 Prichard et al.
6,714,386 B1 3/2004 Polycarpou et al.
6,744,602 B2 6/2004 Rao et al.
6,750,473 B2 6/2004 Amundson et al.
6,761,746 B2 7/2004 Rich et al.
6,769,975 B2 8/2004 Sagawa
6,805,137 B2 10/2004 Bailey et al.
6,811,467 B1 11/2004 Beresford et al.
6,821,189 B1 11/2004 Coad et al.
6,825,829 B1 11/2004 Albert et al.
6,857,937 B2 2/2005 Bajorek
6,872,127 B2 3/2005 Lin et al.
6,875,086 B2 4/2005 Golzarian et al.
6,900,135 B2 5/2005 Somekh et al.
6,929,539 B2 8/2005 Schutz et al.
6,935,013 B1 8/2005 Markevitch et al.
6,949,128 B2 9/2005 Annen
6,952,330 B1 10/2005 Riddering et al.
6,953,385 B2 10/2005 Singh, Jr.
6,963,464 B2 11/2005 Xu et al.
6,967,640 B2 11/2005 Albert et al.
6,984,935 B2 1/2006 Chiu et al.
7,057,856 B2 6/2006 Bonin et al.
7,148,128 B2 12/2006 Jacobson
7,160,178 B2 1/2007 Gagliardi et al.
7,185,384 B2 3/2007 Sun et al.
7,189,333 B2 3/2007 Henderson
7,193,805 B1 3/2007 Haddock
7,195,549 B2 3/2007 Baldoni et al.
7,198,553 B2 4/2007 Goers
7,203,033 B2 4/2007 Boutaghou
7,218,478 B2 5/2007 Mate et al.
7,262,931 B2 8/2007 Nakamura et al.
7,275,311 B2 10/2007 Markevitch et al.
7,326,102 B2 2/2008 Fujii et al.
7,355,810 B2 4/2008 Asakura
7,367,875 B2 5/2008 Slutz et al.
7,382,363 B2 6/2008 Albert et al.
7,383,723 B2 6/2008 Tregub et al.
7,388,726 B1 6/2008 McKenzie et al.
7,404,756 B2 7/2008 Ouderkirk et al.
7,428,124 B1 9/2008 Song et al.
7,430,098 B1 9/2008 Song et al.
7,455,810 B2 11/2008 Fontana et al.
7,456,538 B2 11/2008 Nai et al.
7,469,443 B2 12/2008 Liou et al.
7,485,345 B2 2/2009 Renn et al.
2003/0126804 A1 7/2003 Rosenflanz et al.
2003/0148106 A1 8/2003 Ma et al.
2004/0033772 A1 2/2004 Goers
2004/0040575 A1 3/2004 Tregub et al.
2004/0072510 A1 4/2004 Kinoshita et al.
2004/0224508 A1 11/2004 Engel et al.
2005/0032462 A1 2/2005 Gagliardi et al.
2005/0071986 A1 4/2005 Lackey et al.
2005/0287032 A1 12/2005 Tregub et al.
2006/0025059 A1 2/2006 Gueorguiev et al.
2006/0285248 A1 12/2006 Pust et al.
2007/0035881 A1 2/2007 Burbank et al.
2007/0093181 A1 4/2007 Lugg et al.
2007/0107317 A1 5/2007 Takahagi et al.
2007/0111645 A1 5/2007 Hu et al.
2008/0004743 A1 1/2008 Goers et al.
2008/0008822 A1 1/2008 Kowalski et al.
2008/0015102 A1 1/2008 Rosenflanz et al.
2008/0053000 A1 3/2008 Palmgren et al.
2008/0199360 A1 8/2008 Shahriari
2009/0038234 A1 2/2009 Yin
2009/0067082 A1 3/2009 Albrecht
2010/0000160 A1 1/2010 Lugg et al.
2010/0266812 A1 10/2010 Lugg
2010/0266862 A1 10/2010 Lugg et al.
2010/0279586 A1 11/2010 Schwappach et al.
2010/0317262 A1 12/2010 Boutaghou
2010/0330890 A1* 12/2010 Boutaghou ..... 451/540
2011/0027549 A1 2/2011 Boutaghou
2011/0034107 A1 2/2011 Boutaghou
2011/0104989 A1 5/2011 Boutaghou
2011/0159784 A1 6/2011 Boutaghou et al.
2011/0230126 A1 9/2011 Boutaghou
2011/0244770 A1 10/2011 Boutaghou
2011/0256803 A1 10/2011 Boutaghou
2012/0122380 A1 5/2012 Schwappach et al.
2012/0149283 A1 6/2012 Schwappach et al.
2012/0281315 A1 11/2012 Schwappach et al.
2013/0005229 A1 1/2013 Schwappach et al.
2013/0040542 A1 2/2013 Schwappach et al.

FOREIGN PATENT DOCUMENTS

JP 10286777 10/1998
WO WO 95/07797 A1 3/1995
WO WO 95/22436 A1 8/1995
WO WO 02/29813 A2 4/2002

(56) References Cited

FOREIGN PATENT DOCUMENTS

OTHER PUBLICATIONS

Application and File history for U.S. Appl. No. 12/753,479, filed Apr. 2, 2010. Inventors: Boutaghou.
Application and File history for U.S. Appl. No. 12/766,473, filed Apr. 23, 2010. Inventors: Walker et al.
Application and File history for U.S. Appl. No. 12/766,515, filed Apr. 23, 2010. Inventors: Boutaghou et al.
Application and File history for U.S. Appl. No. 12/784,908, filed May 21, 2010. Inventors: Boutaghou et al.
Application and File history for U.S. Appl. No. 13/275,948, filed Oct. 18, 2011. Inventors: Schwappach et al.
Application and File history for U.S. Appl. No. 13/289,797, filed Nov. 4, 2011. Inventors: Schwappach et al.
Application and File history for U.S. Appl. No. 13/423,396, filed Mar. 19, 2012. Inventor: Schwappach et al.
Application and File history for U.S. Appl. No. 13/430,297, filed Mar. 26, 2012. Inventors: Schwappach et al.
Application and File history for U.S. Appl. No. 13/492,513, filed Jun. 8, 2012. Inventors: Schwappach et al.
Application No. PCT/US2010/040595, filed Jun. 30, 2010, International Search Report and Written Opinion dated Oct. 5, 2010.

* cited by examiner

ABRASIVE ARTICLE WITH ARRAY OF COMPOSITE POLISHING PADS

RELATED APPLICATIONS

The present application is a divisional of U.S. application Ser. No. 12/784,908, entitled Array of Abrasive Members with Resilient Support, filed May 21, 2010, which is a continuation-in-part of U.S. application Ser. No. 12/766,473, entitled Abrasive Article with Array of Gimballed Abrasive Members and Method of Use, filed Apr. 23, 2010, which claims the benefit of U.S. Provisional Patent Application Nos. 61/174,472 entitled Method and Apparatus for Atomic Level Lapping, filed Apr. 30, 2009; 61/187,658 entitled Abrasive Member with Uniform Height Abrasive Particles, filed Jun. 16, 2009; 61/220,149 entitled Constant Clearance Plate for Embedding Diamonds into Lapping Plates, filed Jun. 24, 2009; 61/221,554 entitled Abrasive Article with Array of Gimballed Abrasive Members and Method of Use, filed Jun. 30, 2009; 61/232,425 entitled Constant Clearance Plate for Embedding Abrasive Particles into Substrates, filed Aug. 8, 2009; 61/232,525 entitled Method and Apparatus for Ultrasonic Polishing, filed Aug. 10, 2009; 61/248,194 entitled Method and Apparatus for Nano-Scale Cleaning, filed Oct. 2, 2009; 61/267,031 entitled Abrasive Article with Array of Gimballed Abrasive Members and Method of Use, entitled Dec. 5, 2009; and 61/267,030 entitled Dressing Bar for Embedding Abrasive Particles into Substrates, filed Dec. 5, 2009, all of which are hereby incorporated by reference.

FIELD OF THE INVENTION

An abrasive article with an array of polishing pads adapted to polish substrates. The individual polishing pads are allowed to move independently along at least a pitch axis and a roll axis. A preload is applied to the polishing pads. The polishing pads can include abrasive features, or can interact with free abrasive particles at an interface with the substrate, or a combination thereof.

BACKGROUND OF THE INVENTION

Semiconductor wafers are typically fabricated using photolithography, which is adversely affected by inconsistencies or unevenness in the wafer surface. This sensitivity is accentuated with the current drive toward smaller, more highly integrated circuit designs. After each layer of the circuit is etched on the wafer, an oxide layer is put down as the base for the next layer. Each layer of the circuit can create roughness and waviness to the wafer that is preferably removed before depositing the next circuit layer. For many semiconductor applications the chemical mechanical processing ("CMP") is customized for each layer. A change in a single processing parameter, such as for example, pad design, slurry formulation, or pressure applied by the pad, can require the entire CMP process to be redesigned and recertified.

Magnetic media have similarly stringent planarization requirements as data densities approach 1 Terabyte/inch$^2$ (1 Tbit/in$^2$) and beyond, especially on bit patterned media and discrete track media, such as illustrated in U.S. Pat. Publication 2009/0067082. FIGS. 1 and 2 illustrate the shape of bits formed by etching, such as ion milling or reactive etching. Note that the tops of the bits are rounded, leading to head media spacing loss, roughness at the rounded areas, and magnetic damage due to etching of magnetic materials. Such bits are not viable for magnetic recording. The uneven material increases head media spacing and potential damage to the diamond-like-carbon overcoats. CMP processes have proven inadequate to achieving smooth and flat tops both before and after magnetic material deposition.

CMP is currently the primary approach to planarizing wafers, semiconductors, optical components, magnetic media for hard disk drives, and bit patterned or discrete track media (collectively "substrates"). CMP uses pads to press sub-micron sized particles suspended in the slurry against the surface of the substrate. The nature of the material removal varies with the hardness of the CMP pad. Soft CMP pads conform to the nanotopography and tend to remove material generally uniformly from the entire surface. Hard CMP pads conform less to the nanotopography and therefore remove more material from the peaks or high spots on the surface and less material from low spots.

Traditionally, soft CMP pads have been used to remove a uniform surface layer, such as removing a uniform oxide layer on a semiconductor device. Polishing a substrate with a soft pad also transfers various features from the polishing pad to the substrate. Roughness and waviness is typically caused by uneven pressure applied by the pad during the polishing process. The uneven pressure can be caused by the soft pad topography, the run out of the moving components, or the machined imperfections transferred to the pads. Run-out is the result of larger pressures at the edges of the substrate due to deformation of the soft pad. Soft pad polishing of heterogeneous layered materials, such as semiconductor devices, causes differential removal and damage to the electrical devices.

A CMP pad is generally of a polyurethane or other flexible organic polymer. The particular characteristics of the CMP pad such as hardness, porosity, and rigidity, must be taken into account when developing a particular CMP process for processing of a particular substrate. Unfortunately, wear, hardness, uneven distribution of abrasive particles, and other characteristics of the CMP pad may change over the course of a given CMP process. This is due in part to water absorption as the CMP pad takes up some of the aqueous slurry when encountered at the wafer surface during CMP. This sponge-like behavior of the CMP pad leads to alteration of CMP pad characteristics, notably at the surface of the CMP pad. Debris coming from the substrate and abrasive particles can also accumulate in the pad surface. This accumulation causes a "glazing" or hardening of the top of the pad, thus making the pad less able to hold the abrasive particles of the slurry and decreasing the pad's overall polishing performance. Further, with many pads the pores used to hold the slurry become clogged, and the overall asperity of the pad's polishing surface becomes depressed and matted.

Shortcomings of current CMP processes affect other aspects of substrate processing as well. The sub-micron particles used in CMP tend to agglomerate and strongly adhere to each other and to the substrate, resulting in nano-scale surface defects. Van der Waals forces create a very strong bond between these surface debris and the substrate. Once surface debris form on a substrate it is very difficult to effectively remove them using conventional cleaning methods. Various methods are known in the art for removing surface debris from substrates after CMP, such as disclosed in U.S. Pat. Nos. 4,980,536; 5,099,557; 5,024,968; 6,805,137 (Bailey); U.S. Pat. No. 5,849,135 (Selwyn); U.S. Pat. No. 7,469,443 (Liou); U.S. Pat. No. 6,092,253 (Moinpour et al.); U.S. Pat. No. 6,334,229 (Moinpour et al.); U.S. Pat. No. 6,875,086 (Golzarian et al.); U.S. Pat. No. 7,185,384 (Sun et al.); and U.S. Patent Publication Nos. 2004/0040575 (Tregub et al.); and 2005/0287032 (Tregub et al.), all of which are incorporated by reference, but have proven inadequate for the next generation semiconductors and magnetic media.

Current processing of substrates for semiconductor devices and magnetic media treats uniform surface layer reduction, planarization to remove waviness, and cleaning as three separate disciplines. The incremental improvements in each of these disciplines have not kept pace with the shrinking feature size of features demanded by the electronics industry.

BRIEF SUMMARY OF THE INVENTION

The present disclosure is directed to an abrasive article for polishing a substrate surface. The abrasive article includes a holder pad assembly and an abrasive member held in place with respect to a holder pad. The abrasive member further includes a first surface engaged with the holder pad assembly, and a second surface including an abrasive. A preload mechanism is positioned to bias the second surfaces of the abrasive member toward the substrate surface. One or more fluid bearing features on the second surface of the abrasive member are configured to generate lift forces during relative motion between the abrasive article and the substrate surface.

In one embodiment, at least one abrasive feature is located on the second surface of the abrasive member. The abrasive feature applies a cutting force to the substrate surface during relative motion between the abrasive article and the substrate surface. The fluid bearing can be hydrostatic or hydrodynamic. The abrasive feature can be diamond like carbon or aluminum oxide. The abrasive feature can be a shaped abrasive feature.

The present disclosure is also directed to a flexible foil bearing abrasive article for polishing a substrate surface. The abrasive article includes a preload assembly and a flexible foil web held over the preload assembly. The flexible foil web further includes a first surface with one or more fluid bearings fabricated on the flexible foil web to generate lift forces during motion of the abrasive article relative to the substrate surface, and a second surface engaging the preload assembly. A mechanism is provided that biases the second surface of the abrasive members toward the substrate surface.

At least one abrasive feature is located on the first surface of the flexible foil web. The abrasive feature applies cutting forces to the substrate surface during relative motion of the abrasive article and the substrate surface. In one embodiment, the preload assembly is a hydrostatic pressure bed fabricated on a curved contactor. In another embodiment, the preload assembly is a gimbal assembly with a negative suction cup. The fluid bearing can be hydrostatic or hydrodynamic. The preload further includes a pressure contact sensors located on a hydrostatic bed.

The present disclosure is also directed to a flexible foil bearing abrasive article for polishing a substrate surface. The abrasive article includes a flexible foil web under tension. A hydrostatic preload is provided with a plurality of closed form hydrostatic beds separated by grooves or gaps connected to ambient pressure. The flexible foil includes a first non-abrasive foil surface and a second abrasive foil surface. The first non-abrasive foil surface engages the hydrostatic preload to impart bearing surfaces on the abrasive second flexible foil bearing surface. A mechanism is provided that biases the second abrasive surface toward the substrate surface. An abrasive feature is located on the second surface of the flexible foil web. The abrasive feature applies cutting forces to the substrate surface during motion of the abrasive article relative to the substrate surface.

The hydrostatic preload includes pressure contact sensors located at a closed form hydrostatic bed. The fluid bearing can be hydrostatic or hydrodynamic. The second abrasive surface can include diamond like carbon or alumina.

The present disclosure is also directed to a flexible foil bearing abrasive article for polishing a substrate surface. The abrasive article includes a foil hydrodynamic bearing suspended with non-straight links between two tensioned tapes. A mechanism is provided that biases the second surfaces of the abrasive members toward the substrate surface. Abrasive features are located on a surface of the flexible foil nearest the substrate surface. The abrasive features applying cutting forces to the substrate during motion of the abrasive article relative to the substrate.

The foil hydrodynamic bearing is optionally suspended with a gimballing mechanism or a hydrostatic preload.

The present disclosure is also directed to a method of polishing a surface of a substrate. The method includes the steps of biasing a flexible foil web under tension wrapped around a hydrostatic preload toward the surface of the substrate; pressurizing an abrasive surface of the flexible foil web to provide a contact pressure for the abrasive surface; and monitoring the pressure between the substrate and the abrasive with a pressure opening in the hydrostatic preload.

In one embodiment, abrasive features are located at an interface of the polishing pads and the substrate. The abrasive features polishing the substrate during motion of the polishing article relative to the substrate. The abrasive features can be one or more of an abrasive material attached to the polishing pads, a slurry of free abrasive particles located at the interface with the substrate, or a combination thereof.

The polishing pads are preferably arranged in a circular array, a rectangular array, an off-set pattern, or a random pattern.

The polishing pads optionally include one or more fluid bearing features configured to generate lift forces during motion of the polishing article relative to the substrate. The fluid bearing features are optionally abrasive composites. The lift force is one of aerodynamic lift or hydrodynamic lift.

The polishing pads can be configured to be one of topography following or topography removing. The polishing article optionally includes at least one sensor. The preload flexures are optionally springs.

The present application is also directed to an abrasive article with an array of independently gimballed abrasive members that are capable of selectively engaging with nanometer-scale and/or micrometer-scale height variations and micrometer-scale and/or millimeter-scale wavelengths of waviness, on the surfaces of substrates. The gimbals permit each abrasive member to move independently in at least pitch and roll relative to the substrate. The present abrasive article can be used before or after features are formed on the substrates.

In one embodiment, each abrasive member maintains a fluid bearing (air is the typical fluid) with the substrate. The spacing, which includes clearance, pitch, and roll, of the abrasive members can be adjusted to follow the topography of the substrate to remove a generally uniform layer of material; to engage with the peaks on the substrate to remove target wavelengths of waviness; and/or to remove debris and contamination from the surface of the substrate.

A hydrodynamic and/or hydrostatic bearing is used to provide vertical, pitch and roll stiffness to the abrasive member and to control the spacing and pressure distribution across the fluid bearing features on the abrasive members. Adjustments to certain variables, such as for example, the spacing (which includes minimal spacing and attitude of the abrasive members), pitch and roll stiffness which control attitude, the preload, and/or the abrasive features can be used to modify the cutting force applied to the substrate Fluid bearing structures are fairly complex with a substantial number of variables involved in their design. The primary forces involved in a given fluid bearing are the gimbal structure and the preload. The gimbal structure applies both a pitch and roll moments to the individual abrasive members, and hence, the fluid bearing structures. If the gimbal is extremely stiff, the fluid bearing may not be able to form a pitch or roll angle. The preload and preload offset (location where the preload is applied) bias the fluid bearing toward the substrate. The preload is typically applied by a different structure than the gimbal structure.

Fluid bearing surface geometry plays a large role in pressurization of the bearing. Possible geometries include tapers, steps, trenches, crown, cross curves, twists, wall profile, and cavities. Finally, external factors such as viscosity of the bearing fluid and linear velocity play an extremely important role in pressurizing bearing structures.

The individual abrasive members are capable of selectively engaging with nanometer-scale and micrometer-scale height variations and/or micrometer-scale or millimeter-scale wavelengths of waviness on the surface of substrates to perform one or more of the following three overlapping and complementary functions: 1) following the topography of the substrate to remove a generally uniform layer of material; 2) engaging with the peaks on the substrate to remove target wavelengths of waviness; and/or 3) removing debris and contamination from the surface of the substrate. Consequently, the present abrasive articles can be engineered to perform a wide variety of functions, including lapping, planarization, polishing, cleaning, and burnishing substrates.

In connection with performing any of these three functions, the abrasive members may 1) include abrasive features positioned to interact with the substrate, 2) interact with free abrasive particles at the interface with the substrate, or 3) a combination thereof. Free abrasive particles can be used with either topography following or topography removing abrasive members.

While the abrasive features generally have a hardness greater than the substrate, this property is not required for every embodiment since any two solid materials that repeatedly rub against each other will tend to wear each other away. For example, relatively soft polymeric abrasive features molded on the abrasive members can be used to remove surface contaminants or can interact with free abrasive particles to remove material from the surface of a harder substrate. As used herein, "abrasive feature" refers to a portion of an abrasive member that comes in physical contact with a substrate or a contaminant on a substrate, independent of the relative hardness of the respective materials and the resulting cut rate.

FIG. 3A is a schematic illustration of a topography following abrasive member 1000 in accordance with an embodiment of the present invention. The abrasive member 1000 is typically designed to follow the topography by assuring that the trailing edge area has the largest pressure peak. For example, the fluid bearing can be pitched to ensure that the leading edge is spaced substantially higher above the substrate than the trailing edge. The trailing edge 1006 of the abrasive member 1000 applies a cutting force to nanometer-scale and/or micron-scale height variations 1008 on the surface 1004, while following the millimeter-scale and/or micrometer-scale wavelengths in the waviness 1010 on the substrate. Consequently, the abrasive member 1000 removes a generally uniform layer of material 1012 from peaks 1014 as well as valleys 1016 on the surface 1004, such as for example, removing or controlling the thickness of an oxide layer. As used herein, "topography following" refers to an individually gimbaled abrasive member that generally follows millimeter-scale and/or micrometer-scale wavelengths of waviness on a substrate, while engaging with nanometer-scale height variations to primarily remove a generally uniform amount of material from the surface.

FIG. 3B is a schematic illustration of a topography removing abrasive member 1050 in accordance with an embodiment of the present invention. The leading edge 1056 and/or trailing edge 1058 of the abrasive member 1050 applies a cutting force to peaks 1060 of millimeter-scale and/or micrometer-scale wavelengths of the waviness 1062 on the surface 1054 of the substrate, with minimal engagement with the valleys 1064. Consequently, the abrasive member 1050 removes more material from the peaks 1060 than the valleys 1064. As used herein, "topography removing" refers to an individually gimbaled abrasive member that primarily removes nanometer-scale and/or micrometer-scale height variations from peaks of millimeter-scale and/or micrometer-scale wavelengths in the waviness on a substrate.

FIG. 3C is a schematic illustration of a cleaning abrasive member 1100 in accordance with an embodiment of the present invention. The leading edge 1114 and/or the trailing edge 1106 of the abrasive member 1100 follows the millimeter-scale and/or micrometer-scale wavelengths in the waviness 1108 on the substrate, while applying a cutting force to nanometer-scale and/or micron-scale contaminants 1110. The abrasive member 1100 preferably has a spacing 1112 such that little or no material is removed from the surface 1104 of the substrate other than the contaminants 1110. As used herein, "cleaning" refers to an individually gimbaled abrasive member that generally follows millimeter-scale and/or micrometer-scale wavelengths in the waviness of a substrate, while primarily engaging with nanometer-scale and/or micrometer-scale height contaminant on the surface, with little or no material removal from the surface.

Since the abrasive members engage with nanometer-scale and micrometer-scale structures, it is unlikely that any particular embodiment will perform one of the topography following, topography removing, or cleaning functions to the exclusion of the other two. Rather, the present application adopts a probabilistic approach that a particular embodiment is more likely to perform one function, recognizing that the other two functions are also likely being performed in varying degrees.

For example, the topography following abrasive member 1000 of FIG. 3A can also remove some or all of the surface contaminants 1110 of FIG. 3C. In another example, the pressure applied to peaks 1014 in FIG. 3A may be greater than in the valleys 1016, resulting in more material removal from the peaks 1014, such as illustrated in FIG. 3B. The topography removing abrasive member 1050 may engage sidewalls 1066 of the peaks 1060 or the valley 1064, such as illustrated in FIG. 3A. The cleaning abrasive member 1100 may contact the surface 1104 and remove a generally uniform layer of material from the substrate, along with the contaminants 1110. Therefore, the definitions of "topography following", "topography removing", and "cleaning" should not be read as mutually exclusive. It should be assumed that the design parameters of the abrasive members can be modified to emphasize more of one function than the others.

Various abrasive features are available for the present abrasive members, such as for example, a surface roughness formed on the leading and/or trailing edges of the abrasive members. That surface roughness may include a hard coat, such as for example, diamond-like-carbon. In another embodiment, the abrasive features may be discrete abrasive particles, such as for example, fixed diamonds. In yet another embodiment, the abrasive features may be structured abrasives, discussed further below.

For example, to remove all the wavelengths smaller than a desired value, the dimensions of the abrasive members can be greater than the target wavelengths. The wavelengths are determined by the gas pressure profile generated by the abrasive member and the size of the abrasive member. As a rule of thumb, the smallest circumferential wavelength is about one-fourth the length of the abrasive members.

The dimensions of the abrasive members and the pressure profile due to the hydrostatic and/or hydrodynamic lift (gas and/or liquid) determine the ability of the abrasive member to follow the waviness of the substrate. Assuming that the abrasive members can follow ¼ of its size, then all wavelengths smaller than the ¼ will cause interference with the abrasive members and material removal will ensue due to the interactions. Portions of the abrasive members generate a hydrodynamic lift causing predictable waviness following capability and stabilizing force countering the cutting forces.

DETAILED DESCRIPTION OF THE INVENTION

Figure 1:
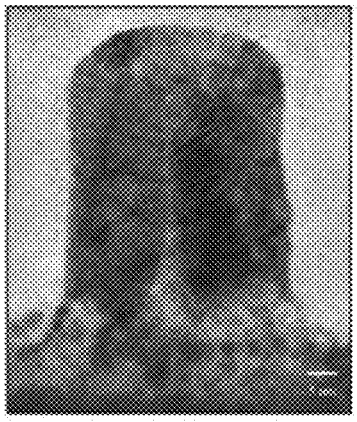
Fig. 1 (PRIOR ART)
FIG. 1 is the configuration of a single bit on a bit patterned media for a hard disk drive.
Figure 2:
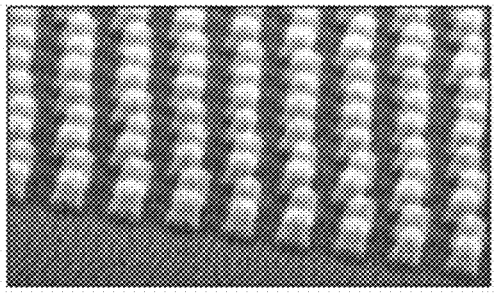
Fig. 2 (PRIOR ART)
FIG. 2 is a perspective view of an array of bits on a bit patterned media.
Figure 3A:
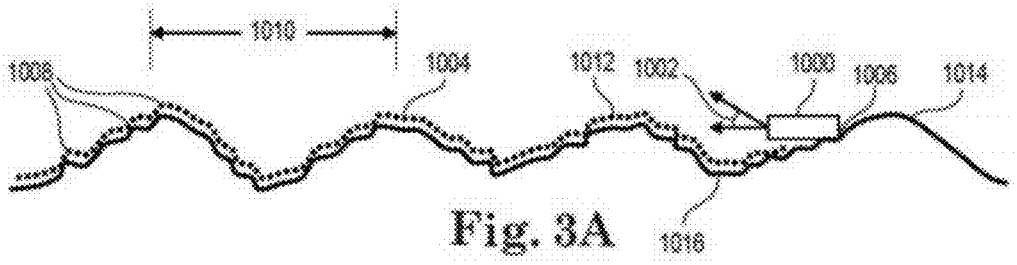
FIG. 3A is a schematic illustration of a topography following abrasive member in accordance with an embodiment of the present disclosure.
Figure 3B:
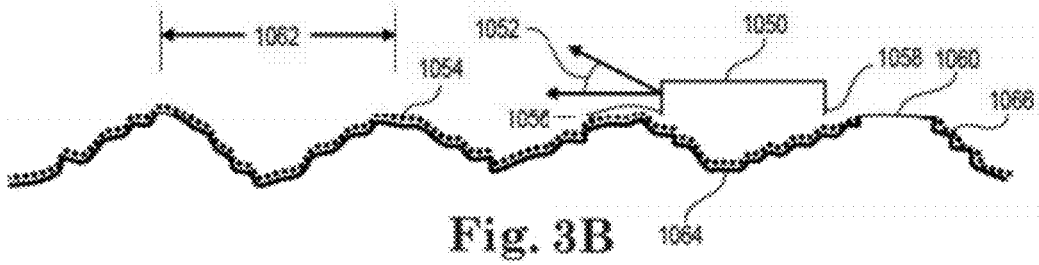
FIG. 3B is a schematic illustration of a topography removing abrasive member in accordance with an embodiment of the present disclosure.
Figure 3C:
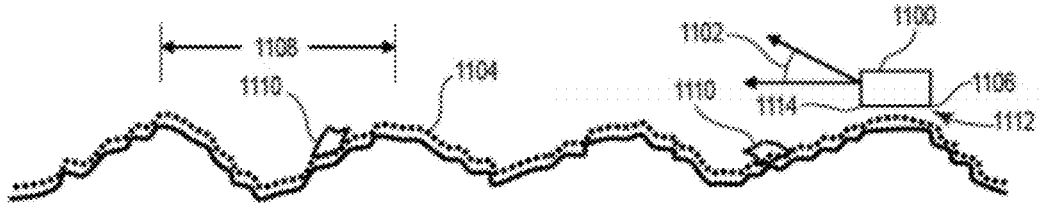
FIG. 3C is a schematic illustration of a cleaning abrasive member in accordance with an embodiment of the present disclosure.
Figure 4:
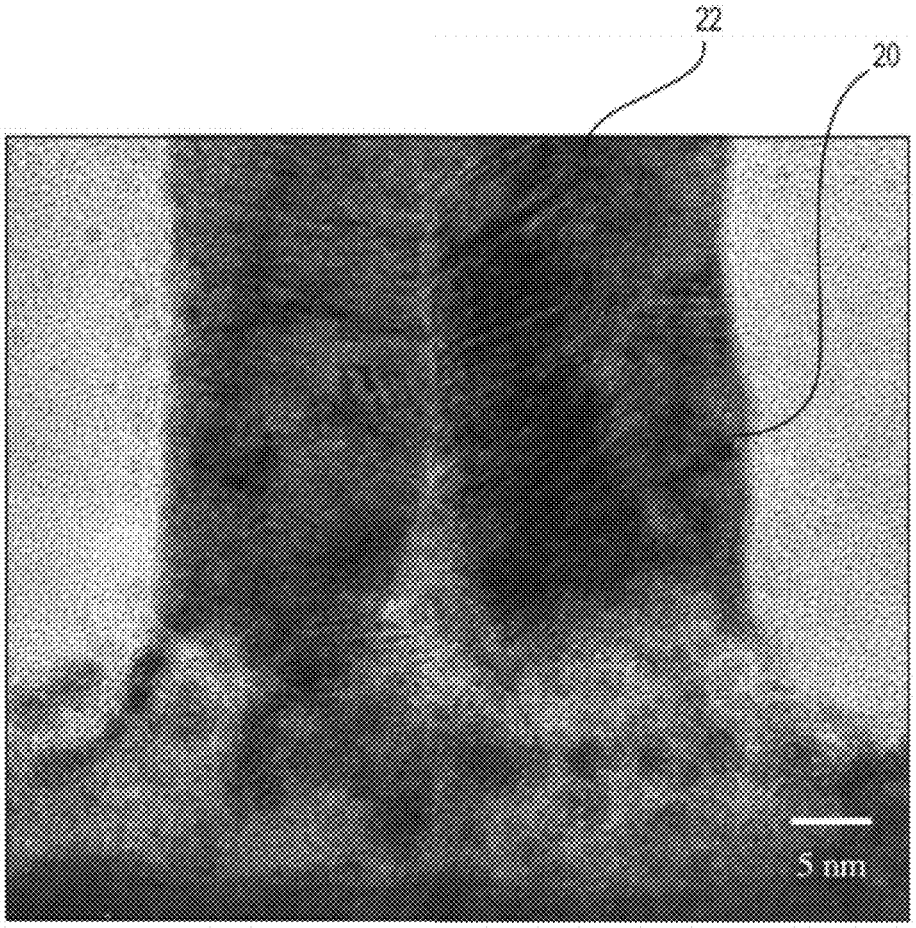
FIG. 4 is a schematic illustration of an idealized bit for bit patterned media in accordance with an embodiment of the present disclosure.

FIG. 4 is a conceptual illustration of bit 20 showing an ideal form for bit pattern bit. Top 22 of the bit 20 is flat promoting constant head media spacing during read and write operations. An abrasive article with an array of gimballed abrasive members in accordance with an embodiment of the present disclosure will permit the bit 20 of FIG. 4 to be manufactured in a production setting.

Figure 5:
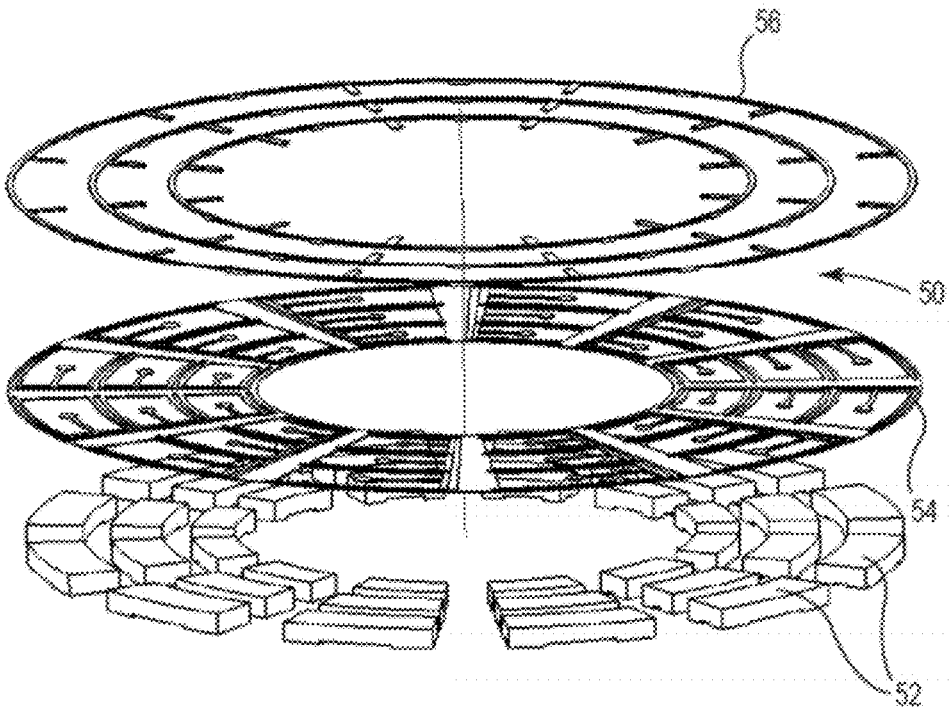
FIG. 5 is an exploded view of an abrasive article with gimbaled abrasive members in accordance with an embodiment of the present disclosure.

FIG. 5 is an exploded view of an abrasive article 50 with an array of gimballed abrasive members 52 in accordance with an embodiment of the present disclosure. The abrasive article 50 includes gimbal structure 54, preload mechanism 56, and the abrasive members 52. The abrasive article 50 can be manufactured in circular and non-circular shapes. The abrasive members 52 can be arranged in a regular pattern a random configuration, an off-set pattern or a variety of other configurations.

Figure 6:
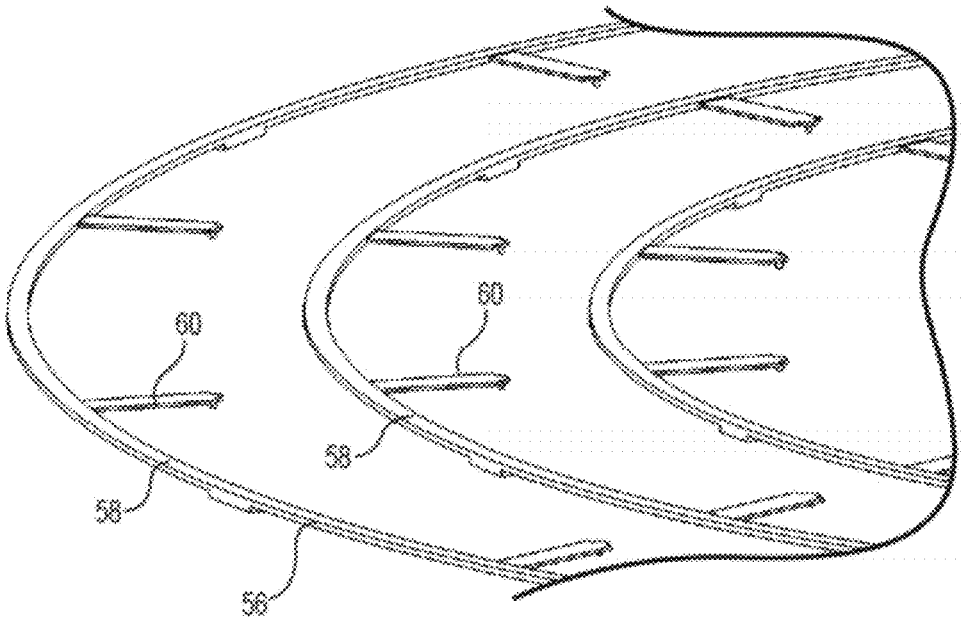
FIG. 6 is a perspective view of a preload mechanism for the abrasive article of FIG. 5.

FIG. 6 provides a detailed view of the preload mechanism 56 of FIG. 5. The preload mechanism 56 includes a series of outer rings 58 each with a plurality of preload beams 60 configured to apply a preload on each of the abrasive members 52 (see e.g., FIG. 11). The preload applied by the beams 60 is preferably concentrated toward the center of the abrasive members 52 so as to not interfere with pitch and roll motions during polishing. Alternatively, the preload beams 60 are positioned to promote topography following or topography removing behavior in the abrasive members 52.

Figure 7:
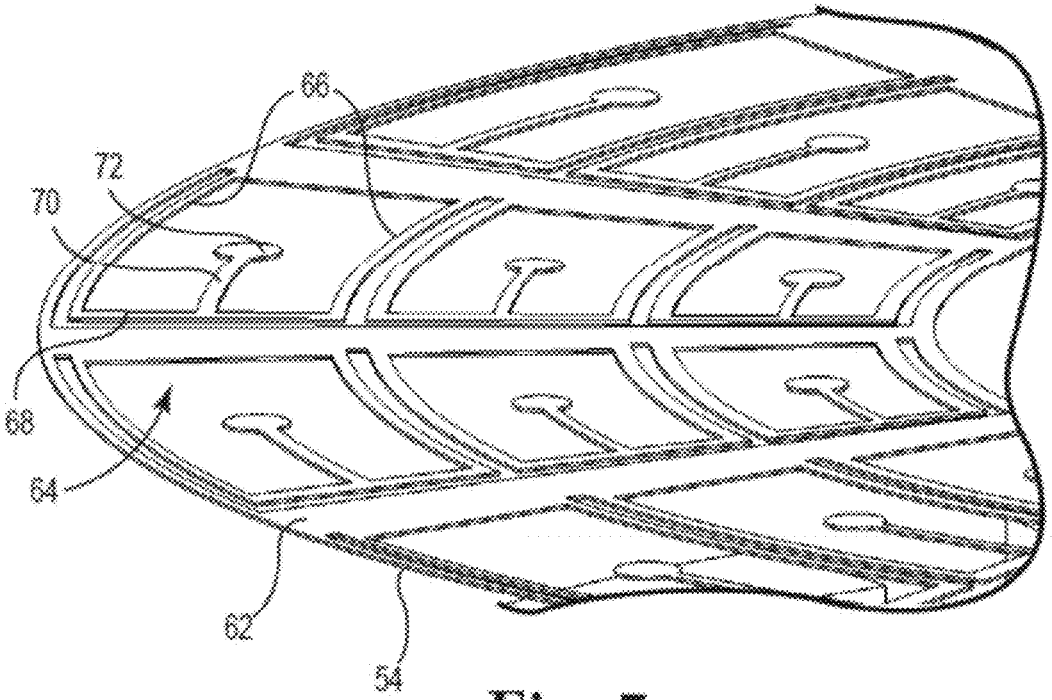
FIG. 7 is a perspective view of a gimbal structure for the abrasive article of FIG. 5.
Figure 8:
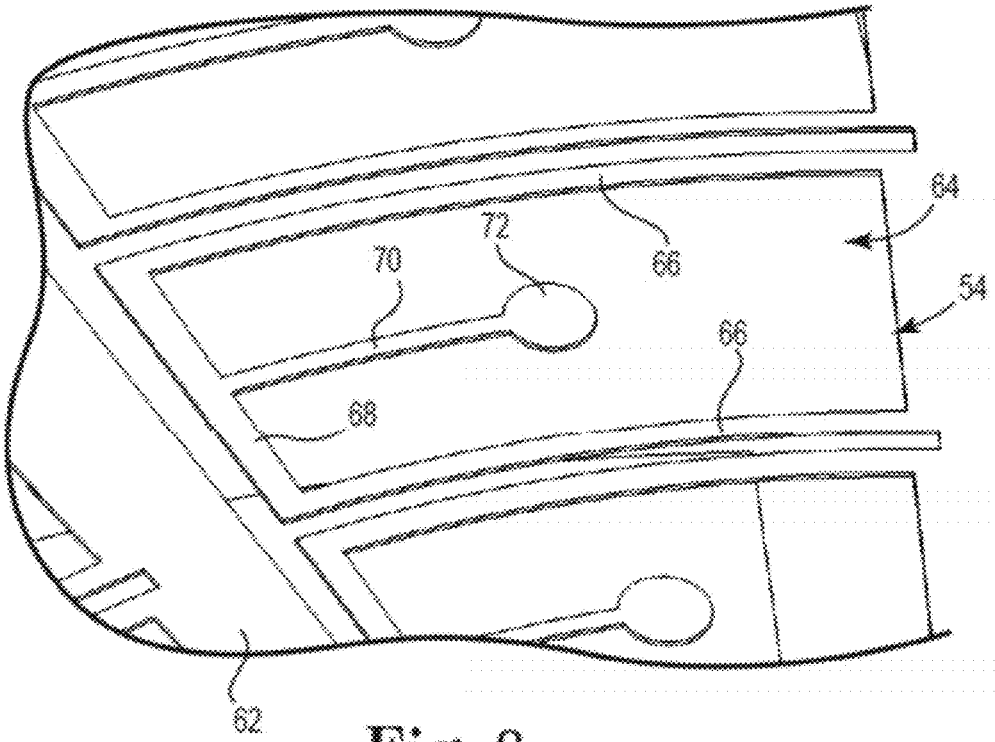
FIG. 8 is a detailed perspective view of a gimbal structure for the abrasive article of FIG. 5.

FIGS. 7 and 8 illustrate the gimbal structure 54 of FIG. 5. Framework 62 supports an array of gimbal assemblies 64. In the illustrated embodiment, each gimbal assembly 64 includes one or more arms 66, a cross member 68 and spring members 70 with attachment features 72. The gimbal assemblies 64 allow each of the abrasive members 52 to independently follow millimeter-scale and micrometer-scale waviness of the substrate during polishing.

The gimbal assemblies 64 control the static attitude or pitch of each abrasive member 52. The arms 66, cross members 68, and spring member 70 permit the abrasive members 52 to move through at least pitch and roll, while assuring adequate torque is applied to the abrasive members 52. The members 66, 68, and 70 can be configured to promote topography following or topography removing behavior in the abrasive members 52. Various alternate gimbal assemblies are disclosed in U.S. Pat. Nos. 5,774,305; 5,856,896; 6,069,771; 6,459,260; 6,493,192; 6,714,386; 6,744,602; 6,952,330; 7,057,856; and 7,203,033, which are hereby incorporated by reference.

Figure 9:
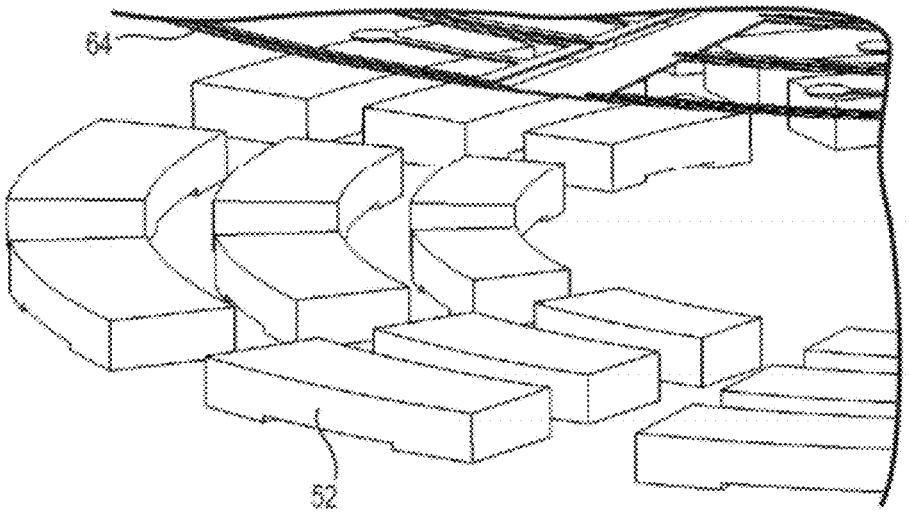
FIG. 9 is a perspective view of the abrasive members for the abrasive article of FIG. 5.

FIG. 9 illustrates the array of abrasive members 52 prior to assembly onto the gimbal assemblies 64. The abrasive members 52 can be made from a variety of materials, such as for example, metal, ceramic, polymers, or composites thereof. The abrasive members 52 are preferably arranged in a random or off-set pattern to impart a uniform polishing pattern onto the substrate.

Figure 10:
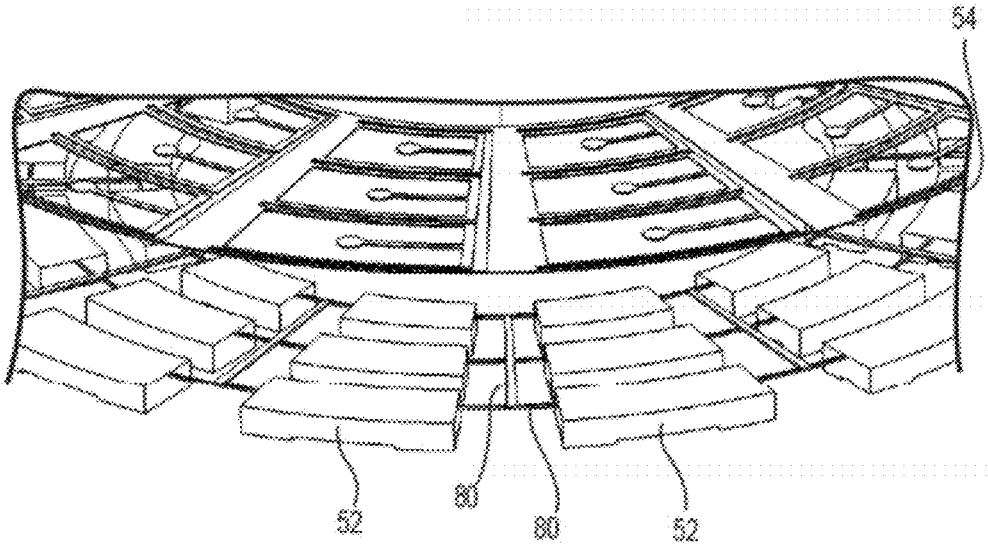
FIG. 10 is another perspective view of the abrasive members for the abrasive article of FIG. 5.

The abrasive members 52 can be fabricated individually as discrete structures or ganged together such as illustrated in FIG. 10. For example, the abrasive members 52 can be fabricated using a mold injection process. In the embodiment of FIG. 10, spacing structures 80 are molded between the abrasive members 52. The spacing structures 80 position the abrasive members 52 during assembly with the gimbal structure 54. The spacing structures 80 can be maintained or removed after assembly is completed.

Figure 11:
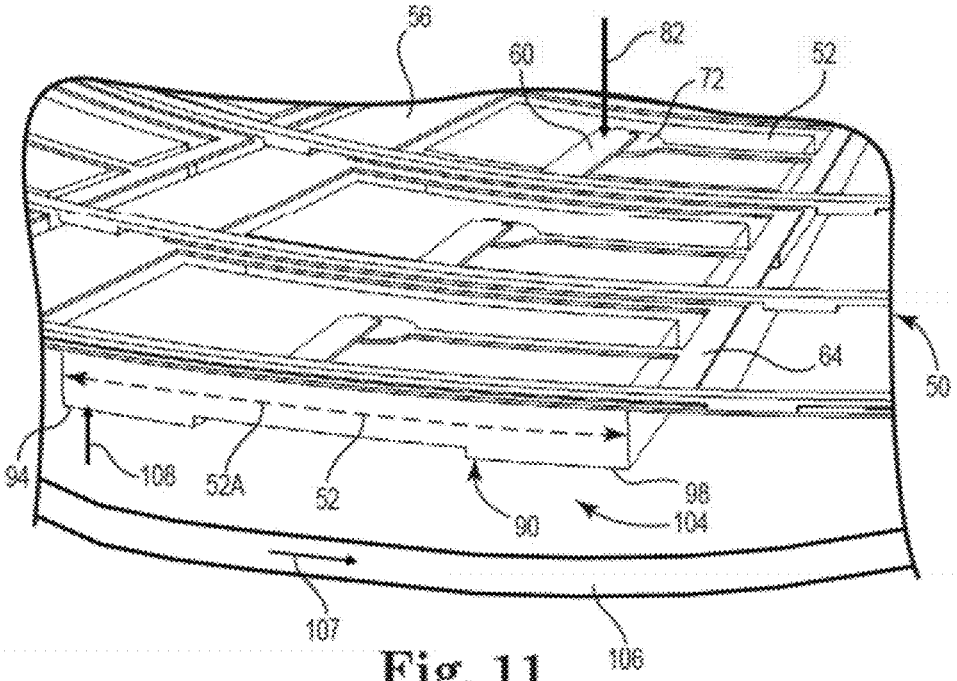
FIG. 11 is a perspective view of the abrasive article of FIG. 5 polishing a substrate in accordance with an embodiment of the present disclosure.

FIG. 11 illustrates the assembled abrasive article 50 positioned to lap substrate 106. The substrate 106 can be a wafer, a wafer-scale semiconductor, magnetic media for hard disk drives, bit patterned or discrete track media, a convention disk for a hard disk drive, or any other substrate. The preload beams 60 on the preload mechanism 56 apply preload 82 to the abrasive members 52. In the illustrated embodiment, the preload beams 60 apply the preload 82 directly to the respective attachment features 72 on the gimbal assemblies 64.

As illustrated in FIG. 11, air shearing forces between the rotating substrate 106 and the abrasive article 50 entrain an air cushion that applies fluid dynamic lift 108 (referred to hereinafter as "lift" or "dynamic lift") on fluid bearing surfaces 90 on the abrasive member 52. The lift 108 can be located at the leading edge 94 and/or the trailing edge 98, although in the illustrated embodiment the lift 108 is concentrated at the leading edge 94 to each abrasive member 52. In an alternate embodiment, the substrate 106 is stationary and the abrasive article 50 rotates. Although the most common fluid used to generate the fluid dynamic lift 108 is air, it is also possible that the lift 108 is generated by a liquid, such as a lubricant. As used herein, the phrase "fluid bearing" refers generically to a fluid (i.e., liquid or gas) present at an interface between an abrasive member and a substrate that applies a lift force on the abrasive member. Fluid bearings can be generated hydrostatically, hydrodynamically, or a combination thereof.

The dynamic lift 108 causes the abrasive members 52 to assume an attitude or pitch during the relative rotation of a substrate 106. The gimbal assemblies 64 allow the abrasive members 52 to follow the micrometer-scale and/or millimeter-scale wavelengths of waviness ("waviness") on the substrate 106, while removing nanometer-scale and/or micrometer-scale height variations. Typically, the leading edges 94 of the abrasive members 52 generate a hydrostatic lift countering the forces generated at the interference 104 between the trailing edge 98 and the substrate 106.

Since each of the abrasive members 52 can independently adjust to the waviness of the substrate 106 and maintain a constant cutting force/pressure, the amount of material removed across the substrate 106 is substantially uniform. The present embodiment is particularly well suited to remove a uniform amount of an oxide layer on a semiconductor. The ability of the abrasive members 52 to follow the waviness enables uniform material removal at a level not attainable by conventional CMP processes. In the case of an air bearing, it is desirable to have a boundary layer of lubricant between the abrasive members 52 and the substrate 106.

The preload force 82 is preferably a fraction of the amount used during conventional lapping. The present system and method typically reduces the preload force 82 by an order of magnitude or more. In one embodiment, the preload 82 is in the range of about 0.1 grams/millimeter$^2$ to about 10 grams/millimeter$^2$ of surface being lapped, compared to about 1 kg/millimeter$^2$ for conventional lapping using an oil flooded lapping media.

Figure 12:
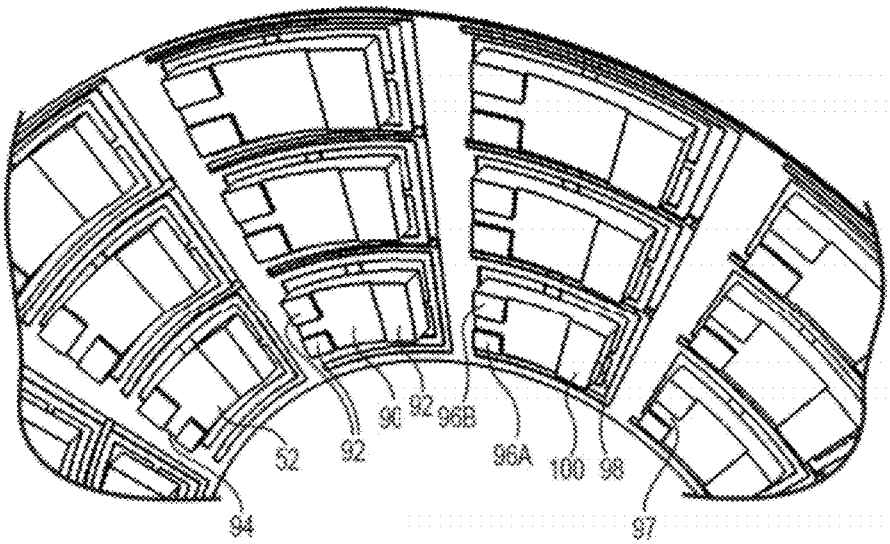
FIG. 12 is a perspective view of the fluid bearing surface on the abrasive members of FIG. 5.
Figure 13:
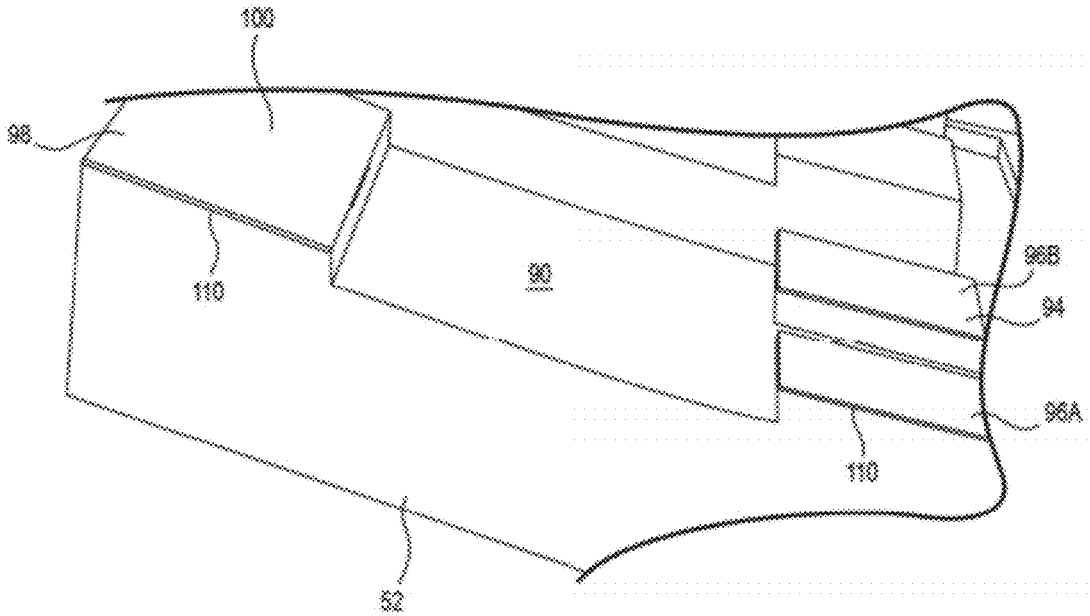
FIG. 13 is a detailed perspective view of the fluid bearing surface on the abrasive members of FIG. 5.

FIGS. 12 and 13 illustrate one possible geometry of the fluid bearing surface 90 of the abrasive members 52. The fluid bearing surfaces 90 include various fluid bearing features 92 that promote the creation of a fluid bearing with the substrate 106. In the illustrated embodiment, leading edge 94 of the fluid bearing surface 90 includes a pair of pressure pads 96A, 96B (collectively "96") separated by gap 97. The trailing edge 98 includes pressure pad 100. A discussion of the lift created by rotating rigid disks is provided in U.S. Pat. No. 7,218,478, which is hereby incorporated by reference.

In one embodiment, the pads 96, 100 can be formed with a crown and cross-curve. The leading edges 94 of the pressure pads 96A, 96B are optionally tapered or stepped to help initiate aerodynamic lift (see, e.g., FIG. 47A). Negative suction force areas can be fabricated in the fluid bearing surface 90 to stabilize the abrasive members 52 during the flying. The fluid bearing surface 90 can also include trenches to enable higher pressurization during the flying.

Figure 14:
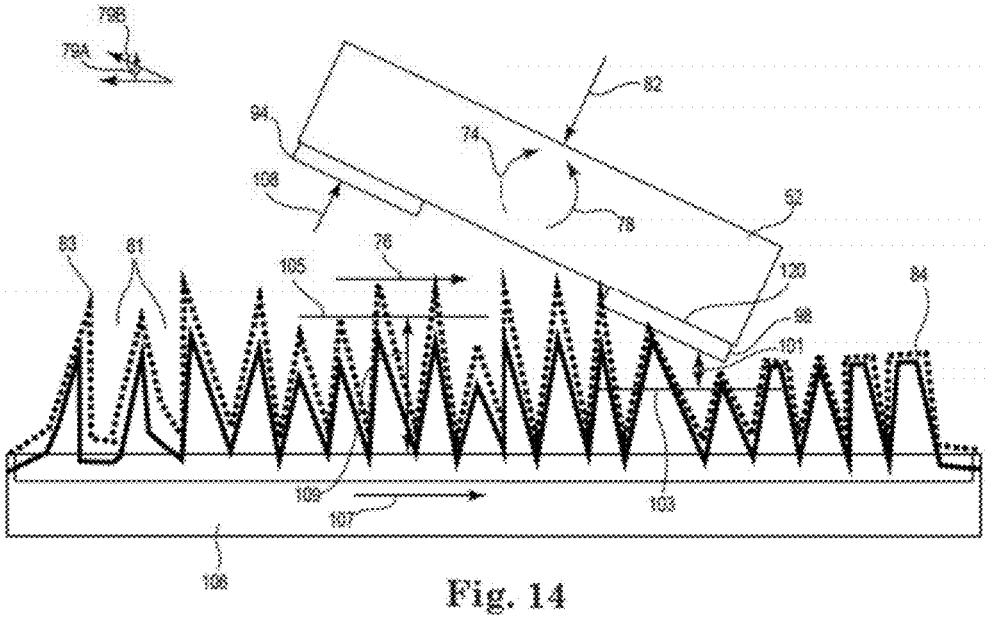
FIG. 14 is a conceptual view of an abrasive member interacting with a substrate in a topography following mode in accordance with an embodiment of the present disclosure.

FIG. 14 is a schematic illustration of the engagement between the abrasive members 52 with the substrate 106 in the topography following mode in accordance with an embodiment of the present disclosure. The peaks 83 and valleys 81 are intended to illustrate nanometer-scale and/or micrometer-scale height variations, although their size relative to the abrasive member 52 is greatly exaggerated. The micrometer-scale and/or millimeter-scale waviness is not illustrated for the sake of simplicity.

The valleys 81 between the peaks 83 entrain sufficient air to permit the abrasive members 52 to "fly" over the substrate 106, even while the trailing edge 98 is in contact with general texture level 105 of the substrate 106.

The leading edges 94 of the abrasive members 52 are raised above the substrate 106 due to lift 108 acting on fluid bearing surface 86. Engagement of the abrasive members 52 with the substrate 106 is defined by pitch angle 79A and roll angle 79B of the abrasive members 52, and clearance 101 with the substrate 106.

The gimbal assembly 56 (see FIG. 11) provides the abrasive members 52 with roll and pitch stiffness that balance by the roll and pitch moments 74 generated by the lift force 108. The frictional forces 76 generated during lapping cause a tipping moment 78 opposite to the moment 74, causing the leading edges 94 of the abrasive members 52 to move toward the substrate 106.

In some embodiments, the lift 108 may be purely aerodynamic, creating a stable, uniform fluid bearing. In some embodiments, the lift 108 may be caused, in part, by lubricant 84 on the substrate 106. Abrasive members 52 in full contact with the substrate 106 experience a large amount of forces and vibrations during the polishing process. The cutting forces and moments tend to cause vibrations and bouncing. The preload and gimbal stiffness need to balance the cutting forces. A lubricant 84 is desirable to keep the frictional forces and cutting forces low enough to prevent chattering and the like.

A boundary layer lubrication regime of a thin film a few atoms thick adhered to the surface of the substrate 106 can be used. Alternatively, the lapping can occur in a fully flood environment. Consequently, the fluid dynamic lift 108 according to the present disclosure may be aerodynamic and/or hydrodynamic in nature. Discussion of the lift created by rotating rigid disks is provided in U.S. Pat. Nos. 7,193,805 and 7,218,478, which are hereby incorporated by reference.

The moment 74 generated by the lift 108 is preferably greater than the moment 78 generated by frictional forces 76 at the interface of the pad 100 with the surface of the substrate 106. The trailing edge 98 is located below the general texture level 105 of the substrate 106 during interference lapping. In operation, the interference between the abrasive members 52 and the substrate 106 is essentially continuous. As used herein, "interference lapping" refers to a clearance with an abrasive member that is less than about half a peak-to-valley roughness of a substrate.

In one embodiment, trailing edge 98 is located at about mid-plane 103 of the peak-to-valley roughness 109. Clearance 101 between the mid-plane 103 and the trailing edge 98 is preferably less than half the peak-to-valley roughness 109 of the substrate 106. For example, if the peak-to-valley roughness 109 is about 50 nanometers, the clearance 101 of the abrasive members 52 is less than about 25 nanometers. As used herein, "clearance" refers to a distance between an abrasive member and a mid-plane of a peak-to-valley roughness of a substrate.

In one embodiment, actuators 120 are provided to thermally expand portions of the abrasive member 52 to perform contact detection with the substrate 106. Contact detection refers to bringing an actuated portion of a fluid bearing surface into contact with a substrate, and then decreasing the actuation to establish a desired level of interference with nanometer-scale and/or micrometer-scale height variations on a surface of a substrate. Contact detection between the abrasive member and the substrate can be performed with a variety of methods including, position signal disturbance stemming from fluid bearing modulation, amplitude ratio and harmonic ratio calculations based on Wallace equations, and piezoelectric based acoustic emission sensors. Various actuators and contact detection systems are disclosed in commonly assigned U.S. patent application Ser. No. 12/424,441 (Boutaghou, et al.), filed Apr. 15, 2009, which is hereby incorporated by reference.

Figure 15:
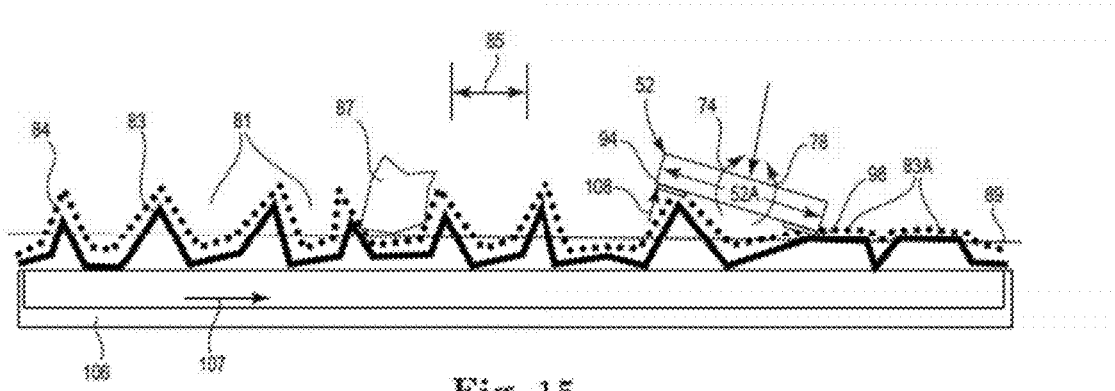
FIG. 15 is a conceptual view of an abrasive member interacting with a substrate in a topography removing mode in accordance with an embodiment of the present disclosure.

FIG. 15 is a schematic illustration of the engagement between the abrasive members 52 with the substrate 106 in the topography removing mode in accordance with an embodiment of the present disclosure. The nanometer-scale and/or micrometer-scale height variations is not illustrated for the sake of simplicity.

The abrasive members 52 have a length 52A measured relative to the motion 107 with substrate 106 that is greater than an approximate wavelength 85 of the peaks 83. The spaces 81 between the peaks 83 entrain sufficient air to permit the abrasive members 52 to "fly" over the substrate 106 at fly height 89 so the trailing edge 98, and in some embodiments the leading edge 94, impacts the peaks 83 or debris 87 located above the fly height 89. The lubricant 84 can be a mono-layer or a flooded environment.

As with the topography following embodiment, the gimbal assembly 56 (see FIG. 11) and the lift force 108 provide the abrasive members 52 with sufficient pitch and roll stiffness to counteract the tipping moment 78 caused by collisions with the peaks 83 or surface debris 87. The interference between the abrasive members 52 and the substrate 106 may be continuous or intermittent. In the illustrated embodiment, the peaks 83A have been removed by the abrasive member 52.

The abrasive members 52 may include abrasive features at the leading edges 94 and/or trailing edges 98, abrasive particles are interposed between the abrasive members 52 and the substrate 106, or a combination thereof.

Figure 16:
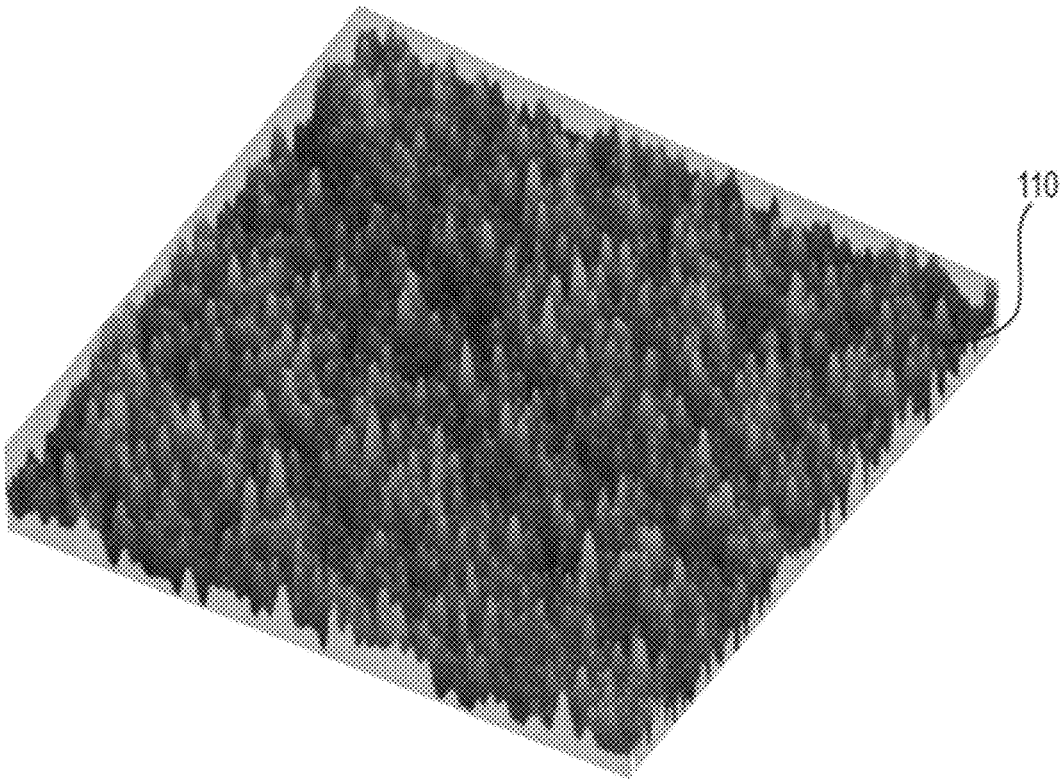
FIG. 16 is a conceptual drawing of a roughened abrasive surface in accordance with an embodiment of the present disclosure.

As illustrated in FIG. 13, the pads 96, 100 may include abrasive features 110 that cause interference with the substrate 106 in order to remove material at the desired rate. In one embodiment, the abrasive features 110 are texture or patterns on the pads 96, 100, such as illustrated in FIG. 16. The abrasive features 110 are preferably in the nanometer range to allow for fluid bearings to be formed. In one embodiment, the abrasive features 110 have a peak-to-peak roughness of about 20 nanometers to about 100 nanometers. The texture 110 can be formed on the pads 96, 100 or transferred from the mold used to manufacture the abrasive members 52.

The abrasive features 110 are preferably covered with a hard coat, such as for example, diamond-like-carbon or other hard overcoats depending on the application. The desired peak-to-peak roughness after application of the hard coat varies from about 10 nanometers to about 30 nanometers to provide effective cutting. The peak-to-valley roughness is preferably about 25 nanometers to about 50 nanometers.

Abrasive members 52 constructed from polymers are compatible with diamond-like-carbons. Diamond-like-carbon ("DLC") thickness varies from about 50 nanometers to about 200 nanometers to provide a hard surface capable of burnishing the substrate. It is highly desirable to generate DLC hardness in the range of 70-90 GPa (Giga-Pascals) to further improve the burnishing process.

In one embodiment the DLC is applied by chemical vapor deposition. As used herein, the term "chemically vapor deposited" and "CVD" refer to materials deposited by vacuum deposition processes, including, but not limited to, thermally activated deposition from reactive gaseous precursor materials, as well as plasma, microwave, DC, or RF plasma arc jet deposition from gaseous precursor materials. Various methods of applying a hard coat to a substrate are disclosed in U.S. Pat. No. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

In another embodiment, nano-diamonds (i.e., with a major diameter less than 1 micrometer) are attached to the pads 96, 100 via existing processes (CVD encapsulation, brazing, adhesives, embedding, etc.). Methods of uniformly dispersing nanometer size abrasive grains are disclosed in U.S. Pat. Pub. No. 2007/0107317 (Takahagi et al.), which is hereby incorporated by reference. Various geometrical features and arrangement of abrasive particles on abrasive articles are disclosed in U.S. Pat. No. 4,821,461 (Holmstrand), U.S. Pat. No. 3,921,342 (Day), and U.S. Pat. No. 3,683,562 (Day), and U.S. Pat. Pub. No. 2004/0072510 (Kinoshita et al), which are hereby incorporated by reference. A two-step adhesion process for attaching diamonds to the pads 96, 100 is disclosed in U.S. Pat. Nos. 7,198,553 and 6,123,612, which are hereby incorporated by reference.

Figure 17:
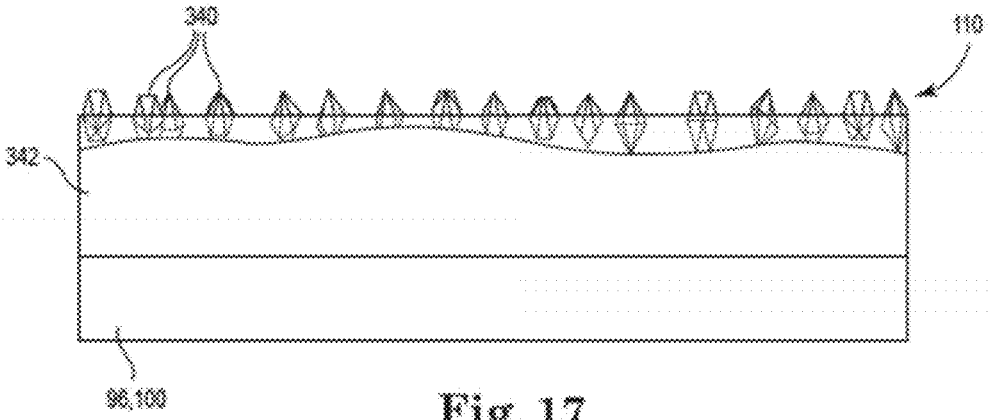
FIG. 17 is a side sectional view of an abrasive surface with nano-scale diamonds attached to a polymeric backing in accordance with an embodiment of the present disclosure.

FIG. 17 illustrates abrasive particles 340, such as nano-scale diamonds, attached to a polyamide backing layer 342 located on the pads 96, 100 that act as the abrasive features 110 in accordance with an embodiment of the present disclosure. In another embodiment, a slurry of nano-scale diamonds and adhesive are spin coated, sprayed coated, or otherwise deposited directly onto the pads 96, 100. A method and system for fabricating the nano-scale diamond abrasive is disclosed in U.S. Provisional Patent Application No. 61/187,658 entitled Abrasive Member with Uniform Height Abrasive Particles, filed on Jun. 16, 2009, which is hereby incorporated by reference.

Figure 18A:
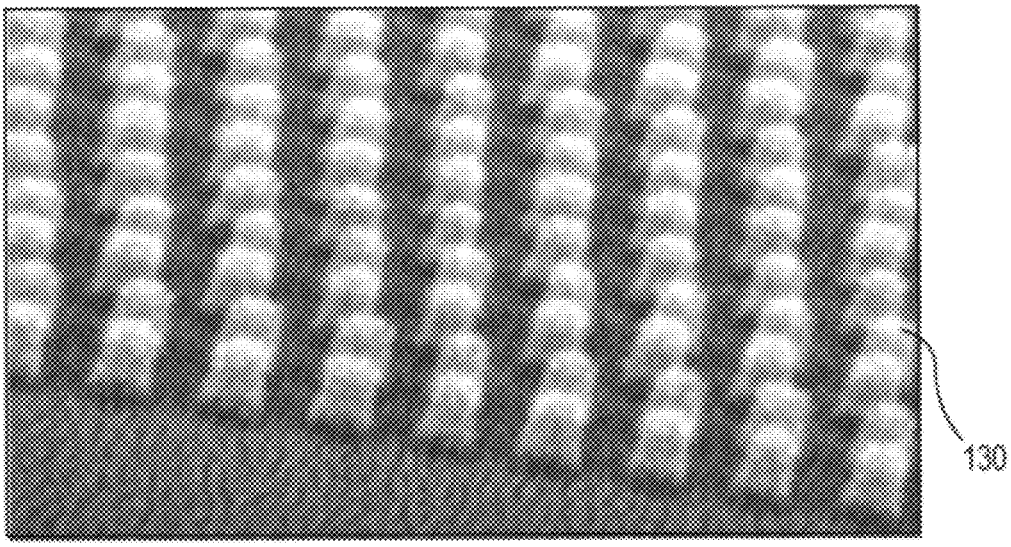
FIGS. 18A and 18B are conceptual illustrations of a structured abrasive surface in accordance with an embodiment of the present disclosure.
Figure 18B:
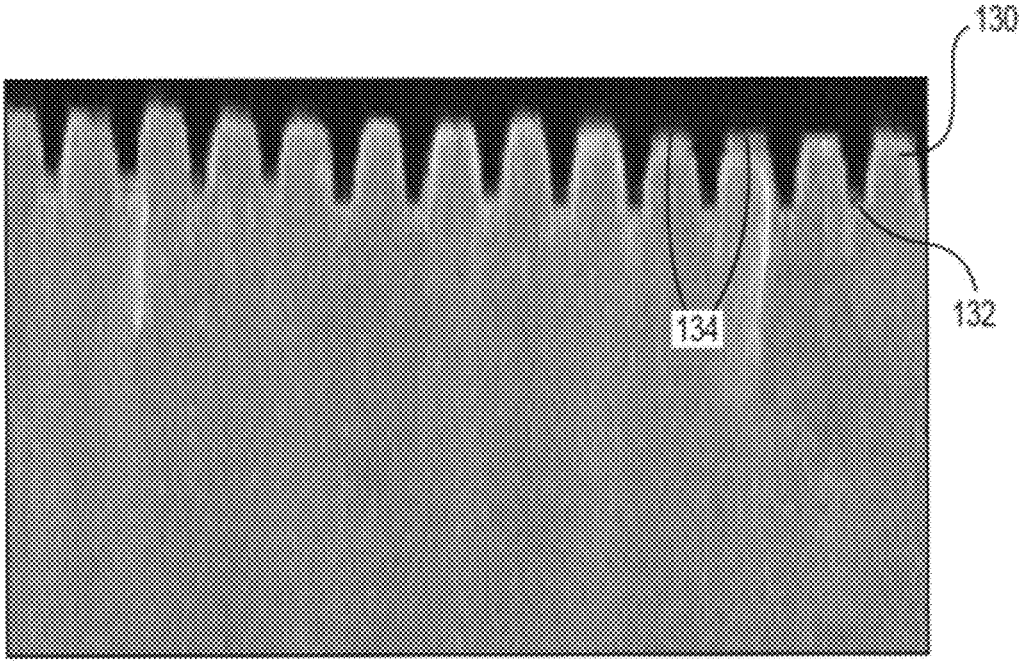

FIGS. 18A and 18B illustrate perspective and side views of an engineered surface 130 imparted to the pads 96, 100 that act as abrasive features 110 in accordance with an embodiment of the present disclosure. The engineered surface 130 is preferably nanometer-scale or micrometer-scale. The depth of the grooves 132 with respect to the peaks 134 must be controlled to within less than about 100 nanometers to promote the formation of a fluid bearing with the substrate 106. The peaks 134 can be textured to promote interference and polishing while the grooves 132 contribute to the fluid bearing lift. If the grooves 132 are too deep (microns), the fluid bearing generation will not be possible and the entire system will be in contact with uncontrolled gas film thickness. A hard coat, such as DLC, is preferably applied to the engineered surface 130.

The engineered surface 130 allows for precise stress management between the polished substrate and the nano-features. Such precise stress management yields a predictable surface finish and the gap allows for residual material to be removed. Various engineered surfaces 130 are disclosed in U.S. Pat. No. 6,194,317 (Kaisaki et al); U.S. Pat. No. 6,612,917 (Bruxvoort); U.S. Pat. No. 7,160,178 (Gagliardi et al.); U.S. Pat. No. 7,404,756 (Ouderkirk et al.); and U.S. Publication No. 2008/0053000 (Palmgren et al.), which are hereby incorporated by reference.

In another embodiment, a slurry of abrasive particles is located at the interface 104 (see, e.g., FIGS. 11, 50A, 50B, and 51), such as for example, in a standard chemical-mechanical polishing process. The abrasive members 52 with or without abrasive features can be used with the abrasive slurry. Various methods of chemical-mechanical processing are disclosed in U.S. Pat. No. 6,811,467 (Beresford et al.) and U.S. Pat. Publication Nos. 2004/0072510 (Kinoshita et al.) and 2008/0004743 (Goers et al.), which are hereby incorporated by reference.

As noted above, the abrasive features 110 generally have a hardness greater than the substrate 106, but this property is not required since any two solid materials that repeatedly rub against each other will tend to wear each other away. The abrasive features can be any portion of an abrasive member 52 that forms an interface with a substrate 106 or a contaminant 87 on a substrate 106, independent of the relative hardness of the respective materials and the resulting cut rate.

In some embodiments, the abrasive members 52 are manufactured with one or more sensors to monitor the polishing process, such as for example, acoustic emission or friction sensor. The present interference lapping preferably results in a surface finish or roughness (Ra) of less than about 20 Angstrom, and more preferably less than about 0.2 Angstrom.

In applications using full oil lubrication an interface can be designed to form an oil hydrodynamic film. Typically, the oil film thickness is substantially thicker than an air film thickness due to the viscosity of the lubricant. The height or roughness of the abrasive features on the pads 96, 100 need to be higher than the film thickness to guarantee interference with the substrate 106. Various hydrodynamic features are disclosed in U.S. Pat. No. 6,157,515 (Boutaghou), which is hereby incorporated by reference. Oil hydrodynamic formation requires larger pressures and preloads 82 to be applied to overcome the lift 108 generated by the oil viscosity. Pressure relief features are preferably formed in the pads 96, 100.

In yet another embodiment, a hydrodynamic bearing is not (fully) formed between the abrasive members 52 and the substrate 106. The abrasive members 52 are in full contact with the substrate 106. The gimballing structure 54 allows the abrasive members 52 to follow the waviness of the substrate 106 during polishing, but not the nanometer-scale or micrometer-scale height variations. In the case of a full contacting abrasive members 52, nanometer-scale or micrometer-scale height variations is defined with respect to the length 52A of the abrasive members 52 (see FIG. 11). Since no gas bearing features are fabricated on this embodiment, no hydrostatic bearing is formed and the abrasive members 52 will not be able to follow the nanometer-scale or micrometer-scale height variations, and these features are removed. The following characteristic of this structure is controlled by the friction forces and the cutting forces emanating from the interface. The friction forces can be minimized by fabricating contacting pads (not shown) to lower the contact area while providing a low friction interface especially in the presence of a lubricant.

Figure 19:
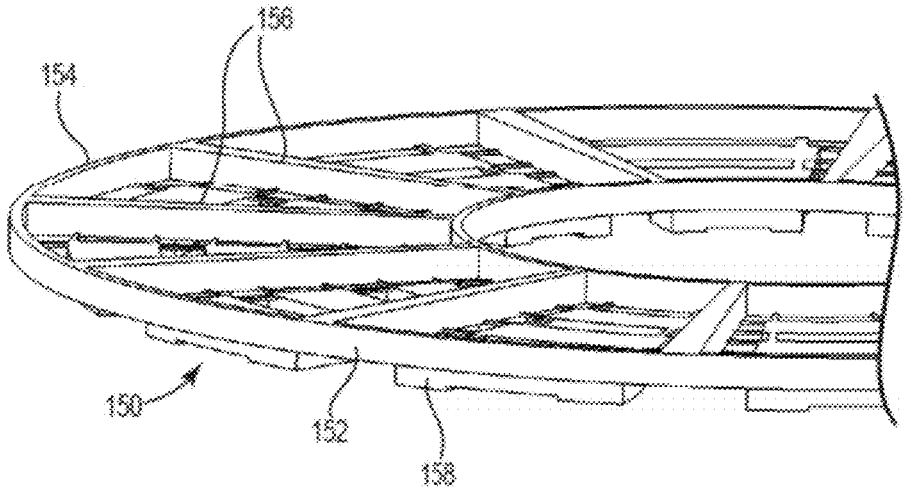
FIG. 19 is a perspective view of a unitary abrasive article in accordance with an embodiment of the present disclosure.
Figure 20:
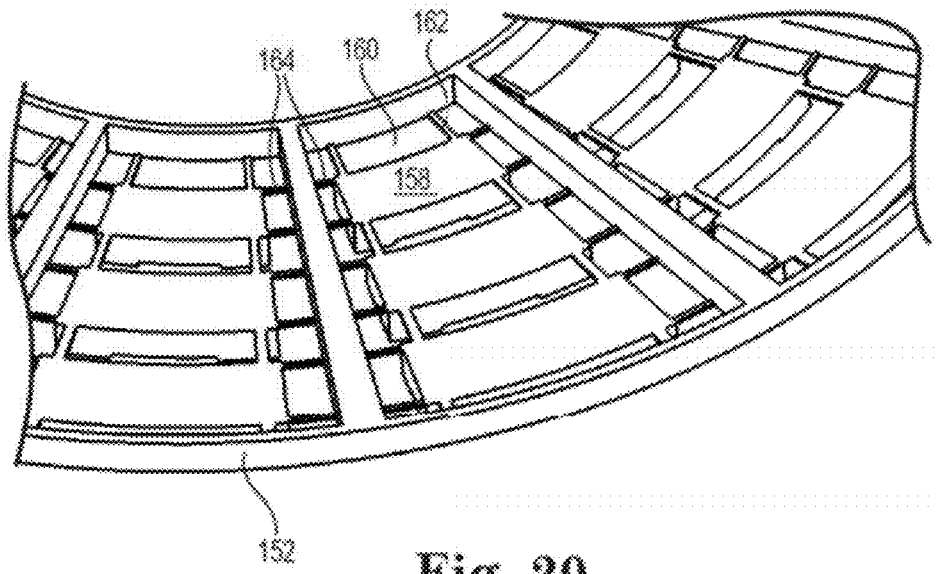
FIG. 20 is a perspective view of the gimbal assemblies of the abrasive article of FIG. 19.
Figure 21:
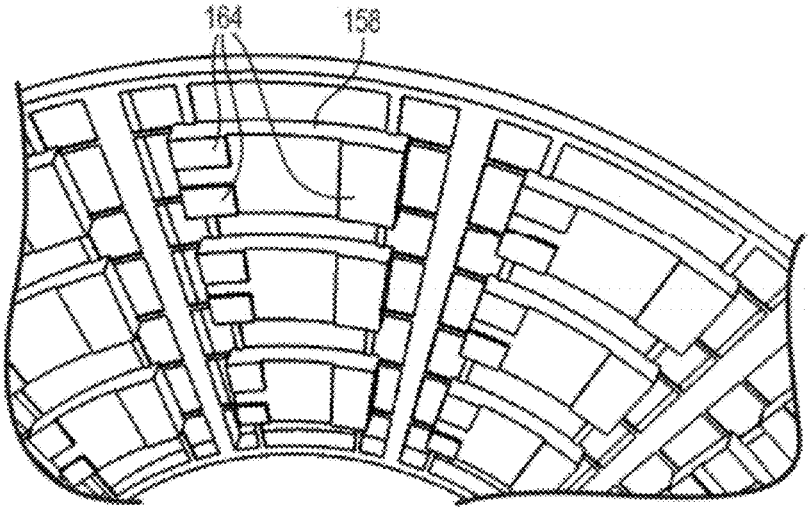
FIG. 21 is a perspective view of the fluid bearing surfaces of the abrasive article of FIG. 19.
Figure 22:
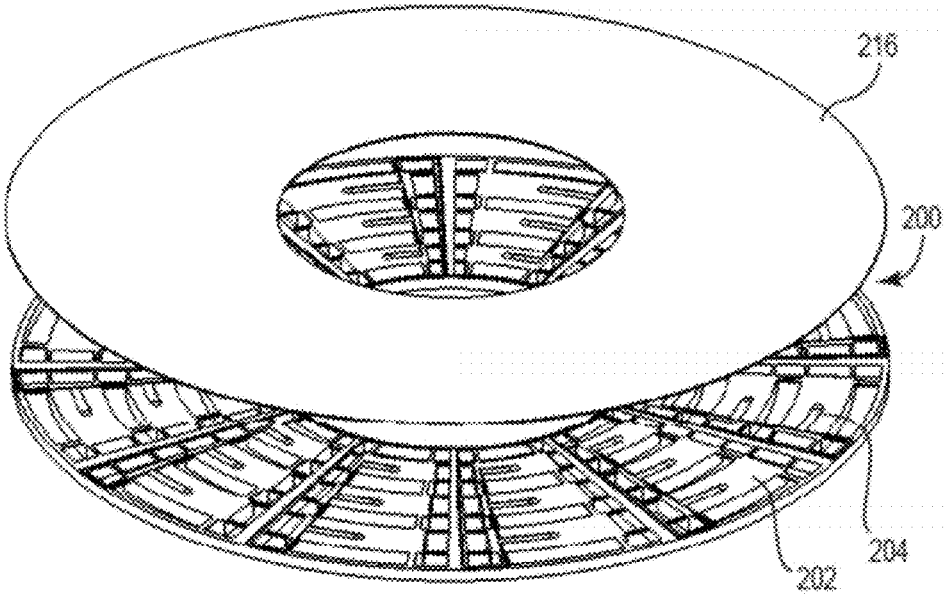
FIG. 22 is an exploded view of an abrasive article with an integral hydrostatic bearing structure in accordance with an embodiment of the present disclosure.

FIGS. 19-21 illustrate a fully integrated gimbaled abrasive article 150 in accordance with an embodiment of the present disclosure. Preload structure 152 includes circumferential ribs 154 and radial ribs 156 to impart a desired preload onto abrasive members 158. Gimbal assemblies 160 include a collection of flexible ribs 162, 164 connecting the preload structure 152 to the abrasive members 158. The abrasive article 150 is preferably fabricated as a single unit, such as by injection molding. The fabrication process can include multiple mold injection steps to meet the system requirements.

Instead of applying the preload directly to the abrasive members 158, the preload is applied by the preload structure 152 through the gimbal assemblies 160. This configuration is ideal for low preload applications. Care must be taken not to cause excessive deformation of the gimbal assemblies 160 during preload applications. FIG. 21 illustrates fluid bearing features 164 fabricated on the abrasive members 158, such as discussed above. The fluid bearing surfaces 164 can include any of the abrasive features discussed herein.

FIGS. 22-25 illustrate an alternate abrasive article 200 with an array of abrasive members 212 having an integrated hydrostatic bearing structure 202 in accordance with an embodiment of the present disclosure. Membrane 216 seals gas conduits 204 in the bearing structure 202.

Figure 23:
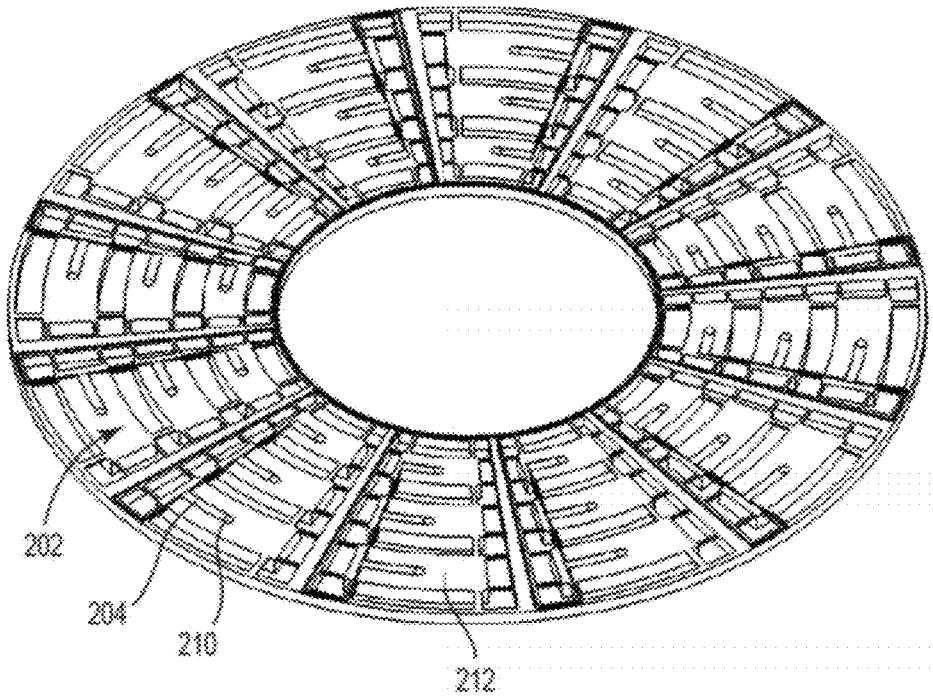
FIG. 23 is a top view of the abrasive article of FIG. 22 with the membrane removed.
Figure 24:
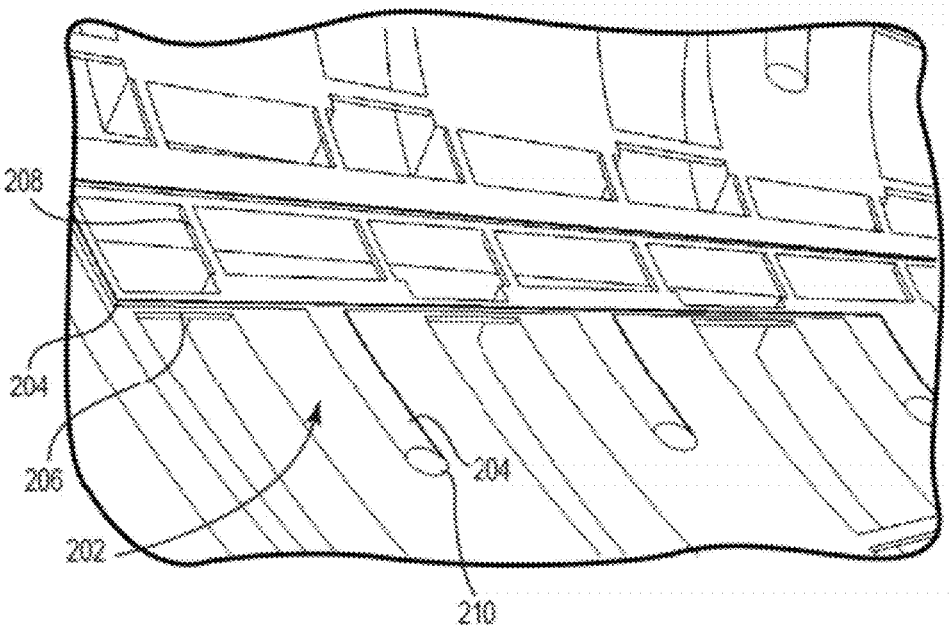
FIG. 24 is a detailed top view of the abrasive article of FIG. 22 with the membrane removed.

FIGS. 23 and 24 illustrate the integrated hydrostatic bearing structure 202 without sealing membrane 216 shown. Gas conduits 204 are fabricated in gimbal assembly 206 and along preload ribs 208. Holes 210 extending through the abrasive members 212 to fluid bearing surfaces 214 (see FIG. 25). The gas conduits 204 are externally pressurized to provide a hydrostatic bearing on each abrasive member 212. The fluid bearing surfaces 214 can include any of the abrasive features discussed herein.

Figure 25:
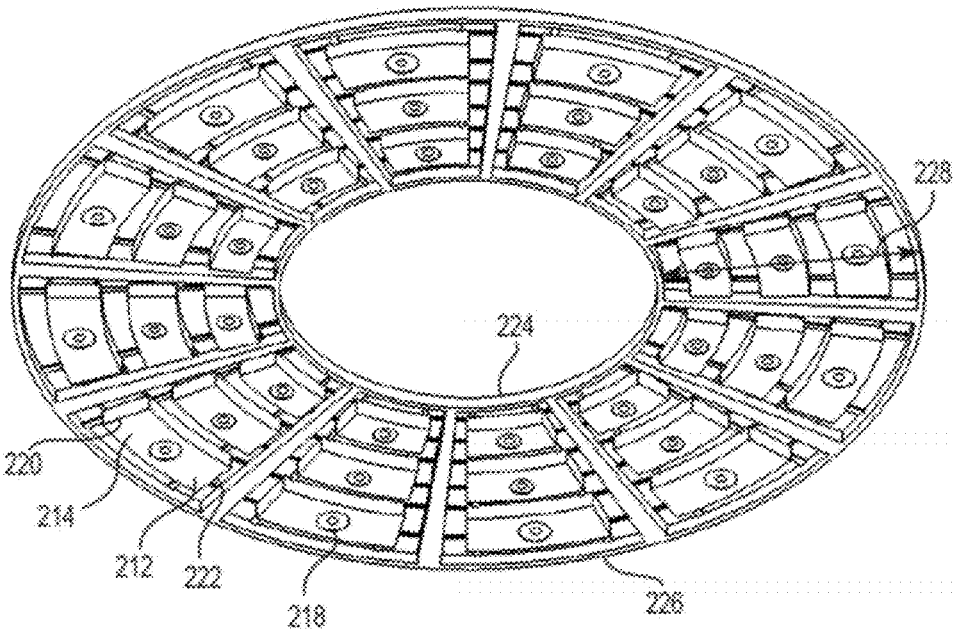
FIG. 25 illustrates the fluid bearing surfaces of the abrasive article of FIG. 22.

As best illustrated in FIG. 25, fluid bearing surfaces 214 of the abrasive members 212 are fabricated with button pressure ports 218 to form a hydrostatic bearing on each abrasive member 212. The hydrostatic bearing generated at each fluid bearing surface 214 is designed to counter the cutting forces during the polishing process. For illustrative purposes, a button bearing design is shown. See also, FIG. 39A. Additional configurations can easily be adapted such as multiple ports onto each abrasive member 212 to enable the abrasive member to form a pitch and roll moment.

In one preferred embodiment, a pressure port 218 is located near the leading edges 220 to increase the pitch of the abrasive members 212 for topography following applications. In another embodiment, pressure ports 218 are located at both the leading edges 220 and trailing edges 222 of the abrasive members 212 to configure the pitch for topography removing applications.

The abrasive article 200 is particularly useful when the relative speed between the substrate and the abrasive members 212 is not high enough to form a fluid bearing or hydrodynamic film. The external pressure applied to the abrasive members 212 forms a hydrostatic film capable of following the substrate waviness and countering the cutting forces emanating from the interference between the peaks of the abrasive member 200 and the substrate.

The hydrostatic fluid bearing may be used in combination with a hydrodynamic fluid bearing. In one embodiment, the hydrostatic fluid bearing is used during start-up rotation and/or ramp-down of the abrasive article 200 relative to a substrate.

In another embodiment, the hydrostatic fluid bearing is used simultaneously with a hydrodynamic fluid bearing. The pressure ports 218 located near the inner edge 224 and outer edge 226 of the abrasive article 200 can be pressurized to offset loss of pressure at the fluid bearing in those locations. Consequently, the pressure of the fluid bearing surfaces 214 across width 228 of the abrasive article 200 can be precisely controlled to reduce run out.

Figure 26:
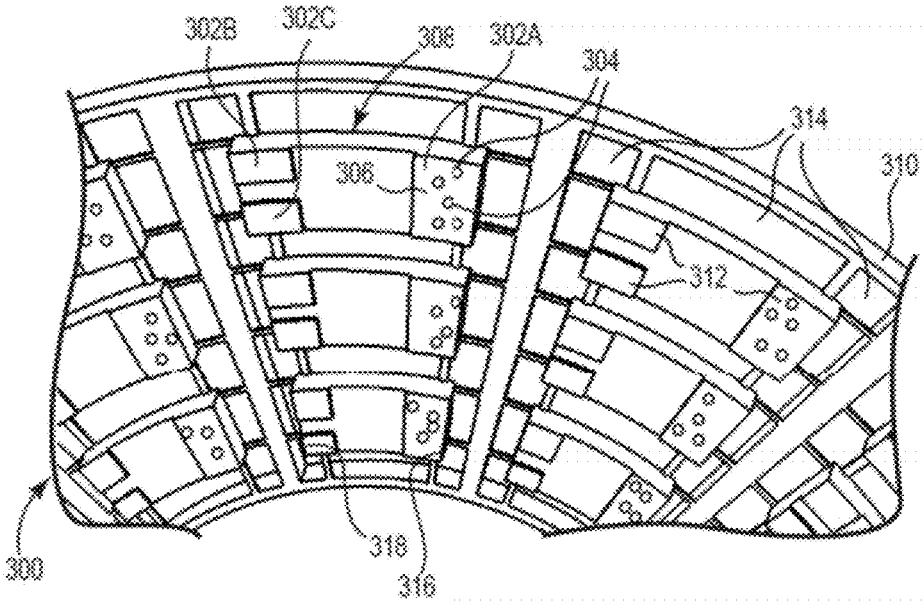
FIG. 26 is a perspective view of an alternate abrasive article with fluid bearing surfaces that comprise abrasive composites in accordance with an embodiment of the present disclosure.

FIG. 26 illustrates an alternate abrasive article 300 in which the fluid bearing features 302A, 302B, 302C ("302") comprise abrasive particles 304 dispersed within a binder 306 in accordance with an embodiment of the present disclosure. The abrasive composites 312 act as the abrasive features in the illustrated embodiment.

In the illustrated embodiment, the fluid bearing features 302 are coextensive with abrasive members 308. The abrasive members 308 are also preferably coextensive with the backing layer 310. The term "coextensive" refers to attachment, bonding, or permeation of the materials comprising the various components 302, 308, and 310. Additional details concerning the general characteristics of the abrasive composites and methods of manufacture can be found in U.S. Pat. No. 5,152,917 (Pieper et al.); U.S. Pat. No. 5,958,794 (Bruxvoort), U.S. Pat. No. 6,121,143 (Messner et al.) and U.S. Patent Publication Nos. 2005/0032462 (Gagliardi et al.) and 2007/0093181 (Lugg et al.), all of which are hereby incorporated by reference.

The abrasive particles 304 are optionally located only at the fluid bearing feature 302A at the trailing edge 316, but can optionally be provided at the fluid bearing features 302B, 302C at the leading edge 318 of the abrasive members 308. The abrasive particles 304 may be non-homogeneously dispersed in a binder 306, but it is generally preferred that the abrasive particles 304 are homogeneously dispersed in the binder.

The abrasive particles 304 may be associated with at least one fluorochemical agent. The fluorochemical agent may be applied to the surface of the abrasive particles 304 by mixing the particles in a fluid containing one or more fluorochemical agents, or by spraying the one or more fluorochemical agents onto the particles. The fluorochemical agents associated with abrasive particles may be reactive or unreactive.

Fine abrasive particles 304 are preferred for the construction of the fluid bearing features 302. The size of the abrasive particles are preferably less than about 1 micrometer and typically between about 10 nanometers to about 200 nanometers. The size of the abrasive particle 304 is typically specified to be the longest dimension. In almost all cases there will be a range or distribution of particle sizes. In some instances, it is preferred that the particle size distribution be tightly controlled such that the resulting fixed abrasive article provides a consistent surface finish on the wafer. The abrasive particles may also be present in the form of an abrasive agglomerate. The abrasive particles in each agglomeration may be held together by an agglomerate binder. Alternatively, the abrasive particles may bond together by inter-particle attraction forces. Examples of suitable abrasive particles 304 include fused aluminum oxide, heat treated aluminum oxide, white fused aluminum oxide, porous aluminas, transition aluminas, zirconia, tin oxide, ceria, fused alumina zirconia, or alumina-based sol gel derived abrasive particles.

The backing layer 310 preferably includes a plurality of areas of weakness 314 that permit the abrasive members 308 to gimbal (i.e., pitch, roll, and yaw) with respect to the backing layer 310. The areas of weakness 314 can be perforations, slits, grooves, and/or slots formed in the backing layer 310. The areas of weakness 314 also permit the passage of the liquid medium before, during, or after use.

The backing layer 310 is preferably uniform in thickness. A variety of backing materials are suitable for this purpose, including both flexible backings and backings that are more rigid. Examples of typical flexible abrasive backings include polymeric film, primed polymeric film, metal foil, cloth, paper, vulcanized fiber, nonwovens and treated versions thereof and combinations thereof. One preferred type of backing is a polymeric film. Examples of such films include polyester films, polyester and co-polyester films, microvoided polyester films, polyimide films, polyamide films, polyvinyl alcohol films, polypropylene film, polyethylene film, and the like. The thickness of the polymeric film backing generally ranges between about 20 to about 1000 micrometers, preferably between about 50 to about 500 micrometers.

A preferred method for making the abrasive composites 312 having precisely shaped abrasive composites 312 is described in U.S. Pat. No. 5,152,917 (Pieper et al) and U.S. Pat. No. 5,435,816 (Spurgeon et al.), both incorporated herein by reference. Other descriptions of suitable methods are reported in U.S. Pat. Nos. 5,437,754; 5,454,844 (Hibbard et al.); U.S. Pat. No. 5,437,754 (Calhoun); and U.S. Pat. No. 5,304,223 (Pieper et al.), all incorporated herein by reference.

Production tools for making the abrasive members 308 may be in the form of a belt, a sheet, a continuous sheet or web, a coating roll such as a rotogravure roll, a sleeve mounted on a coating roll, or die. The production tool may be made of metal, (e.g., nickel), metal alloys, or plastic. The production tool is fabricated by conventional techniques, including photolithography, knurling, engraving, hobbing, electroforming, or diamond turning. For example, a copper tool may be diamond turned and then a nickel metal tool may be electroplated off of the copper tool. Preparations of production tools are reported in U.S. Pat. No. 5,152,917 (Pieper et al.); U.S. Pat. No. 5,489,235 (Gagliardi et al.); U.S. Pat. No. 5,454,844 (Hibbard et al.); U.S. Pat. No. 5,435,816 (Spurgeon et al.); PCT WO 95/07797 (Hoopman et al.); and PCT WO 95/22436 (Hoopman et al.), all incorporated herein by reference. In an alternate embodiment, the abrasive members 308 are used in combination with the gimbal mechanism such as disclosed in FIG. 5.

Figure 27A:
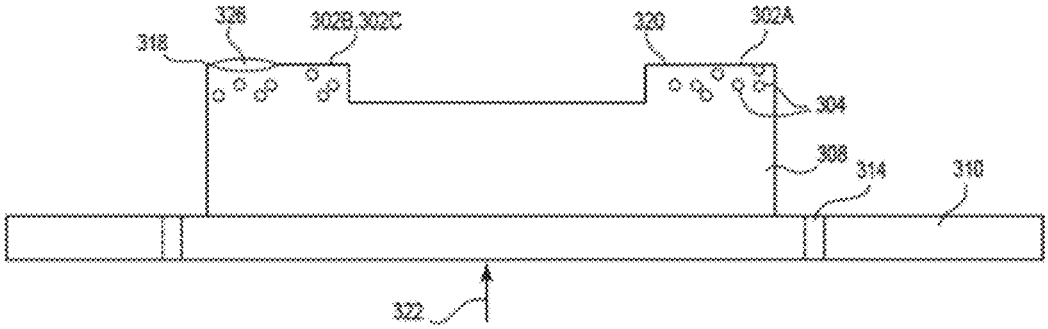
FIGS. 27A and 27B are side schematic illustrations of abrasive members with various abrasive composite structures at the fluid bearing surfaces in accordance with an embodiment of the present disclosure.
Figure 27B:
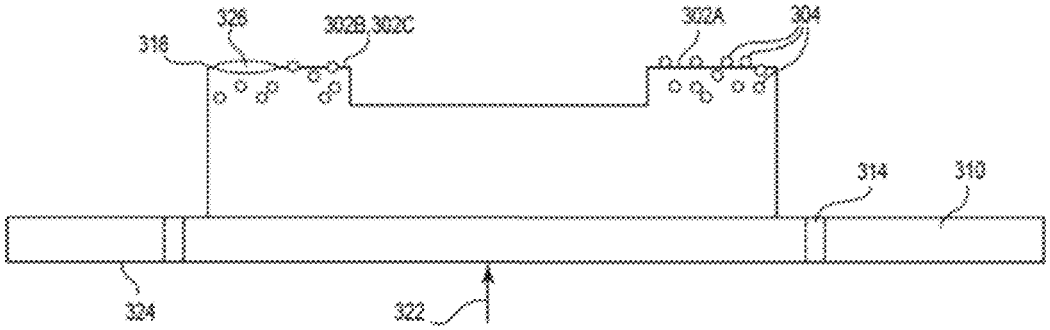

FIG. 27A is a side view of the abrasive members 308 of FIG. 26 in which the abrasive particles 304 do not extend above surface 320 of the fluid bearing features 302. FIG. 27B illustrates an alternate embodiment in which some of the abrasive particles 304 extend above the surface 320 of the fluid bearing features 302. A hard coat, such as diamond-like-carbon is optionally applied to the protruding abrasive particles 304 of FIG. 27B. In both embodiments, the backing layer 310 includes a plurality of areas of weakness 314.

Due to the rigidity of the abrasive members 308, a preload 322 can be applied directly to rear surfaces 324 of the backing layer 310 opposite the abrasive members 308, such as for example, the preload mechanism 56 illustrated in FIG. 5. The areas of weakness 314 permit the abrasive members 308 to gimbal relative to the backing layer 310. In another embodiment, the abrasive members 308 are combined with the gimbal structure 54 and the preload mechanism 56 of FIG. 5 so that the backing layer 310 does not provide the gimbal function.

In one embodiment, one or more protrusions 326 are optionally located near leading edge 318 to prevent the fluid bearing surfaces 302B, 302C from impacting the substrate. The protrusions 326 can be created from a variety of materials, such as for example, diamond-like-carbon.

Figure 28:
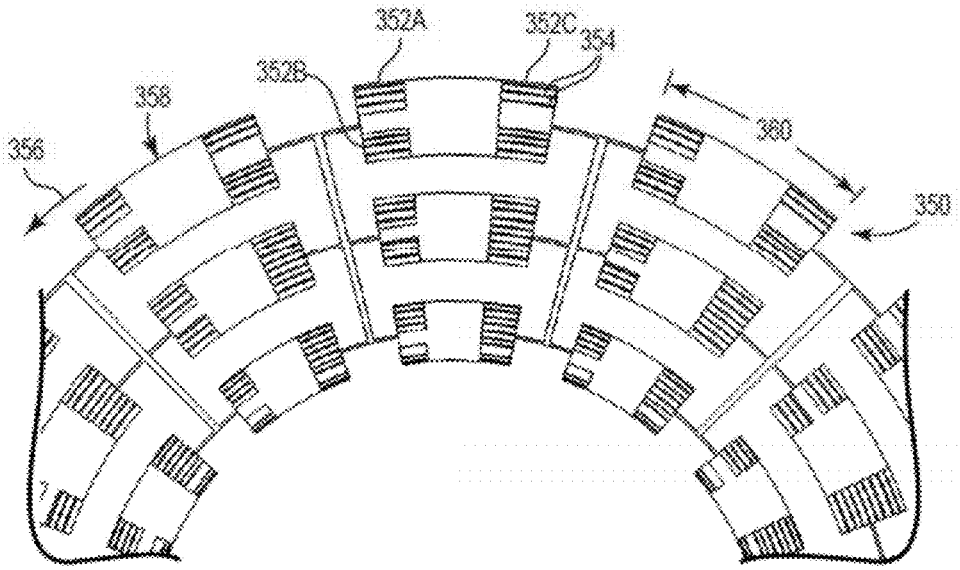
FIGS. 28 and 29 illustrate an alternate abrasive article with grooved fluid bearing surface in accordance with an embodiment of the present disclosure.
Figure 29:
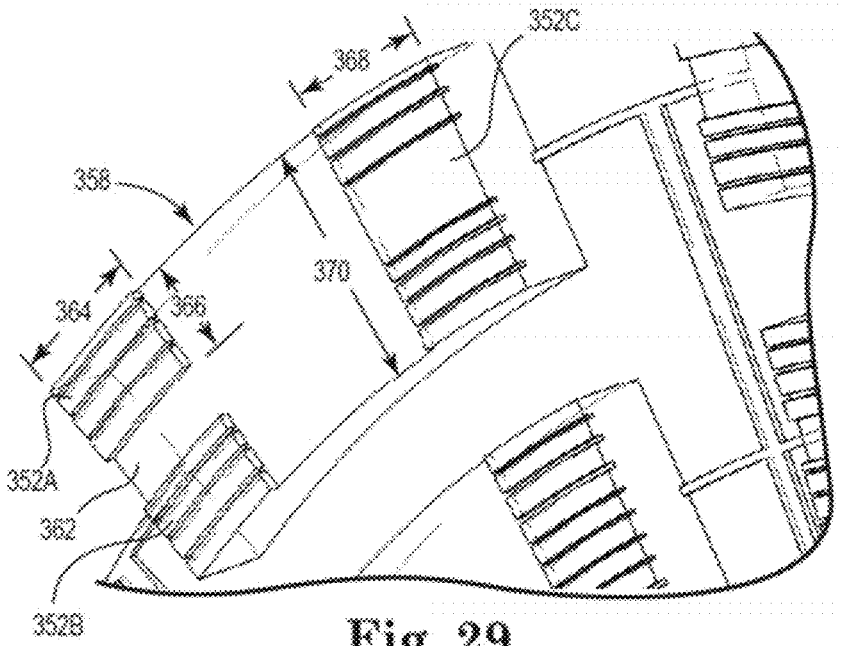

FIGS. 28 and 29 are perspective views of an alternate abrasive article 350 in which the fluid bearing features 352A, 352B, 352C ("352") include a plurality of grooves 354 oriented generally parallel to the direction of travel 356 of the abrasive members 358 relative to the substrate. The grooves 354 release fluid located at the interface between the fluid bearing features 352, reducing the lift on the abrasive members 358.

The grooves 354 reduce the fly height of the abrasive members 358. In applications where the fluid is a liquid, the grooves 354 permit a low fly height and/or a low preload. The grooved abrasive members 358 are particularly well suited to fully flooded applications.

The depth of the grooves 354 must be sufficient to reduce hydrodynamic pressure between the abrasive members 358 and the substrate. In most cases, the grooves 354 have a depth of greater than about 20 micrometers.

By reducing the hydrodynamic film, it is possible to use lubricants with a higher viscosity and/or maintain a low preload on each abrasive member 358, while still achieving interference with the substrate. In some applications, the grooves 354 allow a reduction in the hydrodynamic film while allowing the use of nano-scale diamonds attached to the fluid bearing features 352.

In one embodiment, nano-scale diamonds attached to a polymeric film, such as illustrated in FIG. 14B, are attached to the fluid bearing features 352. The grooves 354 permit the load on the abrasive members 358 to be sufficiently low so as to not substantially deform the polymeric film 342. In another embodiment, the fluid bearing features 352 are grooved abrasive composites.

Designing length 360 of the abrasive members 358 to be greater than the target wavelength permits the abrasive members 358 to interact with the peaks of the waviness for topography removing applications. Alternatively, reducing the length 360 will cause the abrasive members 358 to follow the contour of the waviness and provide more uniform material removal for topography following applications.

The grooves 354 also permit the fly height to be engineered for particular applications. Assuming all other processing variables are held constant, increasing the size or number of grooves 354 reduces fly height, and hence, increases interference between the substrate.

The fly height of the abrasive members 358 above the substrate can also be engineered, such as by changing the size and shape of the fluid bearing features 352. Some variables critical to fly height include the size and shape of gap 362 between the fluid bearing features 352A, 352B, the length 364 and width 366 of the fluid bearing features 352A, 352B, and the length 368 and width 370 of the fluid bearing features 352C.

In one embodiment, a series of different abrasive articles 350 are designed with different sized abrasive members 358 and/or fluid bearing features 352 used to polish a substrate. For example, the abrasive article 350 may initially target peaks only, followed by an abrasive article 350 designed to follow the contour.

Figure 30A:
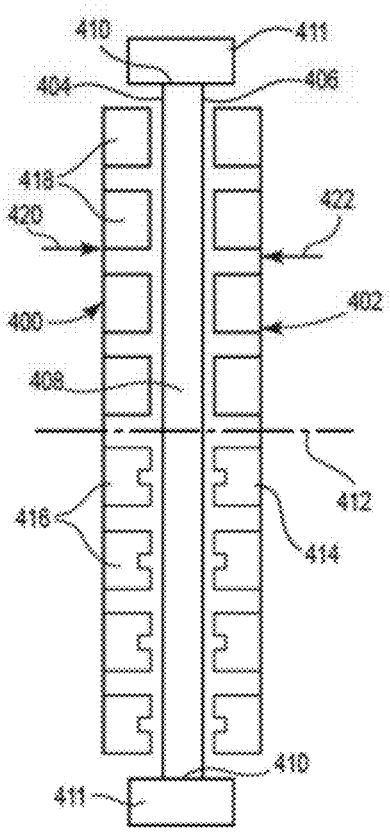
FIGS. 30A and 30B are schematic illustrations of double sided substrate processing using an abrasive article in accordance with an embodiment of the present disclosure.
Figure 30B:
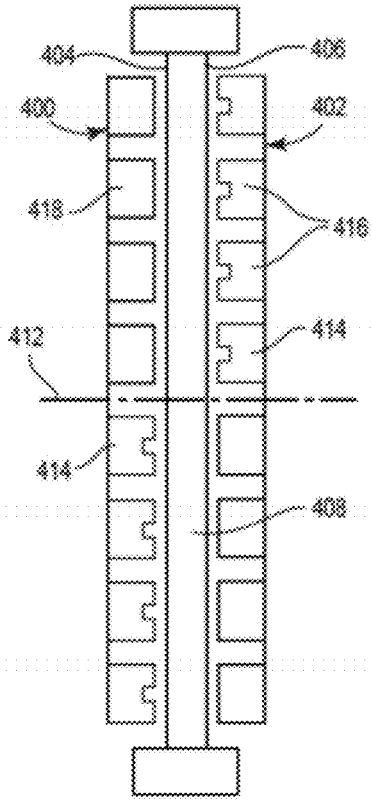

FIGS. 30A and 30B are schematic illustrations of a pair of abrasive articles 400, 402 simultaneously lapping opposite surfaces 404, 406 of substrate 408 in accordance with an embodiment of the present disclosure. The fixing process used to mount substrates (e.g., wax mounting, vacuum chucking, etc.) causes topology from the backside of the substrate to be transmitted to the front side and causes nanotopography. While free mounting of substrates does not transmit nanotopography, substrate flatness is not guaranteed. The best flatness and nanotopography is obtained using double-sided polishing. Since the substrate is polished in a free state, nanotopography is minimized and good flatness is achieved. The substrate 408 is preferably gripped by its edges 410 by mechanism 411 and rotated about axis 412, such as disclosed in U.S. Pat. No. 7,185,384 (Sun et al.); U.S. Pat. No. 6,334,229 (Moinpour et al.); and U.S. Pat. No. 6,092,253 (Moinpour et al.), all of which are incorporated by reference.

In the embodiment of FIG. 30A, leading edges 414 of the individual abrasive members 416 are illustrated below the axis 412, and trailing edges 418 above the axis 412. The fluid bearings generated by the opposing abrasive articles 400, 402 generate opposing forces 420, 422 that permit simultaneous lapping of both surfaces 404, 406 with minimum deformation of the substrate 408. Simultaneously lapping both surfaces 404, 406 of a substrate 406 held between opposing fluid bearings provides superior results over current lapping techniques. In another embodiment, the abrasive articles 400, 402 are rotated relative to the substrate 408.

In the embodiment of FIG. 30B, leading edges 414 of the abrasive articles 402 are illustrated above the axis 412 permitting the abrasive articles to be counter rotated. Counter rotating the abrasive articles 400, 402 may permit the substrate 408 to be free floating. In this embodiment, the mechanism 411 acts as a barrier to the edges 410 to maintain the substrate 408 generally concentric with the abrasive articles 400, 402, but does not otherwise restrain the substrate 408.

Figure 31:
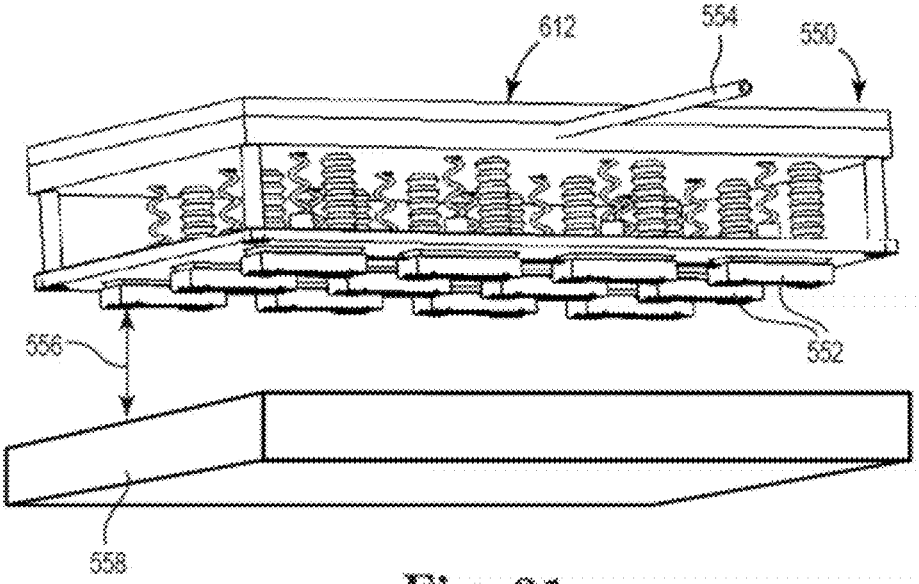
FIG. 31 is a perspective view of a hydrostatic abrasive member assembly in accordance with an embodiment of the present disclosure.

FIG. 31 is a bottom perspective view of hydrostatic abrasive article 550 with an array of hydrostatic abrasive members 552 in accordance with an embodiment of the present disclosure. External pressure source 554 is applied to each of the abrasive members 552 to control clearance 556 with the substrate 558. Preload 612 biases the abrasive members 552 toward the substrate 558. Polishing is accomplished by relative motion between the hydrostatic abrasive article 550 and the substrate 558, such as linear, rotational, orbital, ultrasonic, and the like. In one embodiment, that relative motion is accomplished with an ultrasonic actuator such as disclosed in commonly assigned U.S. Provisional Patent Application Ser. No. 61/232,525, entitled Method and Apparatus for Ultrasonic Polishing, filed Aug. 10, 2009, which is hereby incorporated by reference.

Figure 32:
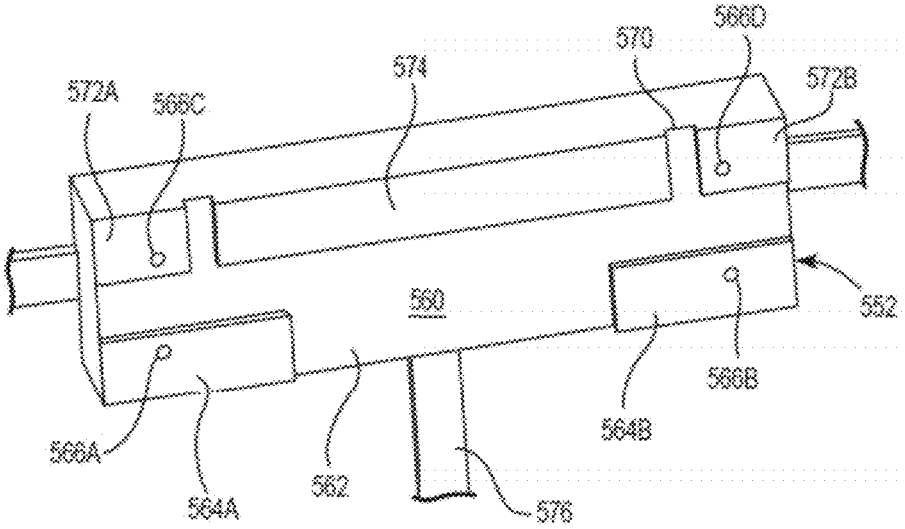
FIG. 32 is a bottom perspective view of an abrasive member in accordance with an embodiment of the present disclosure.

FIG. 32 illustrates an embodiment of an individual abrasive member 552 with both hydrostatic and hydrodynamic fluid bearing capabilities designed into bottom surface 560 in accordance with an embodiment of the present disclosure. The bottom surface 560 of the abrasive member 552 includes both air bearing features 564 and pressure ports 566.

Leading edge 562 of the abrasive member 552 includes a pair of fluid bearing pads 564A, 564B (collectively "564") each with at least one associated pressure port 566A, 566B. Trailing edge 570 also includes a pair of fluid bearing pads 572A, 572B (collectively "572") and associated pressure ports 566C, 566D. The fluid bearing surfaces 574 on the trailing edge 570 enhance the stability of the abrasive member 552 at the interface with a surface defect.

The fluid bearing pads 572 on the trailing edge 570 have less surface area than the fluid bearing pads 564 at the leading edge 562. Consequently, the leading edge 562 typically flies higher than the trailing edge 570, which sets the pitch of the abrasive member 552 relative to the substrate 558 (see, e.g., FIG. 14). The trailing edge 570 is typically designed to be in interference with the surface defects on the substrate 558. Both leading edge and trailing edge structures 564, 572 contribute to holding the abrasive member 552 at a desired clearance 556 from the substrate 558 and controlling the amount of interference with surface defects. It is also possible to control the pressure applied to the pressure ports 566A, 566B at the leading edge 562 to increase or decrease the pitch of the abrasive member 552.

The hybrid abrasive member 552 can operate with a hydrostatic fluid bearing and/or a hydrodynamic fluid bearing. The hydrostatic pressure ports 566 apply lift to the abrasive member 552 prior to movement of the substrate 558. The lift permits clearance 556 to be set before the substrate 558 starts to move. Consequently, preload 612 does not damage the substrate 558 during start-up. Once the substrate 558 reaches its safe speed and the hydrodynamic fluid bearing is fully formed, the hydrostatic fluid bearing can be reduced or terminated. The procedure can also be reversed at the end of the polishing process.

In another embodiment, both the hydrostatic and hydrodynamic fluid bearings are maintained during at least a portion of the polishing process. The pressure ports 566 can be used to supplement the hydrodynamic bearing during the polishing process. For example, the pressure ports 566 may be activated to add stiffness to the fluid bearing during initial passes over the substrate 558. The hydrostatic portion of the fluid bearing is then reduced or terminated part way through the polishing process. The pressure ports 566 can also be used to adjust or fine tune the attitude and/or clearance of the abrasive members 552 relative to the substrate 558.

Figure 35:
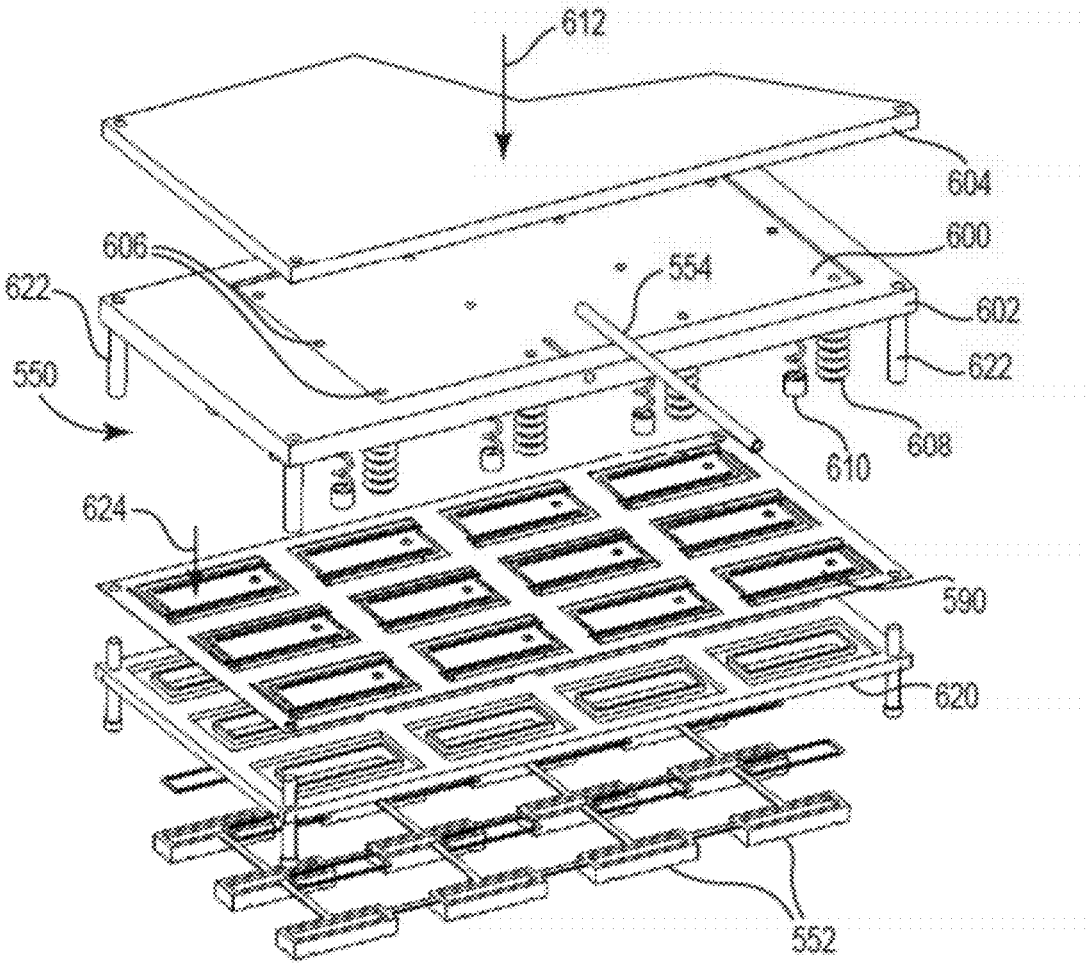
FIG. 35 is an exploded view of the hydrostatic abrasive member assembly of FIG. 31.

As best illustrated in FIG. 35, the abrasive members 552 are preferably formed in an array with a spacing structure 576. In one embodiment, the abrasive members 552 and spacing structure 576 are injection molded from a polymeric material to form an integral structure. Alternatively, discrete abrasive members 552 can be bonded or attached to the gimbal mechanisms 590. The bottom surface 560 optionally includes intermediate pad 574 to increase the cutting surfaces to remove surface defects. To enhance the cutting action abrasive features are optionally fabricated onto the pads 564, 572, 574, as discussed above.

Figure 33:
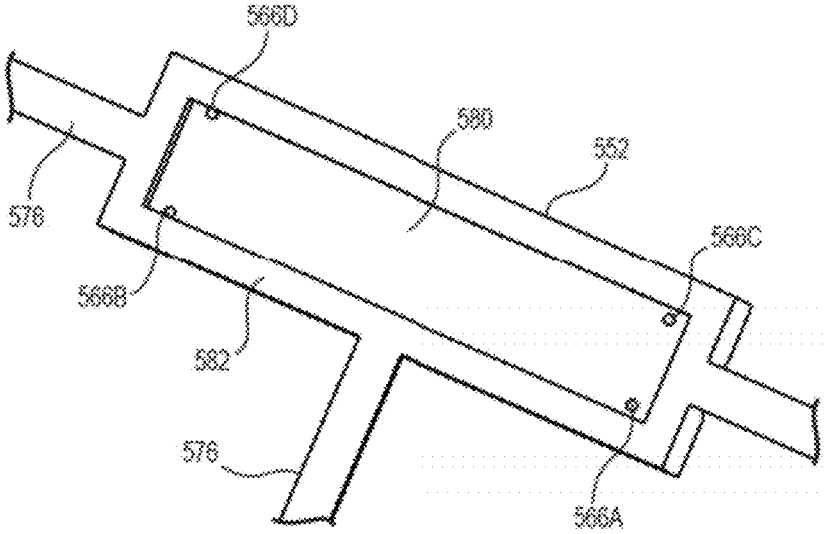
FIG. 33 is a bottom perspective view of the abrasive member of FIG. 32.

FIG. 33 illustrates a top view of the abrasive member 552 of FIG. 32. Pressure cavity 580 is fabricated on the back surface 582 of the abrasive member 552 that acts as a plenum for the delivery of pressurized gas out through the pressure ports 566.

Figure 34:
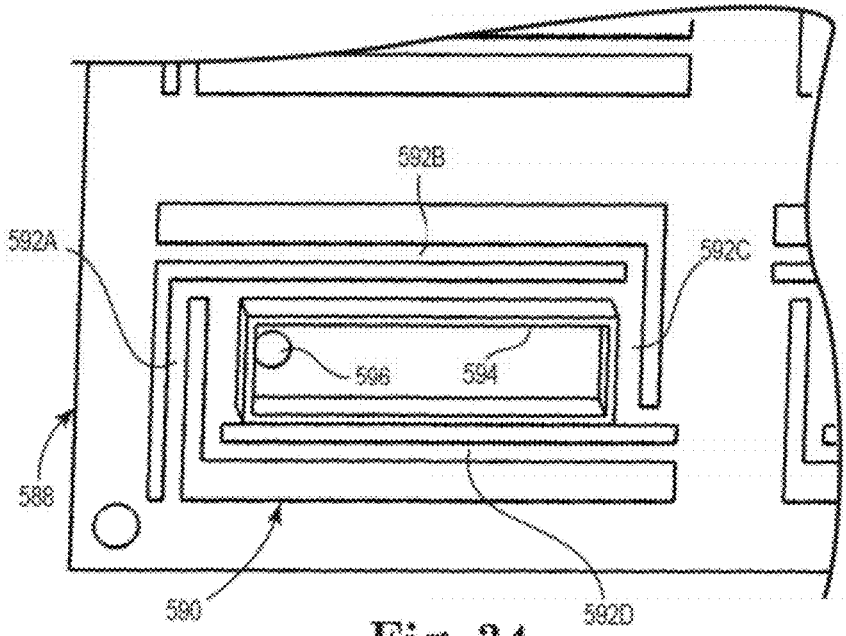
FIG. 34 is a bottom perspective view of a gimbal mechanism in accordance with an embodiment of the present disclosure.

FIG. 34 illustrates a gimbal assembly 588 that contains an array of gimbal mechanisms 590 of FIG. 31. Each gimbal mechanism 590 includes four L-shaped springs 592A, 592B, 592C, 592D (collectively "592") that suspend the abrasive members 552 above the substrate 558 in accordance with an embodiment of the present disclosure. Box-like structure 594 is optionally fabricated on each gimbal structure 590 to help align the abrasive members 552. The box-like structure 594 also includes a port 596 that delivers the pressurized gas to the backs of the abrasive members 552 and out the pressure ports 566.

FIG. 35 is an exploded view of the hydrostatic abrasive article 550 of FIG. 31. External pressure source 554 delivers pressurized gas (e.g., air) to plenum 600 in preload structure 602. Cover 604 is provided to enclose the plenum 600. A plurality of pressure ports 606 in the plenum 600 are fluidly coupled to the pressure ports on the gimbal mechanism 590 by bellows couplings 608.

Springs 610 transfer the preload 612 from the preload structure 602 to each of the gimbal mechanisms 590. The externally applied load 612, the geometry of the hydrostatic bearing 564, 572, and the external pressure control the desired spacing 556 between the abrasive members 552 and the substrate 558.

Holder structure 620 is attached to the preload structure 602 by stand-offs 622. The holder structure 620 sets the preload 624 applied on each abrasive member 552 and limits the deformation of the gimbal mechanisms 590 in order to avoid damage while the individual preload 624 is applied. An adhesive layer (not shown) attaches the abrasive members 552 to the gimbal box-like structure 594. The external preload 612 applied to the array of abrasive members 552 is greater than or equal to the preloads 624 generated by the independently suspended abrasive members 552 in order to allow the gimbal mechanisms 590 to comply with the substrate 558 and not interfere with the holder structure 620.

Figure 36:
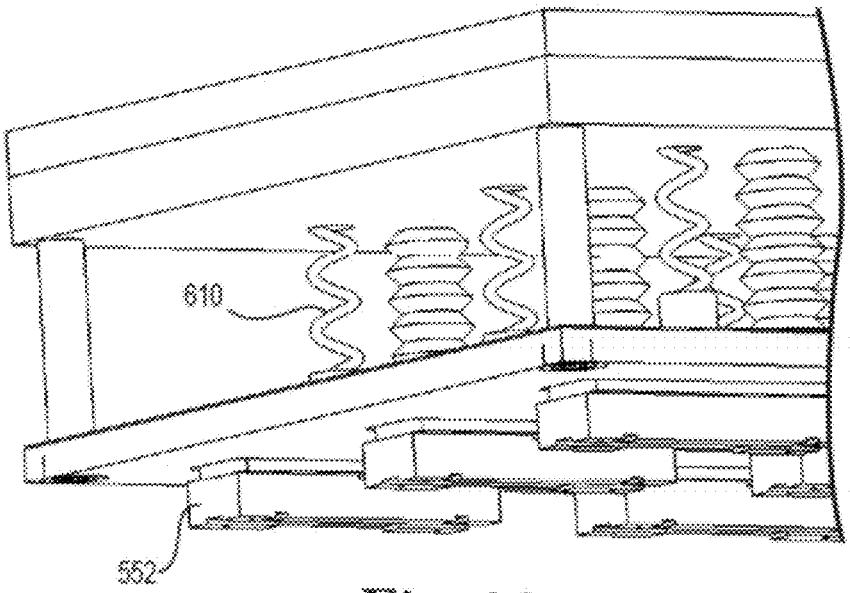
FIGS. 36 and 37 are perspective views of the hydrostatic abrasive member assembly of FIG. 31.
Figure 37:
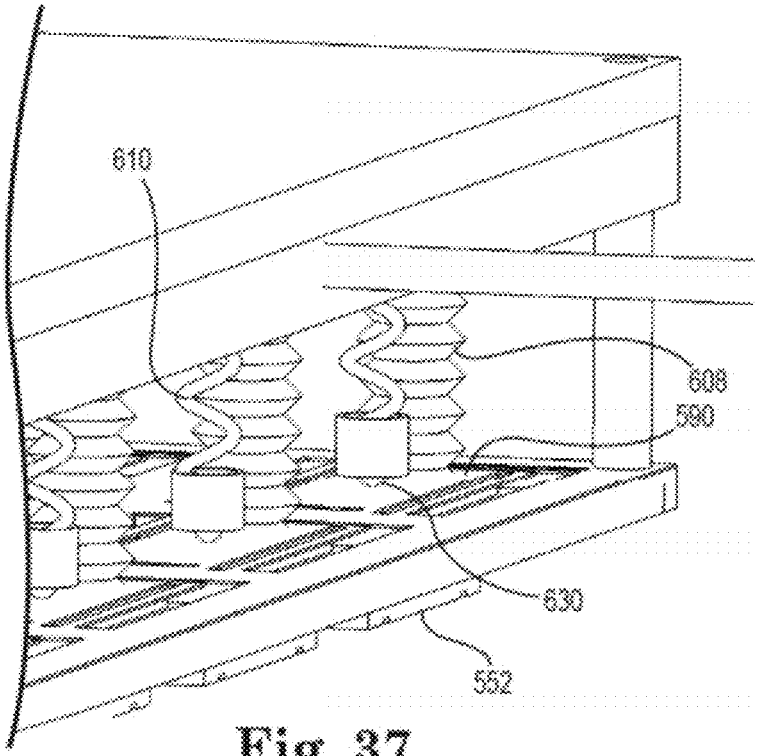

FIGS. 36 and 37 illustrates dimple structure 630 interposed between the springs 610 and the gimbal mechanism 590. The dimple structure 630 delivers the preload as a point source. Offset from the springs 610 and the dimple 630 is a flexible bellow 608 that delivers the external pressure to each individual abrasive member 552 via the gimbal mechanisms 590. The gimbal mechanisms 590, preload structure 602, and holder structure 620 can also be used in a hydrodynamic application without the pressure ports 566 and bellows couplings 608.

Figure 38:
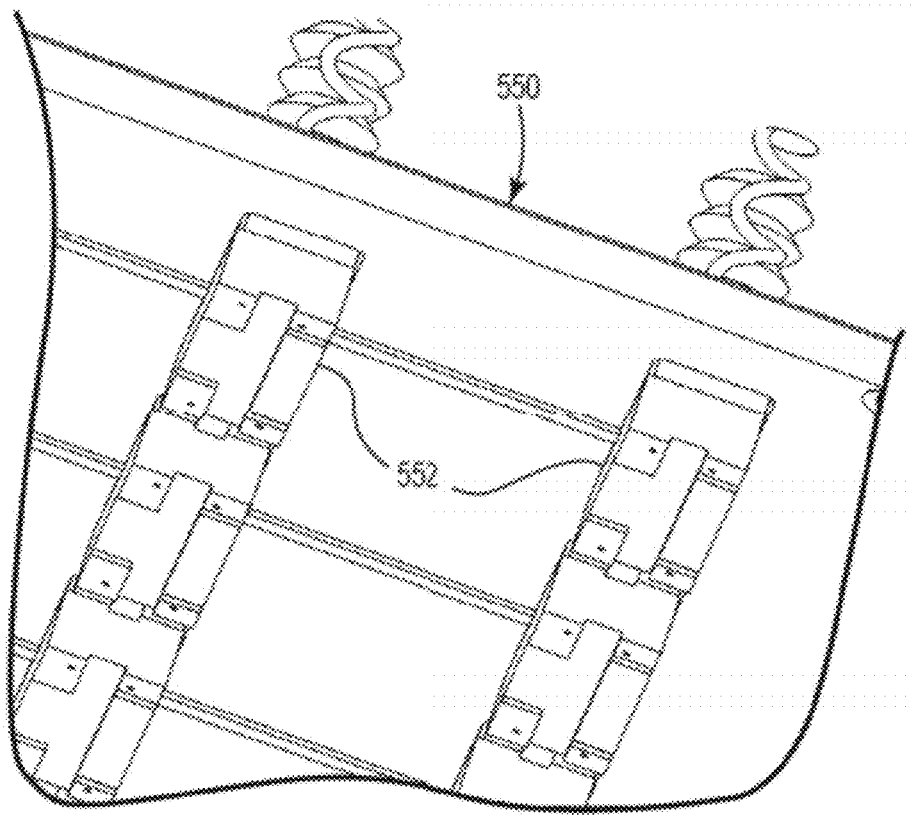
FIG. 38 is a bottom perspective view of the hydrostatic abrasive member assembly of FIG. 31.

FIG. 38 is a bottom view of the hydrostatic abrasive article 550 with the individual abrasive members 552 organized in a serial fashion. Note that other configurations can easily be accommodated, such as for example an off-set or random pattern.

Alternate hydrostatic slider height control devices are disclosed in commonly assigned U.S. Provisional Patent Application Ser. No. 61/220,149 entitled Constant Clearance Plate for Embedding Diamonds into Lapping Plates, filed Jun. 24, 2009 and Ser. No. 61/232,425 entitled Dressing Bar for Embedding Abrasive Particles into Substrates, which are hereby incorporated by reference. A mechanism for creating a hydrostatic fluid bearing for a single abrasive member attached to a head gimbal assembly is disclosed in commonly assigned U.S. Provisional Patent Application Ser. No. 61/172,685 entitled Plasmon Head with Hydrostatic Gas Bearing for Near Field Photolithography, filed Apr. 24, 2009, which is hereby incorporated by reference.

Controlling the magnitude of the pressure applied to the abrasive members changes the clearance between the substrate and the abrasive members. The frequency response of the system is independent of the compliance of the material selected for the abrasive member but can be engineered by the selection of the gimballing mechanism, including the hydrostatic bearing design. The pressure generated by the hydrostatic bearing contributes to forming pitch, z-height, and roll forces that counter the cutting forces emanating from surface defects interaction and potential contact with the substrate.

Figure 39A:
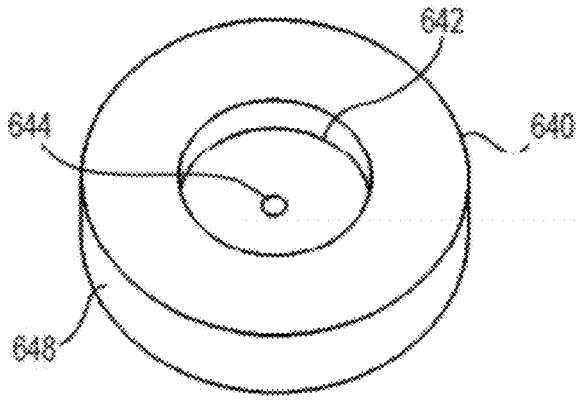
FIG. 39A is a perspective view of an annular fluid bearing surface in accordance with an embodiment of the present disclosure.

FIG. 39A illustrates a circular hydrostatic abrasive member 640 in accordance with an embodiment of the present disclosure. The cylindrical shaped recess 642 and pressure port 644 create a generally constant pressure at center, with a logarithmical decaying pressure radially outward.

Figure 39B:
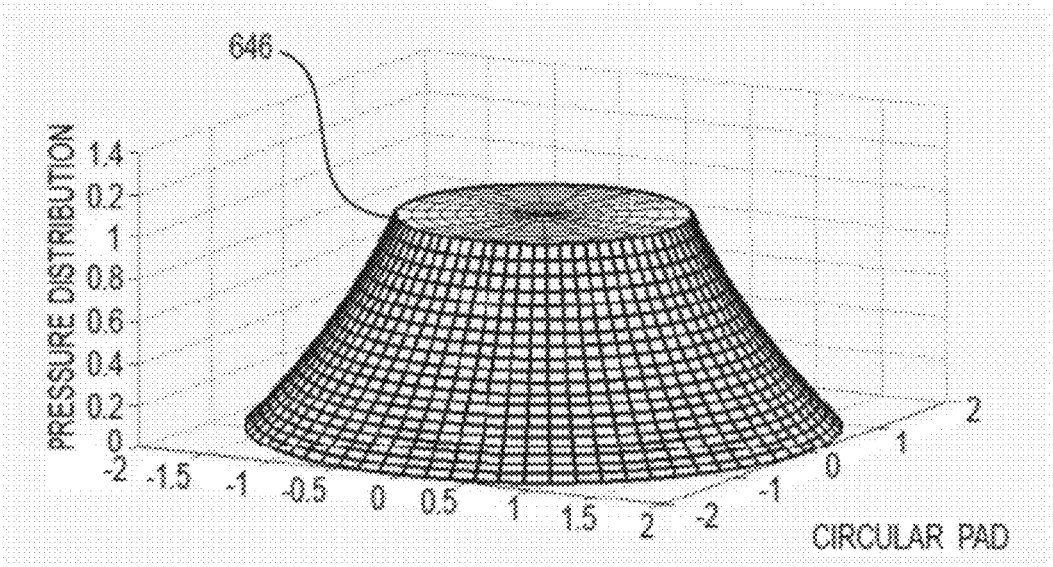
FIG. 39B is a pressure profile graph of the fluid bearing of FIG. 39A.

FIG. 39B is a graphical illustration of the pressure profile for the circular abrasive member of FIG. 39A. The circular abrasive member has a generally constant pressure profile 646 in center region 642 adjacent to the pressure port 644. The pressure at the outer edges 648 of the abrasive member matches ambient pressure. This pressure profile operates similar to a spring. One embodiment envisions a cylindrical shaped recess, such as 642, at each corner of the abrasive member of FIG. 31.

Figure 40:
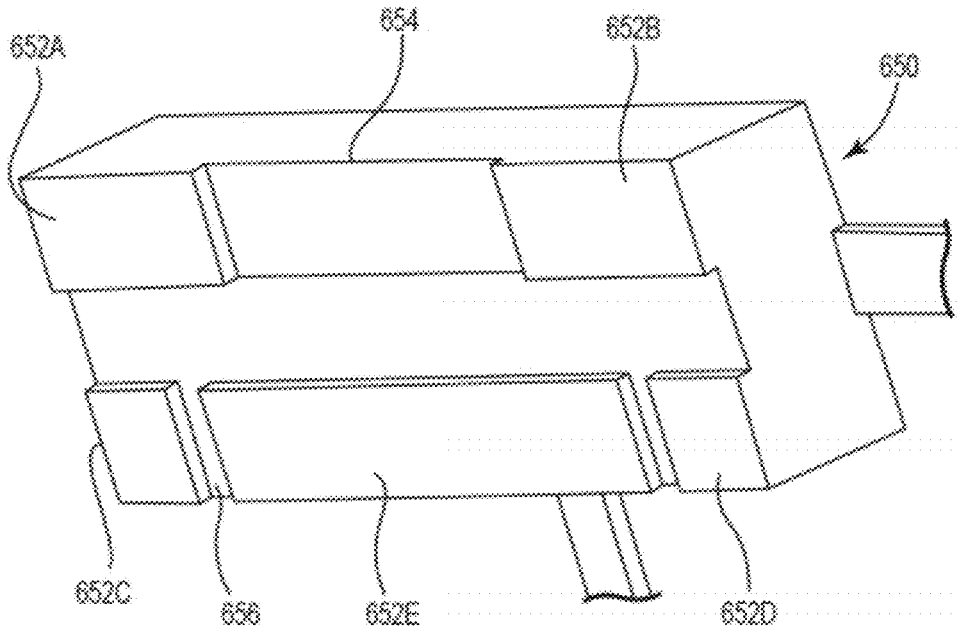
FIG. 40 is a perspective view of a hydrodynamic abrasive member in accordance with an embodiment of the present disclosure.

FIG. 40 illustrates a hydrodynamic abrasive member 650 in accordance with an embodiment of the present disclosure. The abrasive member 650 is generally the same as discussed above, except that no pressure ports are required. Fluid bearing surfaces 652A, 652B, 652C, 652D, 652E (collectively "652") located along the leading edge 654 and trailing edge 656 create hydrodynamic lift between the abrasive member 650 and the substrate 658 (see FIG. 43). The air for the fluid bearing enters along the leading edge 654 and exits along the trailing edge 656. The fluid bearing surfaces 652 also enhance the stability at the interface and a cutting surface to remove surface defects from the substrate 658.

The conditions promoting hydrodynamic lift are bearing design, gas/liquid shearing, and linear velocity of the abrasive member 650 relative to the substrate 658. Such conditions can promote the formation of a fluid film (oil, water, gas) between the abrasive member and the substrate. The relative velocity is obtained by rotating the substrate 658 and/or the abrasive members 650.

Figure 42:
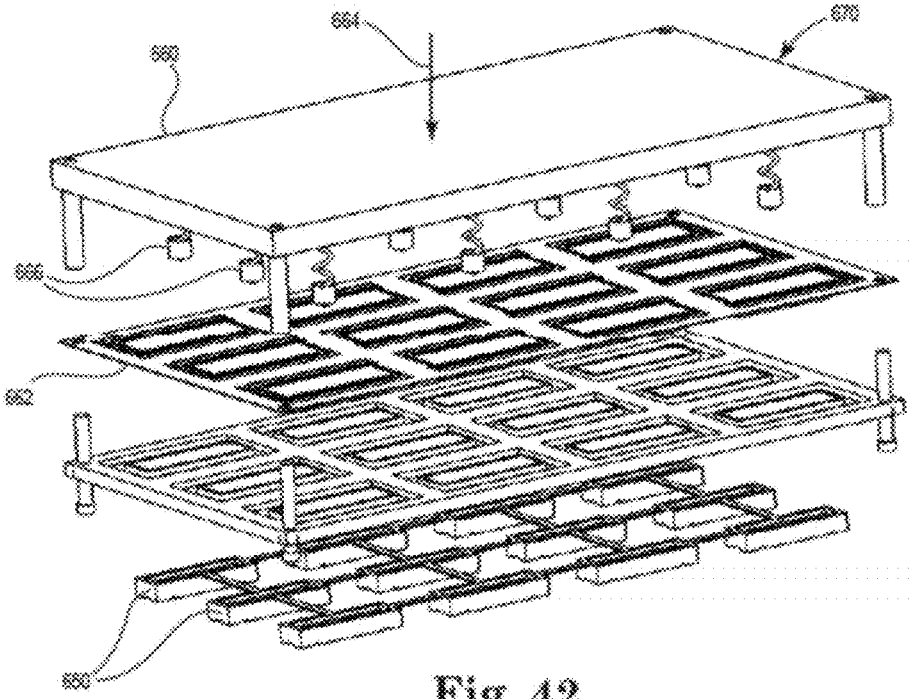
FIG. 42 is an exploded view of a hydrodynamic abrasive member assembly in accordance with an embodiment of the present disclosure.
Figure 43:
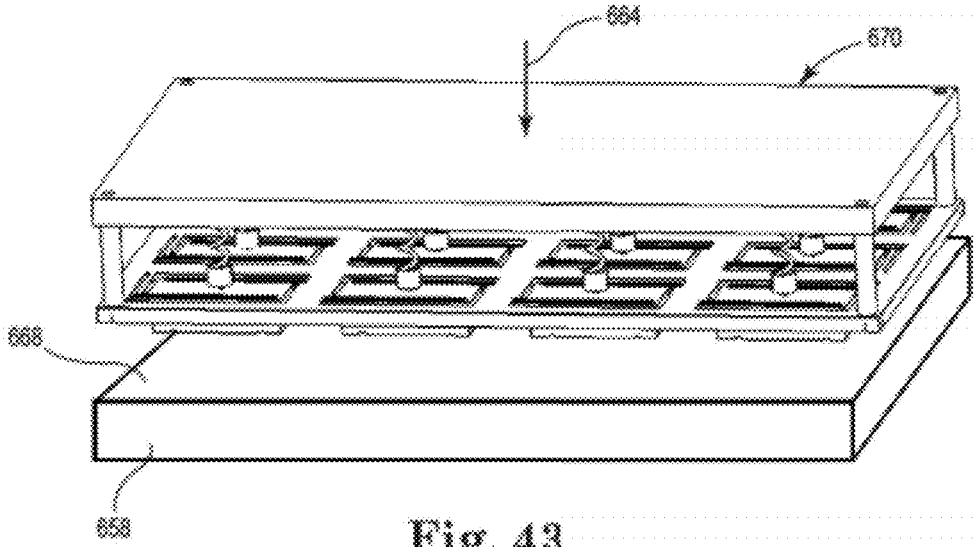
FIG. 43 is a perspective view of the hydrodynamic abrasive member assembly of FIG. 42.

Hydrodynamic abrasive article 670 of the present embodiment is best illustrated in FIGS. 42 and 43. An array of abrasive members 650 is attached to preload structure 660 by an array of gimbal mechanisms 662. Preload 664 is transmitted to the gimbal mechanisms 662 by dimpled springs 666, generally as discussed above. The suspended abrasive members 650 have a static pitch and roll stiffness through the hydrodynamic fluid bearing and a z-stiffness through the gimbal mechanisms 662. The fluid bearing surfaces 652 can include any of the abrasive features discussed herein.

The hydrodynamic fluid film formed at each abrasive member 650 controls the dynamic response of the structure. The frequency response of such system can be designed to be in the 10-100 kHz range, which is sufficient to comply with the substrate surface 668 and to interact with surface debris. The spacing between the polishing surfaces 652C, 652D, 652E can be controlled to cause interaction with surface defects with little to no material removal from the substrate 658. In order for the fluid bearing surfaces 652 to develop a stable interface, the hydrodynamic forces must be greater than external disturbances caused by the interference or contact between the polishing surfaces 652C, 652D, 652E and the surface defects.

Figure 41:
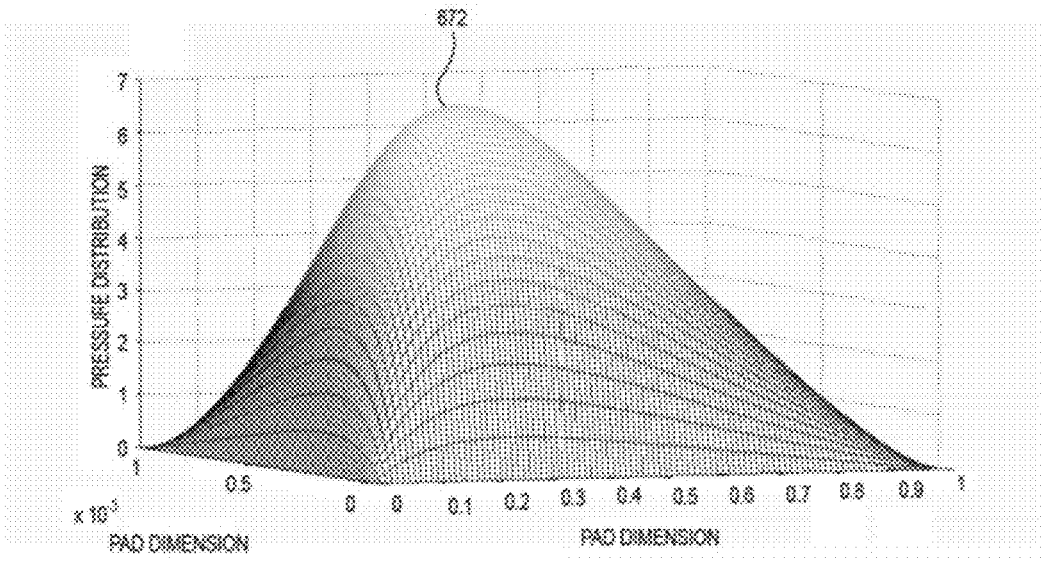
FIG. 41 is a pressure profile graph for the abrasive member of FIG. 40.

FIG. 41 illustrates a pressure curve generate by the abrasive member 650 of FIG. 40. Note that the pressure vanishes to atmospheric pressure at the edges of the fluid bearing surfaces and builds-up to a maximum 672 at the trailing edge fluid bearing surfaces 652C, 652D, 652E. Each of the fluid bearing surfaces pressurizes under the shear force of the lubricating fluid (air or liquid) to generate a force contributing to counter the preload 664 and the cutting forces emanating from the polishing or polishing operation. The pressure formed under the fluid bearing surfaces maintains a certain clearance between the substrate 658 and the abrasive members 650.

Figures 44A, 44B, 44C:
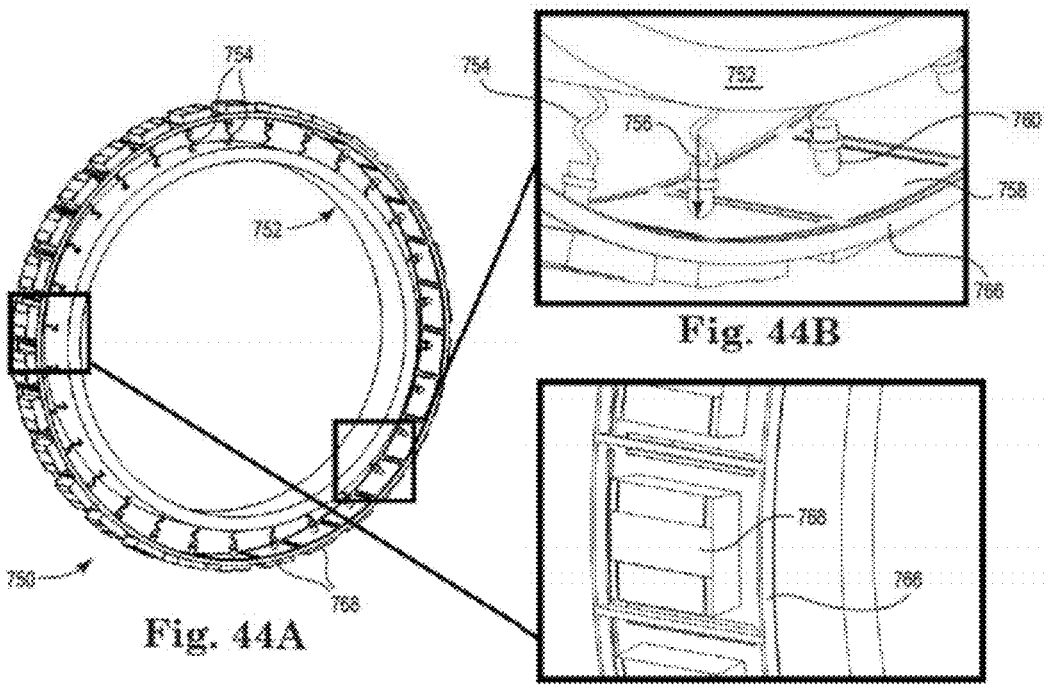
FIGS. 44A-44C are various views of a cylindrical array of abrasive members in accordance with an embodiment of the present disclosure.
Figure 45:
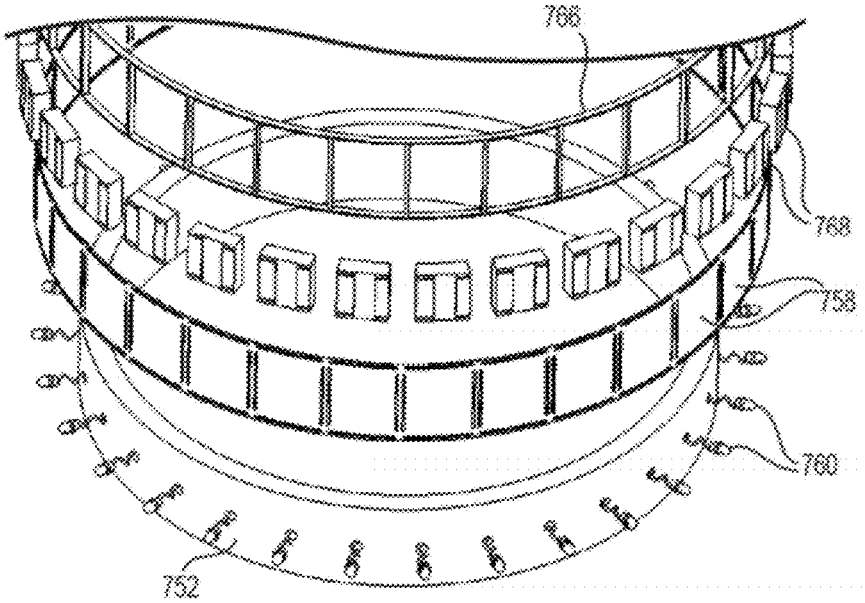
FIG. 45 is an exploded view of the cylindrical array of abrasive members of FIGS. 44A-44C.

FIGS. 44A-44C illustrate an abrasive member assembly 750 with an array of abrasive members 768 arranged in a cylindrical array in accordance with an embodiment of the present disclosure. FIG. 45 is an exploded view of the abrasive member assembly 750 of FIG. 44A-44C.

The abrasive member 750 preferably forms a contact interface with the substrate, although this embodiment may be used with a hydrodynamic or hydrostatic bearing. Cylinder preload fixture 752 includes a plurality of dimpled spring members 754 that apply an outward radial preload 756 on each gimbal mechanism 758. The preload 756 is transferred by dimple member 760 acting on rear surface 762 of the gimbal mechanisms 758. The gimbal mechanisms 758 are interconnected into a gimbal assembly 764 by support structure 766. The individual abrasive members 768 are attached to the gimbal mechanisms 758.

Figure 46:
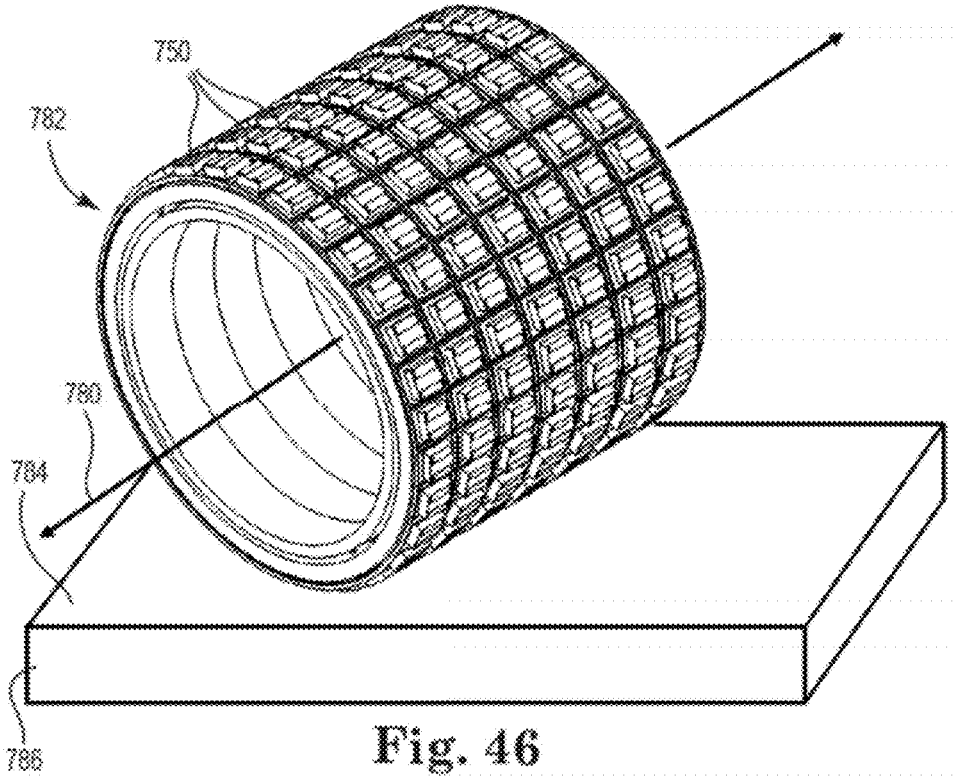
FIG. 46 is a plurality of the cylindrical array abrasive member assemblies of FIGS. 44A-44C in accordance with an embodiment of the present disclosure.

FIG. 46 illustrates a plurality of the abrasive member assemblies 750 of FIG. 45 arranged in a stack configuration 782. The cylindrical structure can be used to clean planar or non-planar substrates. In one embodiment, axis of rotation 780 is oriented parallel to the surface 784 of the substrate 786. The stacked configuration 782 is optionally rotated while engaged with the substrate 786. The substrate 786 can be stationary or moving.

A hydrostatic bearing can optionally be generated at the interface of the abrasive members 768 and the substrate via external pressurization means, as discussed above. The hydrostatic approach permits the abrasive members 768 to hover over the substrate surface at any desired clearance while still being able to interact and remove surface defects. A stable contacting interface can also be used with the abrasive members 768. The abrasive members 768 can either be a porous sponge-like material or a hard coated slider. The gimbal mechanisms 758 and preload mechanisms 754 permit the abrasive members 768 to follow the run-out and waviness of the substrate while the abrasive members 768 intimately contact and clean the substrate.

Alternate methods of controlling the height of the abrasive members above the substrate are disclosed in commonly assigned U.S. Provisional Patent Application Ser. No. 61/220,149 entitled Constant Clearance Plate for Embedding Diamonds into Lapping Plates, filed Jun. 24, 2009 and Ser. No. 61/232,425 entitled Dressing Bar for Embedding Abrasive Particles into Substrates, which are hereby incorporated by reference. A mechanism for creating a hydrostatic fluid bearing for a single abrasive member attached to a head gimbal assembly is disclosed in commonly assigned U.S. Provisional Patent Application Ser. No. 61/172,685 entitled Plasmon Head with Hydrostatic Gas Bearing for Near Field Photolithography, filed Apr. 24, 2009, which is hereby incorporated by reference.

Controlling the magnitude of the pressure applied to the abrasive members changes the clearance between the substrate and the abrasive members. The frequency response of the system is independent of the compliance of the material selected for the abrasive members but can be engineered by the selection of the gimballing mechanism, including the hydrostatic bearing design. The pressure generated by the hydrostatic bearing contributes to forming pitch, z-height and roll forces that counter the cutting forces emanating from surface defects interaction and potential contact with the substrate.

Example 1

Figure 47A:
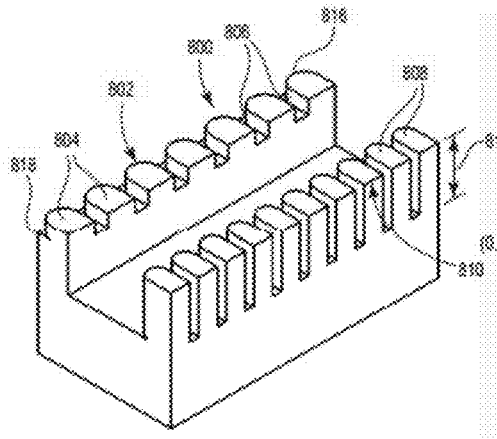
FIG. 47A is a schematic illustration of an abrasive member for topography following applications in accordance with an embodiment of the present disclosure.

FIG. 47A illustrates an abrasive member 800 modeled for topography following applications. The leading edge 802 includes a plurality of discrete features 804 separated by cavities 806 that permit air flow and particles to enter. The cavity depth 812 is about 2 micrometers to about 3 micrometers to promote a negative suction force.

The leading edge pads 804 are formed with rounded surfaces 816 to promote the redistribution of debris and lubricant. This example of a low contact force abrasive member 800 includes leading edge step 818 that increases lift at the leading edge 802.

Figure 47B:
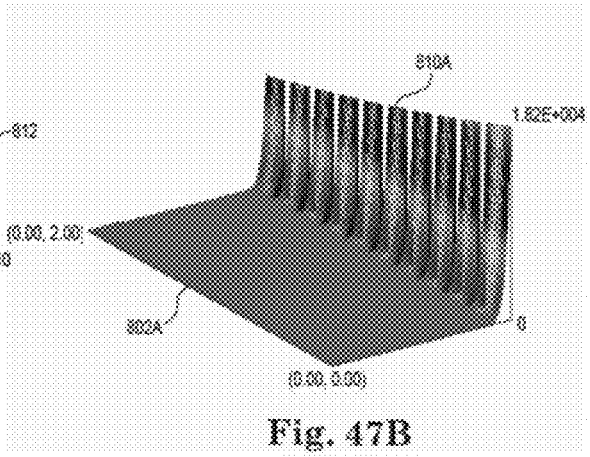
FIG. 47B is a pressure profile for the abrasive member of FIG. 47A.

FIG. 47B is a graphical illustration of the contact pressure of the abrasive member 800 with the substrate. The leading edge pressure 802A is preferably zero. Trailing edge pressure 810A shows a minor negative suction force. Upon application of large loads (e.g., up to 12 grams) the leading edge 802 does not contact the substrate, while the trailing edge 810 follows the topography of the substrate.

Table 1 shows that the leading edge 802 clears the substrate, while the trailing edge 810 is in contact. This approach permits the trailing edge 810 to follow the substrate waviness. The leading and trailing edge pressurization contribute to the stability of the design during asperity interactions and debris removal. This design is ideal for cleaning debris and removing nano level amounts of material in the presence of a thin film lubricant.

TABLE 1

| Preload (grams) | Negative pressure (grams) | Positive pressure (grams) | Contact force (grams) | Pitch (micro-radians)/Fly height (nm) |
|---|---|---|---|---|
| 3 | −0.89 | 3.88 | 0 | 318/24 |
| 5 | −1.03 | 6.02 | 0.01 | 233/10 |
| 8 | −1.18 | 8.93 | 0.24 | 163/4.2 |
| 10 | −1.27 | 10.72 | 0.54 | 130/2.5 |
| 12 | −1.31 | 12.47 | 0.83 | 113/1.7 |

Example 2

Figure 48A:
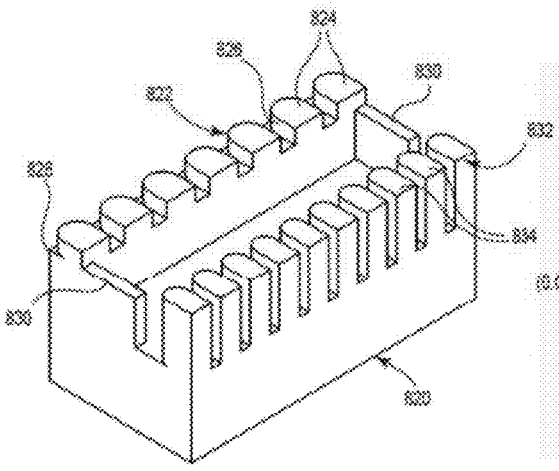
FIG. 48A is a schematic illustration of an abrasive member for topography following applications in accordance with an embodiment of the present disclosure.

FIG. 48A illustrates an abrasive member 820 modeled for topography following applications. The leading edge 822 includes a plurality of discrete features 824 separated by slots 826 that permit air flow and particles to enter. This example of a low contact force abrasive member 820 includes leading edge step 828 and extended sides 830 to increase the negative pressure force (suction force). The leading edge step 828 has a depth of about 0.1 micrometers to about 0.5 micrometers to promote the formation of higher pressure at the leading edge 822. Note that the trailing edge 832 is formed of discrete pads 834 to reduce the spacing between the substrate and the abrasive member, and to allow for circulation of lubricant and debris.

Figure 48B:
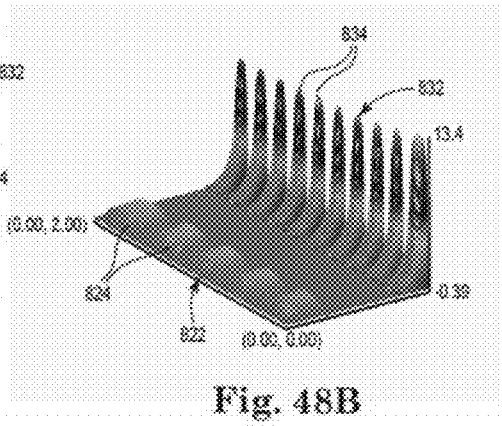
FIG. 48B is a pressure profile for the abrasive member of FIG. 48A.

FIG. 48B is a graphical illustration of the contact pressure for the abrasive member 820 against the substrate. The contact forces are concentrated at the pads 834 located at trailing edge 832. The negative pressure saturates around 3.5 grams while the positive pressure increases to balance the applied load while keeping a pitch angle causing the spacing between the leading edge 822 and the substrate. The design provides very good contact stiffness contributing to the stability of the abrasive member. The abrasive member 820 has a pitch that permits the leading edge 822 to remain above the substrate. This design transmits about 15 percent of the applied load to the substrate, which is greater than the force in Example 1. This design is ideal for cleaning and removing debris from wafers in the presence of a thin film lubricant. Nanometer-level removal from this design is expected.

Table 2 provides a summary of various performance parameters for the abrasive member as a function of preload.

TABLE 2

| Preload (grams) | Negative pressure (grams) | Positive pressure (grams) | Contact force (grams) | Pitch (micro-radians)/Fly height (nm) |
|---|---|---|---|---|
| 3 | −2.9 | 5.7 | 0.26 | 200/3.3 |
| 5 | −3.18 | 7.5 | 0.6314 | 159/1.4 |
| 8 | −3.4 | 10.2 | 1.14 | 118/0.5 |
| 11 | −3.5 | 13.0 | 1.6 | 91/0.18 |
| 12 | CRASH | | | |

Example 3

Figure 49A:
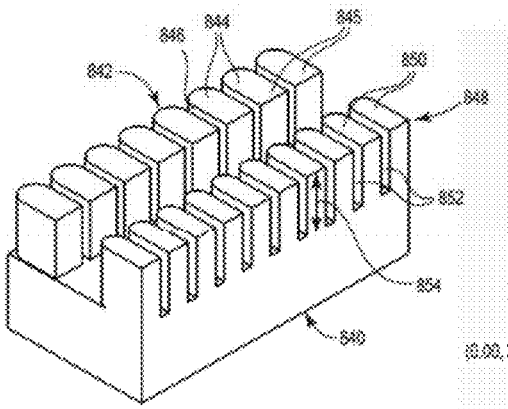
FIG. 49A is a schematic illustration of an abrasive member for topography removing applications in accordance with an embodiment of the present disclosure.

FIG. 49A illustrates an abrasive member 840 modeled for topography removing applications. The leading edge 842 includes a plurality of discrete features 844 separated by slots 846 that permit air flow and particles to enter. The trailing edge 848 similarly includes a plurality of discrete features 850 separated by slots 852. The features 844, 850 have a height 854 of about 2 micrometers and are formed with rounded leading edge surfaces to distribute both lubricant and wear debris.

The height 854 is sufficient to create a positive pressure profile at the top of the pads 844, 850 and a negative suction force at the trailing side 845 of the features 844 in cases of air as a lubricant. The proper selection of the pressure distributions controls the pitch angle of the abrasive member 840 and the minimum spacing above the substrate.

In the case of topography removing, the abrasive member 840 does not follow certain target wavelengths of waviness. The pitch angle of the abrasive member 840 is therefore substantially reduced to cause both the leading edges 842 and the trailing edges 848 to not follow the target wavelengths of waviness and to cause wear of the interacting surfaces.

A simple exercise demonstrates the capability of this design given in Table 3. By varying the externally applied preloads from about 0.1 grams to about 10 grams, a reduction in the pitch angle and spacing is attained, causing a higher level of wear and interactions between both the leading and trailing edges 842, 848 and the substrate. The low pitch angle also inhibits follow of the target wavelengths.

Figure 49B:
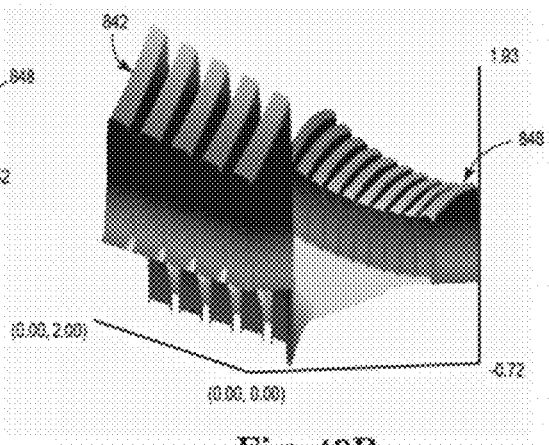
FIG. 49B is a pressure profile for the abrasive member of FIG. 49A.

Note that at 5 grams of preload a negative suction force and a total positive pressure is generated to counter the contact force of 2.56 grams and the 5 grams of preload. An increase in preload as shown causes a substantially linear increase in contact force responsible for the removal of material at the substrate. FIG. 49B is a graphical illustration of the contact pressure of the abrasive member 840 with the substrate. Note the negative pressure at the leading edge 842.

Table 3 provides a summary of various performance parameters for the abrasive member as a function of preload.

TABLE 3

| Preload (grams) | Negative Pressure (grams) | Positive Pressure (grams) | Contact force (grams) | Pitch (micro-radians)/fly height (nm) |
|---|---|---|---|---|
| .1 | −2.33 | 2.43 | 0 | 31/21 |
| 1 | −2.39 | 3.31 | 0.075 | 12/14 |
| 5 | −2.4 | 4.91 | 2.56 | 4/4.8 |
| 7 | −2.48 | 5.35 | 4.13 | 2.6/3.2 |
| 10 | −2.50 | 5.97 | 6.53 | 8/1.5 |

Example 4

Figure 50A:
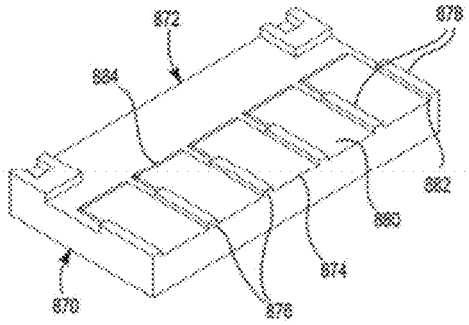
FIGS. 50A and 50B illustrate a hydrodynamic abrasive member for use in CMP in accordance with an embodiment of the present disclosure.
Figure 50B:
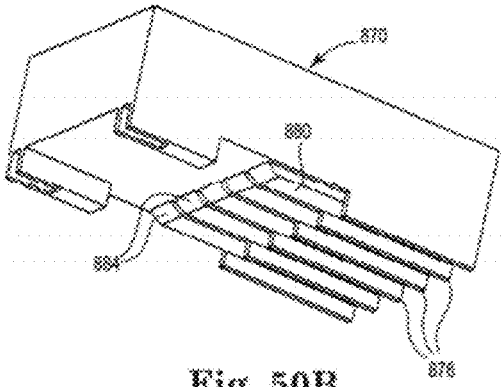

FIGS. 50A and 50B illustrate an abrasive member 870 for use with free abrasive particles, such as in CMP. Leading edge pressurization causes the abrasive member 870 to pitch upward so leading edge 872 does not contact the substrate. The pitch also contributes to the ability of the abrasive member 870 to follow the topography of the substrate.

Rails 876 at trailing edge 874 help pressurize the bearing and cause the trailing edge 874 to contact the substrate. Top surfaces 878 of the rails 876 are in direct contact with the substrate if desired. These surfaces 878 can be textured and coated with hard coatings to cause defect removal and burnishing. The rails 876 control the spacing between the abrasive member 870 and the substrate and provide a predictable interference between the trapped free abrasive particles and the substrate.

A series of shaped recessed pads 880 are fabricated at the trailing edge 874 between the rails 876 to interact with the free abrasive particles present in the chemical mechanical polishing slurry. The recesses have a depth 882 of about 10 nanometers to about 50 nanometers relative to rails 876, which is smaller than the diameter of the free abrasive particles. The leading edges 884 of the recessed pads 880 are shaped to allow progressive entrance of the free abrasive particles to the interface of the abrasive member 870 with the substrate.

The design presents a leading edge 884 pressurized zone and a trailing edge 874 pressurized zone. The trailing edge 874 is able to both follow the topography while the recessed pads 880 cause the free abrasive particles to be in intimate contact with the substrate. The resulting contact pressure is substantially uniform and independent of the substrate topography.

Example 5

Figure 51:
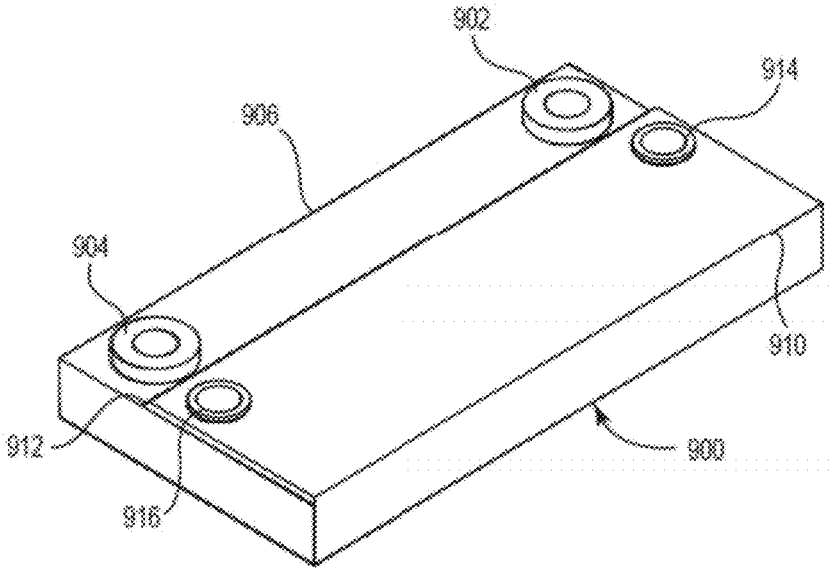
FIG. 51 illustrates a hydrostatic abrasive member for use in CMP in accordance with an embodiment of the present disclosure.

FIG. 51 illustrates abrasive member 900 for use with free abrasive particles, similar to CMP. In the case of conditions where a hydrodynamic film is difficult to establish, such as for example in the case of slow spinning plates and the presence of large amount of debris interfering with the formation of a hydrodynamic film, it is desirable to switch to a hydrostatic bearing concept.

One or more button bearings 902, 904 are fabricated at the leading edge 906, such as illustrated in FIGS. 39A and 39B. Pad 908 is formed at the trailing edge 910. The pad 908 includes ramp 912 that promotes movement of the free abrasive particles into the interface with the substrate. The trailing edge 910 is in contact with the slurry, causing the free abrasive particles to contact the surface and remove material. The hydrostatic bearing establishes a stable bearing and assures topography following. The hydrostatic bearing provides a substantially constant polishing pressure across the substrate.

Additional button bearings 914, 916 are optionally located on the pad 908 to establish a desired spacing profile with the substrate, including pitch, nominal spacing (minimum), and a roll attitude of the abrasive member 900.

Example 6

Figure 52A:
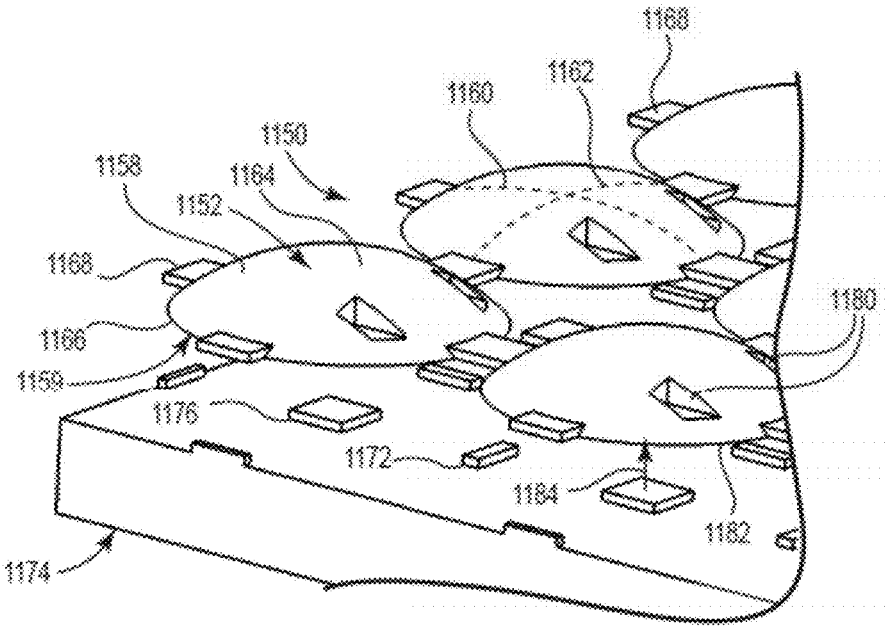
FIGS. 52A and 52B illustrate an alternate abrasive article with curve fluid bearing surfaces in accordance with an embodiment of the present disclosure.
Figure 52B:
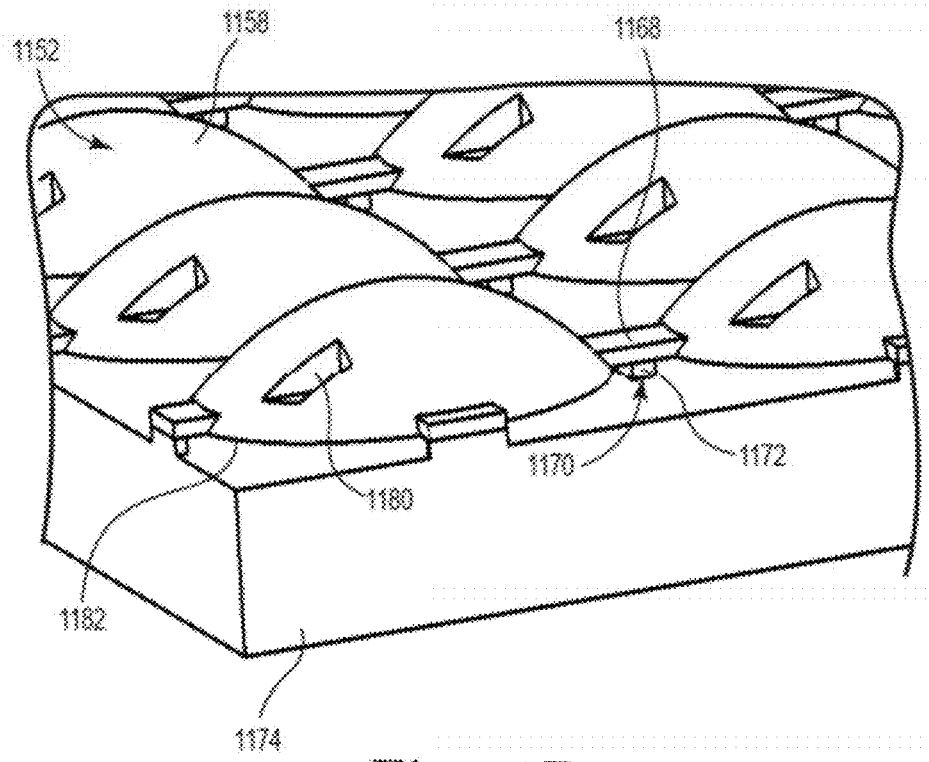

FIGS. 52A and 52B illustrates an abrasive article 1150 with an array of abrasive member 1152 with integrated preload 1154 and gimbal structure 1156 in accordance with an embodiment of the present disclosure. The illustrated abrasive members 1152 includes spherical fluid bearing structures 1158 each with crown 1160 (curvature in the direction of travel) and camber 1162 (curvature perpendicular to the crown) 1160. The illustrated curvature is substantially exaggerated to illustrate the concept. The abrasive members 1152 can be cylindrical or spherical in form.

The height differential from center 1164 of the fluid bearing structure 1158 to the edge 1166 is preferably about 10 nanometers to about 100 nanometers to permit the fluid bearing to form. The spherical nature of the fluid bearing surface 1158 is desirable for interacting with free abrasive particles contained in slurry for chemical mechanical polishing.

Each abrasive member 1152 includes a plurality of extensions 1168 that form the individual gimbal assemblies 1170. As best illustrated in FIG. 52B, the extensions 1168 are mounted to tabs 1172 on preload pad 1174, such as for example, by an adhesive, solvent bonding, ultrasonic welding, and the like. The extensions 1168 can flex and twist on either side of the tabs 1172 so the abrasive members 1152 can be independently displace vertically, and in pitch and roll. For ease of manufacturing the abrasive members 1152 and extension 1168 are molded as a unitary structure.

Preload members 1176 are positioned between the preload pad 1174 and rear surfaces 1159 of the abrasive members 1152. The preload members 1176 are preferably resilient to permit deflection of the abrasive members 1152 in the vertical direction. The preload members 1176 are preferably attached to either the preload pad 1174 or the abrasive members 1152. In an alternate embodiment, the preload pad 1174 is made of a resilient material. The preload 1184 is applied simply by pushing the entire assembly 1150 against the substrate.

The abrasive members 1152 optionally include one or more cavities or steps 1180 near leading edge 1182 to promote formation of a fluid bearing. By changing the curvature of the fluid bearing surface 1158, the shape or location of the cavities 1180, or a variety of other variables, the abrasive members can be either topography following or topography removing. If the curvature of the fluid bearing surface 1158 is increased above about 100 nanometers, the maximum pressure tends to form at the center 1164. The spherical configuration permits a progressive interactions with free abrasives. The spherical shape also allows for a point like contact with desirable topography following properties.

Example 7

Figure 53A:
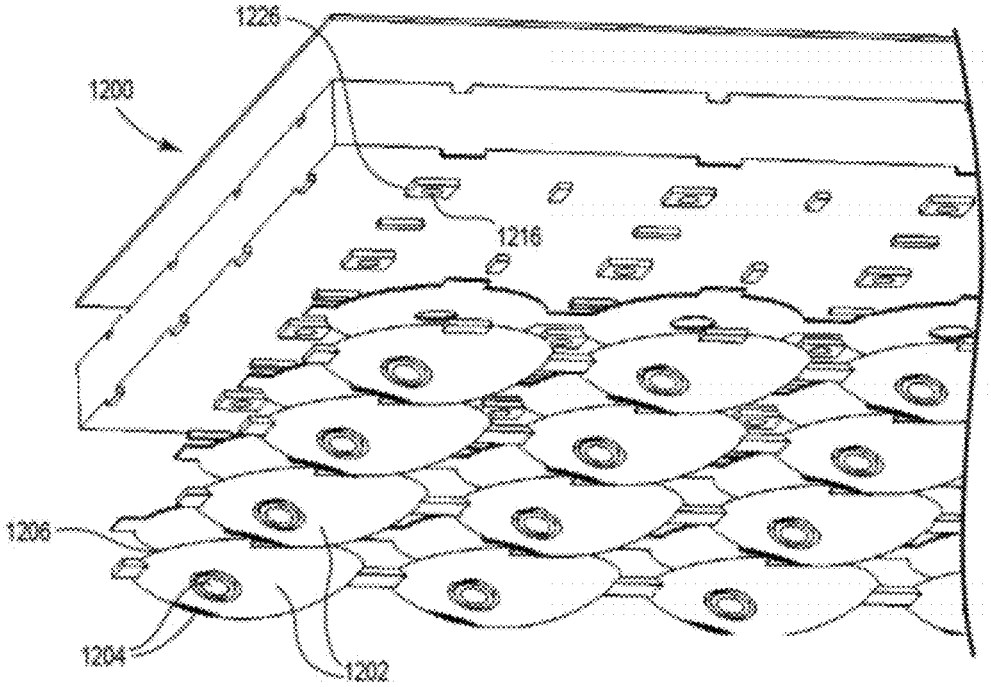
FIGS. 53A and 53B illustrate a hydrostatic version of the abrasive article of FIGS. 52A and 52B in accordance with an embodiment of the present disclosure.
Figure 53B:
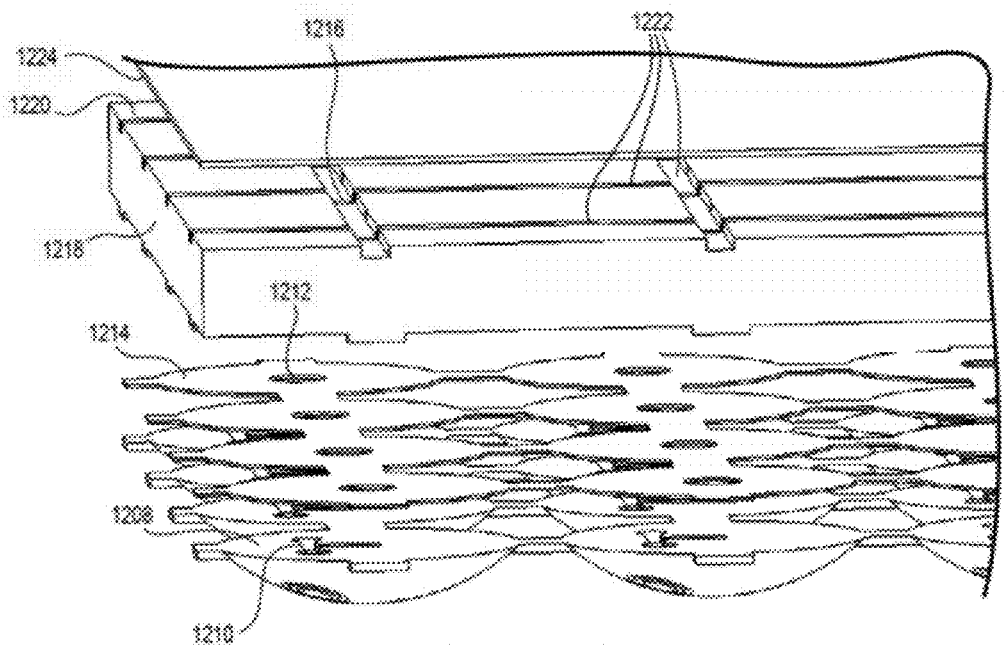

FIGS. 53A and 53B illustrates an abrasive article 1200 with an array of abrasive member 1202 substantially as shown in FIGS. 52A and 52B with hydrostatic ports 1204 in accordance with an embodiment of the present disclosure. The hydrostatic ports 1204 are preferably button bearings, such as disclosed in FIG. 39A, located at leading edges 1206 of the abrasive members 1202.

Rear surfaces 1208 of each abrasive member 1202 includes channels 1210 that fluidly communicate with opening 1212 in sealing layer 1214. As best illustrated in FIG. 53A, the openings 1212 fluidly communicate with holes 1216 in preload members 1226. Rear surface 1220 of preload pad 1218 includes a series of channels 1222 and backing layer 1224. As a result, a pressurized gas delivered to the channels 1222 flows through the backing layer, to the channels 1210 in the abrasive members 1202 and out the pressure ports 1204.

Resilient Support

Figure 54:
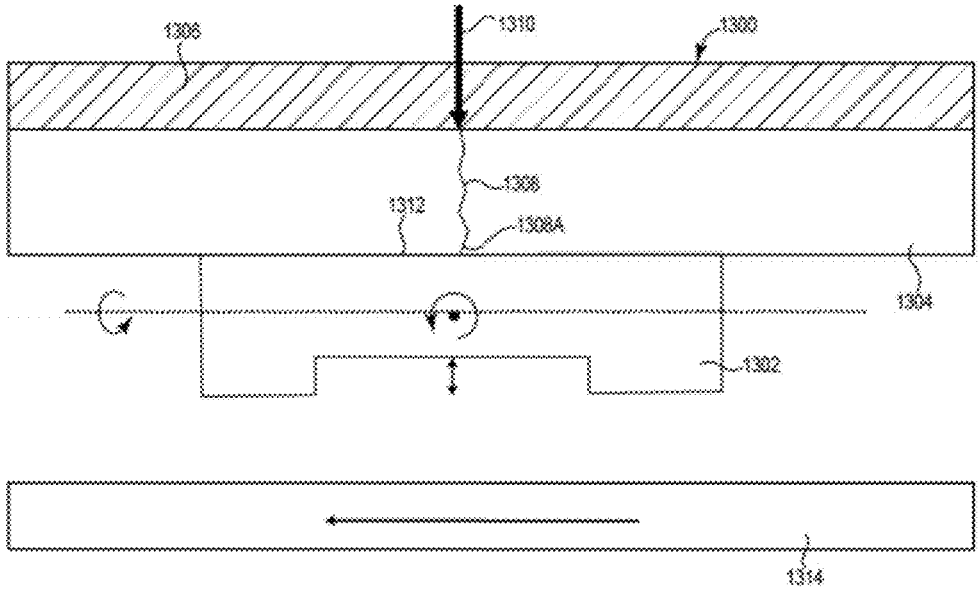
FIG. 54 is a schematic illustration an abrasive article with a resilient polymeric support in accordance with an embodiment of the present disclosure.
Figure 55:
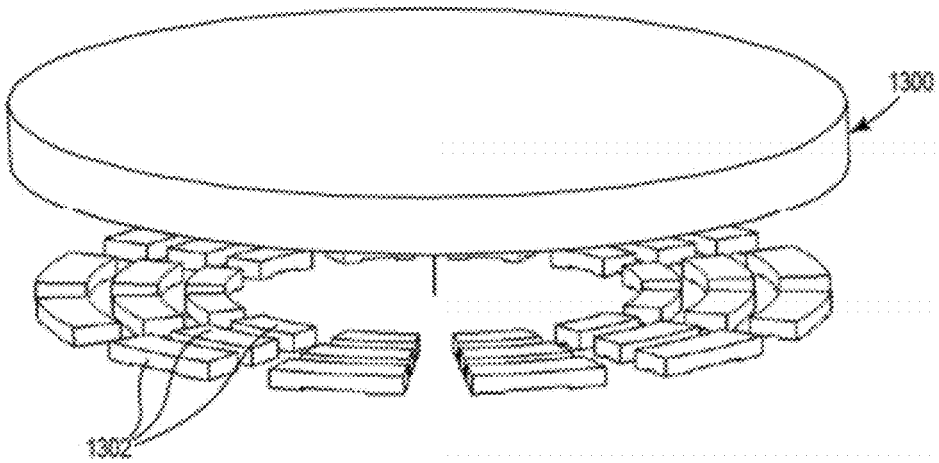
FIG. 55 is an exploded view of the abrasive article of FIG. 54.

FIGS. 54 and 55 illustrate abrasive article 1300 with an array of abrasive members 1302 coupled to resilient support 1304 in accordance with an embodiment of the present disclosure. Resilience refers to a property of a material to absorb energy when it is deformed elastically and then, upon unloading, to have this energy recovered. The resilient support is preferably an elastomer (e.g., a polymer with viscoelastic properties).

In the illustrated embodiment, resilient support 1304 is a layer of resilient material and the abrasive members 1302 are discrete structures arranged in a circular array. Each abrasive member 1302 can articulate independently in at least pitch 1336 and roll 1338 (see FIG. 57).

The resilient supports of the embodiments discussed herein are a lower cost alternative to mechanical gimbal mechanisms. While some embodiments the resilient supports may lack the frequency response of a mechanical gimbal, the resilient supports are more resistant to vibration or chatter. By modifying the resilient support, pitch and roll stiffness can be engineered for the particular application. The resilient supports can be made using a wide variety of techniques, such as for example, molding, stamping, laser cutting, and can be constructed from one or more layers.

The stiffness of the air bearing is preferably greater than the stiffness of the resilient support 1304, so the dominant factor effecting the engagement of the abrasive members 1302 with substrate 1314 is the air bearing. Once the air bearing is formed the frequency response is typically comparable to that of mechanical gimbals, with greater resistance to harmonic vibration and chatter. Additionally, frequency response is typically less important for some topography removing applications.

In the illustrate embodiment, resilient layer 1304 does not completely decouple pitch and roll displacement of a single abrasive member 1302, as can be done with a mechanical gimbal. The ability to use low-cost molding techniques to make the abrasive article 1300, however, outweighs this limitation for some embodiments.

In one embodiment, the resilient support 1304 is bonded to the abrasive member 1302. As used herein, "bond" or "bonding" refers to, for example, adhesive bonding, solvent bonding, ultrasonic welding, thermal bonding, and the like. In another embodiment, the resilient support 1304 and the abrasive members 1302 are fused together during the molding process.

Preload structures 1306 biases preload member 1308 to transmit preload 1310 to rear surface 1312 of the abrasive members 1302. In the preferred embodiment, each abrasive member 1302 has one or more discrete preload members. The preload members 1308 are preferably embedded or molded in the resilient layer 1304. The stiffness of the air bearing is preferably balanced with the stiffness of preload structure 1306.

The abrasive members 1302 are preferably rigid so that they pivot around distal end 1308A of the preload member 1308. In the illustrated embodiment, the preload member 1308 is a metallic spring member that permits Z-axis 1334 displacement of the abrasive members 1302, although a rigid preload member can also be used (see FIG. 57). As used herein, "spring members" refers to a wide variety of spring structures, such as for example, coil springs, leaf springs, flat springs, cantilever springs, and the like.

Figure 56:
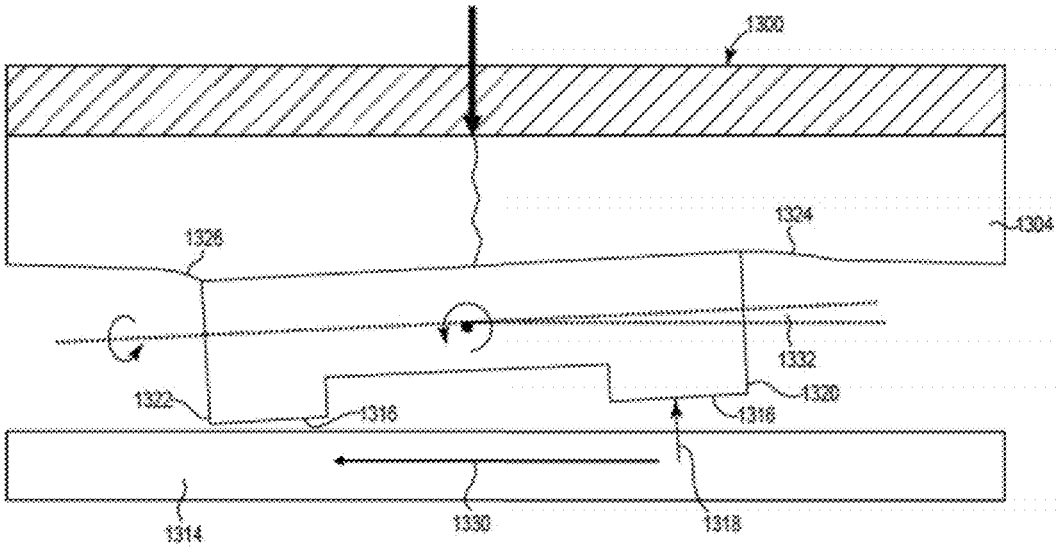
FIG. 56 is a schematic illustration of the abrasive article of FIG. 54 subject to hydrodynamic forces in accordance with an embodiment of the present disclosure.

As illustrated in FIG. 56, air shearing forces generated by relative motion 1330 of the abrasive article 1300 relative to substrate 1314 to entrain an air cushion that interacts with air bearing features 1316 to create hydrodynamic forces 1318. The air bearing features 1316 are preferably configured so generate greater lift 1318 at leading edge 1320 then at trailing edge 1322. As a result, the abrasive members 1302 assume an attitude or pitch angle 1332. Resilient layer 1304 compresses at location 1324 and stretches at location 1326 to accommodate the pitch angle 1332.

Figure 57:
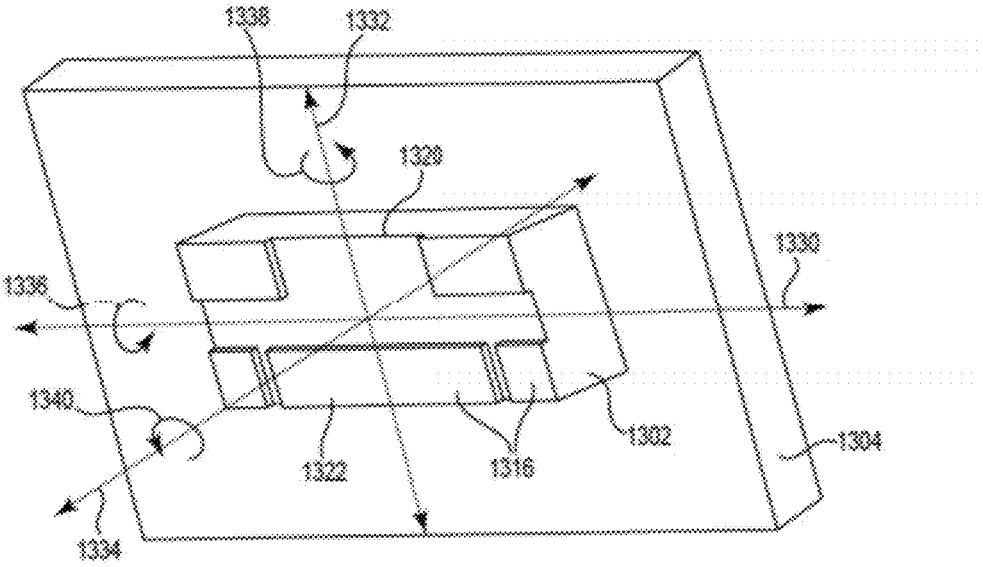
FIG. 57 is a perspective view of the abrasive member of FIG. 54.

The hydrodynamic forces 1318 are preferably substantially greater than the stiffness of the resilient layer 1304. The pitch angle 1332 is preferably controlled by other factors, such as for example, the configuration of the air bearing features 1316, the speed of the abrasive article 1300 relative to the substrate 1314, and the like. FIG. 57 illustrates one possible embodiment of the air bearing features 1316. The resilient layer 1304 allows the abrasive member 1302 to articulate in all six degrees of freedom X-axis 1330, Y-axis 1332, Z-axis 1334, pitch 1336, roll 1338, and yaw 1340.

As discussed herein, the trailing edge 1322 preferably includes abrasive features. The abrasive features can be one or more of an abrasive material attached to the air bearing features 1316, a slurry of free abrasive particles located at the interface of the air bearing features 1316 and the substrate 1314, air bearing features 1316 made from abrasive particles disbursed in a binder, nano-scale roughened surface of the air bearing features 1316 coated with a hard coat, or nano-scale diamonds attached to the air bearing features 1316 at trailing edges 1322 of the abrasive members 1302, or a combination thereof. The substrate 1314 can be a wafer, a wafer-scale semiconductor, magnetic media for hard disk drives, bit patterned or discrete track media, a convention disk for a hard disk drive, or any other substrate.

Figure 58:
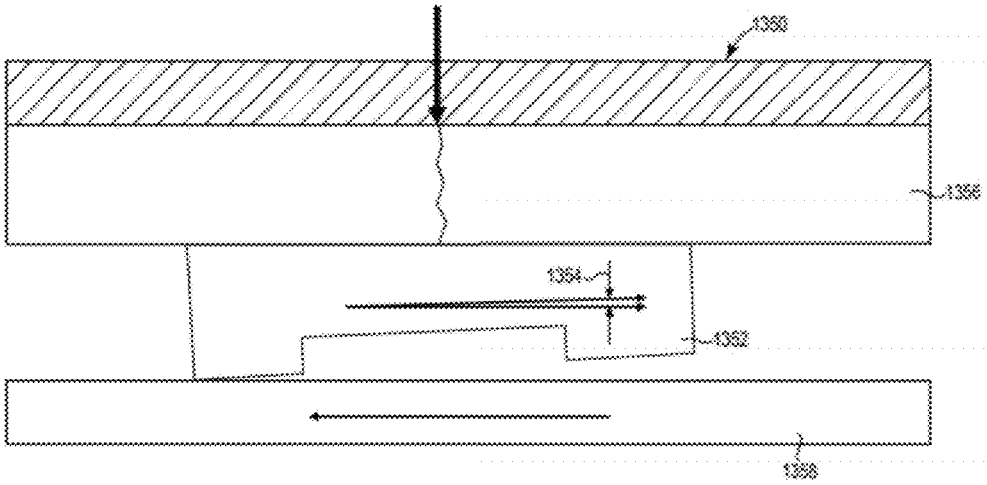
FIG. 58 is a schematic illustration of an array of abrasive members preconfigured with a pitch angle in accordance with an embodiment of the present disclosure.

FIG. 58 illustrates an alternate abrasive article 1350 with abrasive members 1352 pre-configured with pitch angle 1354 in accordance with an embodiment of the present disclosure. The pre-configured pitch attitude 1354 reduces the amount of deformation of the resilient backing 1356 required to establish the desired flying attitude of the abrasive members 1352 relative to substrate 1358. The pre-configured pitch angle 1354 is preferably established during the molding process.

Figure 59:
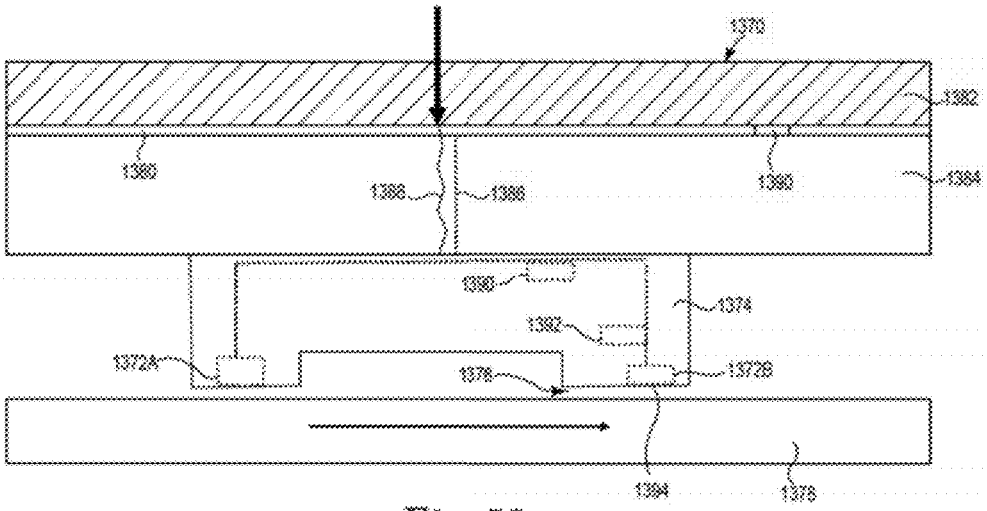
FIG. 59 is a schematic illustration of an array of abrasive members with embedded sensors in accordance with an embodiment of the present disclosure.

FIG. 59 illustrates an alternate abrasive article 1370 with one or more sensors 1372A, 1372B (collectively "1372") located in abrasive members 1374 in accordance with an embodiment of the present disclosure. Sensor 1372 can be used to perform contact detection in order to establish gap 1376 between the abrasive member 1374 and substrate 1378, to monitor material removal from the substrate 1378, and/or to monitor surface roughness of the substrate 1378. The sensors 1372 can be a shear based transducer such as disclosed in U.S. Pat. No. 6,568,992 (Angelo et al.); a lapping sensor such as disclosed in U.S. Pat. No. 5,494,473 (Dupuis et al.) and U.S. Publication No. 2005/0071986 (Lackey et al.); a piezoelectric pressure sensors disclosed in U.S. Pat. No. 6,543,299 (Taylor); and the like, all of which are hereby incorporated by reference.

In another embodiment, one or more heaters 1392 can be included to thermally expand the abrasive members 1374 as a mechanism of controlling the gap 1376 and/or to shape the contact surface 1394. Various arrangements of heaters are disclosed in U.S. Pat. Nos. 7,428,124 and 7,430,098 (Song, et al.); U.S. Pat. No. 7,388,726 (McKenzie et al.); and U.S. Pat. Publication No. 2007/0035881 (Burbank et al.), which are hereby incorporated by reference.

In the illustrated embodiment, circuit layer 1380 is located between the preload structure 1382 and the resilient layer 1384. The electrical connection between the circuit layer 1380 and the sensors 1372 can be made using a separate electrical conductor 1386 embedded in the resilient layer 1384. In another embodiment, preload member 1388 acts as the electrical conductor 1386.

Additional circuitry or electrical devices 1390 can be located in the circuit layer 1380 or in the abrasive members 1374, such as for example, ground planes, power planes, transistors, capacitors, resistors, RF antennae, shielding, filters, memory devices, embedded IC, and the like. In one embodiment, the electrical devices 1390 can be formed using printing technology, adding intelligence to the abrasive members 1374. The availability of printable silicon inks provides the ability to print electrical devices 1390, such as disclosed in U.S. Pat. No. 7,485,345 (Renn et al.); U.S. Pat. No. 7,382,363

(Albert et al.); U.S. Pat. No. 7,148,128 (Jacobson); U.S. Pat. No. 6,967,640 (Albert et al.); U.S. Pat. No. 6,825,829 (Albert et al.); U.S. Pat. No. 6,750,473 (Amundson et al.); U.S. Pat. No. 6,652,075 (Jacobson); U.S. Pat. No. 6,639,578 (Comiskey et al.); U.S. Pat. No. 6,545,291 (Amundson et al.); U.S. Pat. No. 6,521,489 (Duthaler et al.); U.S. Pat. No. 6,459,418 (Comiskey et al.); U.S. Pat. No. 6,422,687 (Jacobson); U.S. Pat. No. 6,413,790 (Duthaler et al.); U.S. Pat. No. 6,312,971 (Amundson et al.); U.S. Pat. No. 6,252,564 (Albert et al.); U.S. Pat. No. 6,177,921 (Comiskey et al.); U.S. Pat. No. 6,120,588 (Jacobson); U.S. Pat. No. 6,118,426 (Albert et al.); and U.S. Pat. Publication No. 2008/0008822 (Kowalski et al.), which are hereby incorporated by reference.

Figure 60:
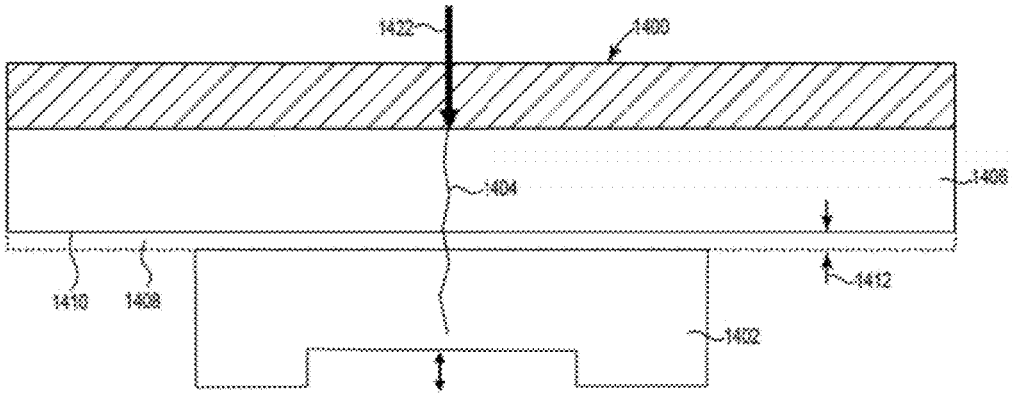
FIG. 60 is a schematic illustration of a method of making an array of cantilevered abrasive members in accordance with an embodiment of the present disclosure.

FIGS. 60 and 61 illustrate an alternate abrasive article 1400 with an array of cantilevered abrasive members 1402 in which preload member 1404 combines the preload function with the articulation function in accordance with an embodiment of the present disclosure. The embodiment of FIG. 61 substantially decouples pitch and roll displacement of the abrasive members 1402. The preload member 1404 is preferably embedded in abrasive members 1402, such as during the molding process. In one embodiment, preload member 1404 is molded into resilient support 1406.

In one embodiment, sacrificial layer 1408, such as for example a photo mask, is then applied to surface 1410 of the resilient support 1406. The abrasive members 1402 are then molded over the preload member 1404 protruding from the sacrificial layer 1408. Thickness 1412 of the sacrificial layer 1408 determines gap 1414 (see FIG. 61) between the abrasive members 1402 and the resilient support 1406.

Figure 61A:
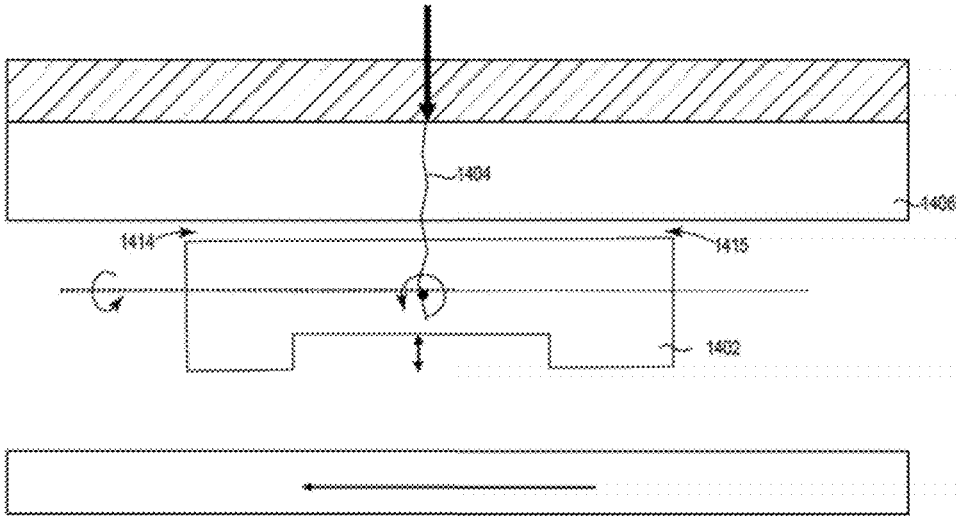
FIG. 61A is the array of cantilevered abrasive members of FIG. 60 with the sacrificial layer removed in accordance with an embodiment of the present disclosure.

As illustrated in FIG. 61A, once the sacrificial layer 1408 is removed, the abrasive member 1402 is retained in cantilevered configuration 1415 relative to the resilient support 1406 by preload member 1404. The preload member 1404 also applies preload 1422 to the abrasive members 1402, as discussed above. The preload member 1404 retains the abrasive members 1402 in a cantilevered relationship with resilient support 1406, and determines pitch and roll stiffness. The stiffness of the resilient support 1406 is optionally increased to create a stop on deflection of the abrasive member 1402.

Figure 61B:
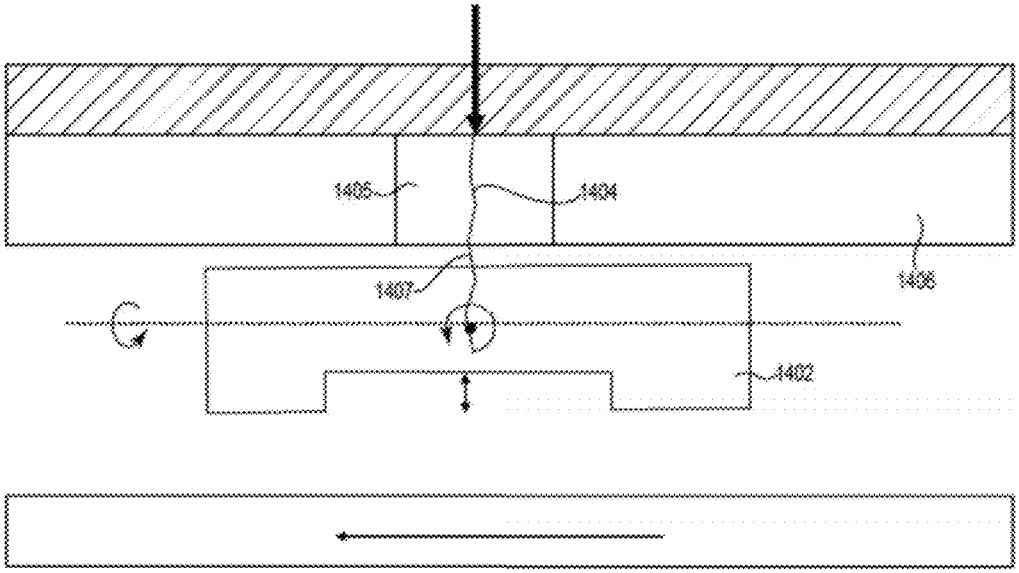
FIG. 61B is the array of alternate cantilevered abrasive members with the sacrificial layer removed in accordance with an embodiment of the present disclosure.

In an alternate embodiment illustrated in FIG. 61B, preload member 1404 is retained in a less resilient or rigid material 1405 surrounded by resilient support 1406. Consequently, resistance to displacement of the abrasive members 1402 is concentrated in distal portion 1407 of the preload member 1404.

Figure 62:
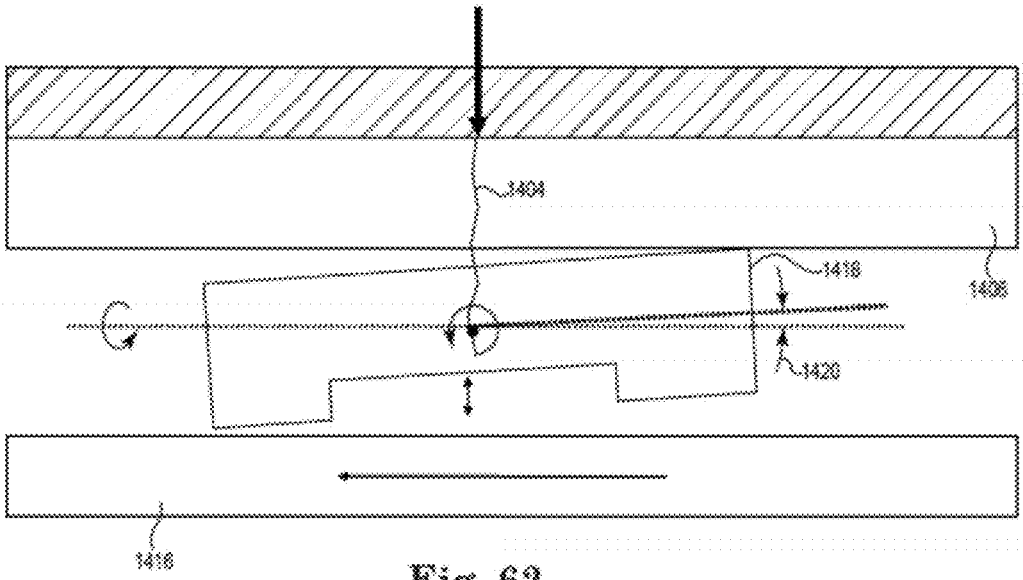
FIG. 62 is a schematic illustration of the array of cantilevered abrasive members of FIG. 60 subject to hydrodynamic forces in accordance with an embodiment of the present disclosure.

In one embodiment, the thickness 1412 is selected to permit the abrasive members 1402 to assume a desired pitch angle 1420 relative to substrate 1416. As illustrated in FIG. 62, leading edge 1418 contacts, or is adjacent to, the layer 1406 after formation of an air bearing. The layer 1406 acts to limit or resist further increases in the pitch angle 1420. The interaction of the leading edge 1418 with the layer 1406 attenuates vibration of the abrasive member 1402.

As illustrated in FIG. 62, the preload member 1404 flexes to permit the abrasive member 1402 to move in all six degrees of freedom. In the preferred embodiment, the preload member 1404 is constructed from metal to provide high frequency response during interaction with substrate 1416. The preload member 1404 can be supplemented with any of the resilient or spring structures disclosed herein.

Figure 63:
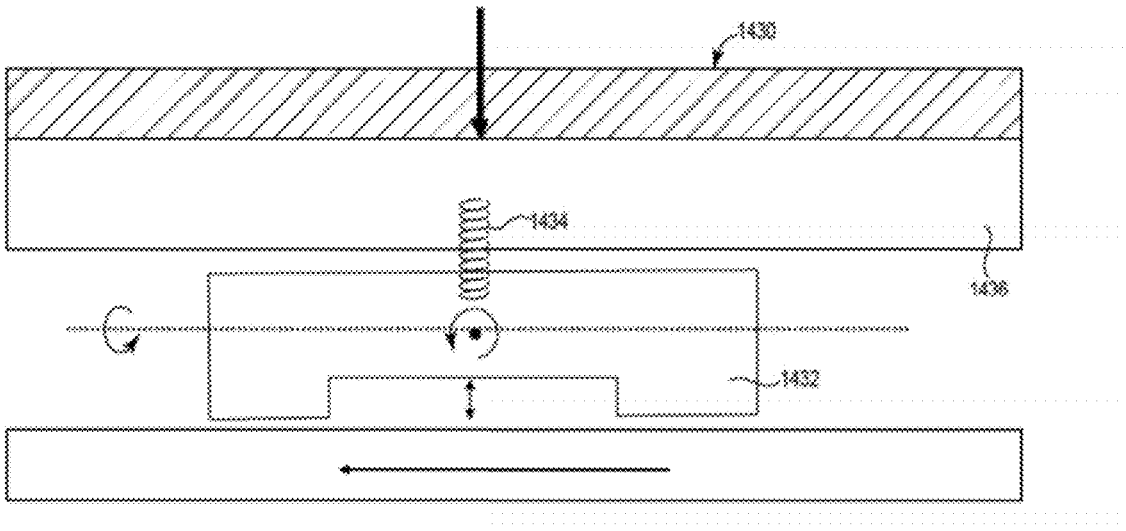
FIG. 63 is the array of alternate cantilevered abrasive members in accordance with an embodiment of the present disclosure.

FIG. 63 illustrates an alternate abrasive article 1430 with an array of cantilevered abrasive members 1432 in accordance with an embodiment of the present disclosure. In the illustrated embodiment, resilient support 1434 is a coiled spring structure embedded in the abrasive members 1432 and the resilient support 1436. Resilient support 1436 optionally has greater stiffness to limit articulation of the abrasive members 1432.

Figure 64:
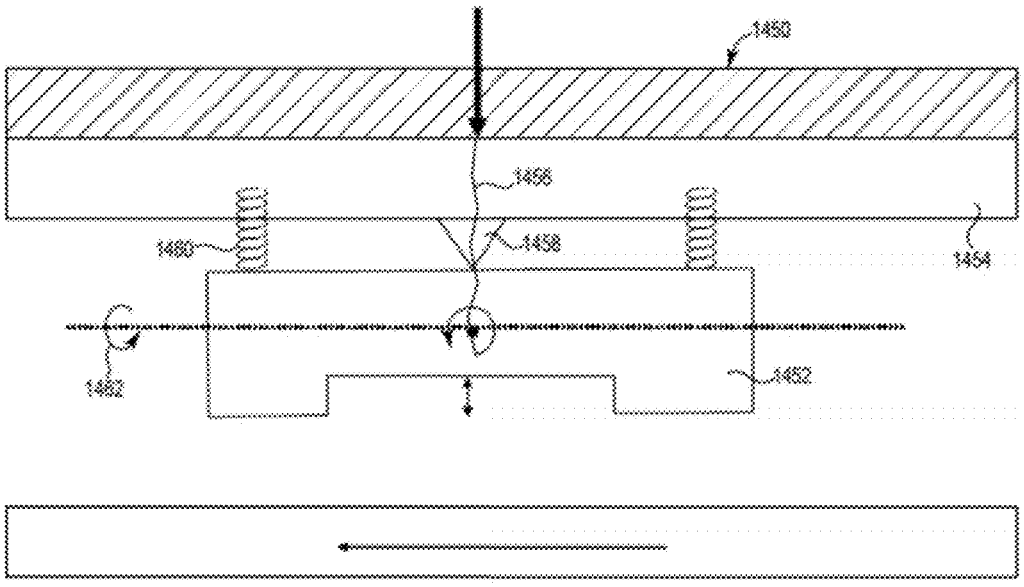
FIG. 64 is an alternate abrasive article in accordance with an embodiment of the present disclosure.

FIG. 64 illustrates an alternate abrasive article 1450 with an array of abrasive members 1452 in accordance with an embodiment of the present disclosure. Abrasive members 1452 are retained to resilient support 1454 by tension member 1456 that extends through pivot structure 1458. The pivot structure 1458 is preferably constructed from a resilient material that permits some Z-axis displacement.

In the illustrated embodiment, the tension member 1456 is highly flexible and provide minimal resistance to the abrasive members 1452 pivoting on pivot structure 1458. In one embodiment, the tension member 1456 is an extension of pivot structure 1458, instead of a separate structure. In another embodiment, tension member 1456 is a polymeric structure, such as a monofilament.

In the preferred embodiment, a plurality of spring structures 1460 are embedded in resilient support layer 1454. The spring structures 1460 are preferably located along centerline of the abrasive members 1452 (x-axis) so as to reduce resistance to roll 1462. Although the spring structures 1460 are illustrated as coil springs, a variety of other spring structures may be used, such as for example, leaf springs, flat springs, cantilever springs, and the like. Alternatively, the resilient supports 1460 can be embedded in the abrasive members 1452 and/or the resilient support layer 1454. In yet another embodiment, the spring structures 1460 are elastomeric members.

Figure 65:
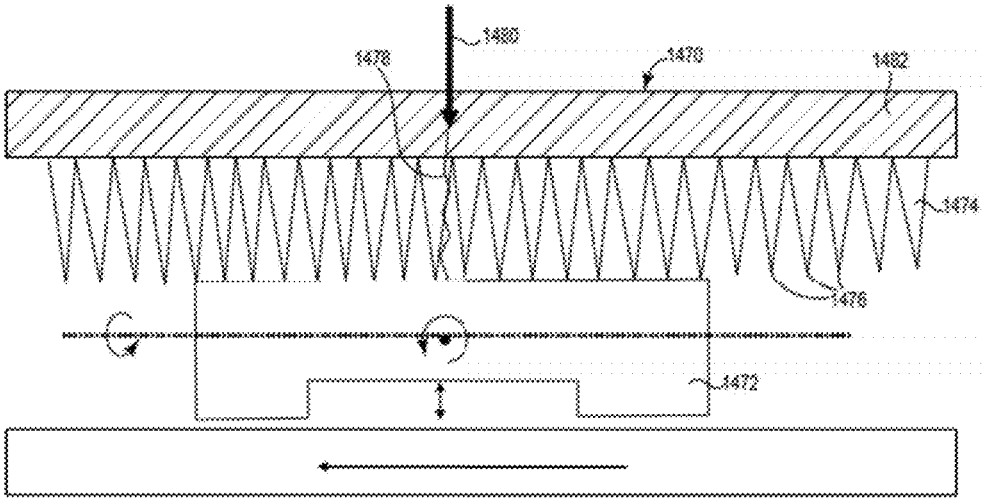
FIG. 65 is an abrasive article with a discontinuous resilient polymeric support in accordance with an embodiment of the present disclosure.

FIG. 65 illustrates an alternate abrasive article 1470 with an array of abrasive members 1472 with textured resilient support 1474 in accordance with an embodiment of the present disclosure. Altering the texture permits the pitch and roll stiffness to be adjusted. The abrasive members 1472 are preferably bonded to peaks 1476 of the textured support structure 1474. The textured resilient support 1474 has reduced stiffness relative to a continuous layer. Preload member 1478 applies preload 1480 to the abrasive members 1472. Preload member 1478 can be embedded in the textured resilient support 1474 and/or layer 1482.

Figure 66:
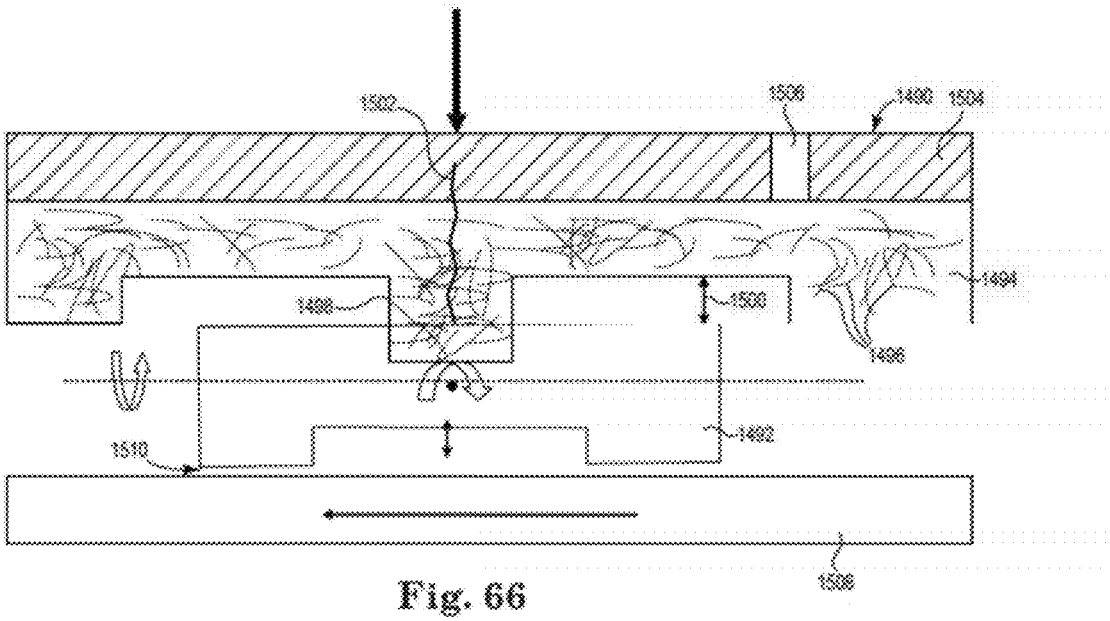
FIG. 66 is an abrasive article with a non-woven resilient polymeric support in accordance with an embodiment of the present disclosure.

FIG. 66 illustrates an alternate abrasive article 1490 with an array of abrasive members 1492 with non-woven resilient support 1494 in accordance with an embodiment of the present disclosure. The non-woven resilient support 1494 preferably includes spring metal and polymeric fibers 1496 in a non-woven configuration to increase frequency response.

In the illustrate embodiment, the non-woven resilient support 1494 is non-planar. Resilient protrusion 1498 is preferably embedded in the abrasive members 1492, such as by overmolding, to create gap 1500 to facilitate pivoting. Preload member 1502 is optionally embedded in layer 1504 for greater stability. In one embodiment, layer 1504 includes a plurality of openings 1506 through which debris abraded from substrate 1508 is removed from interface 1510 by force of vacuum.

Figure 67:
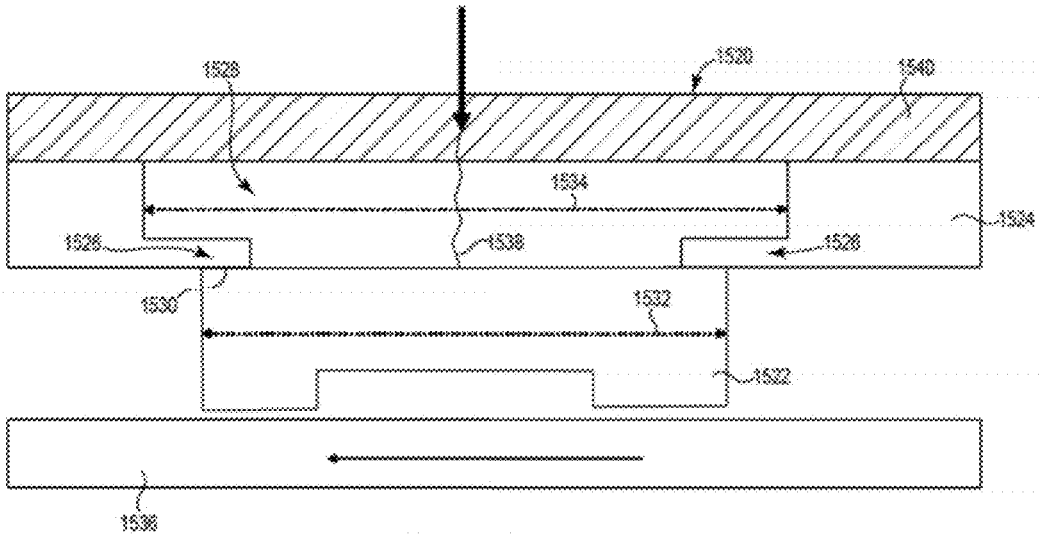
FIG. 67 is an alternate abrasive article with a discontinuous resilient polymeric support in accordance with an embodiment of the present disclosure.

FIG. 67 illustrates an alternate abrasive article 1520 with an array of abrasive members 1522 on discontinuous resilient support 1524 in accordance with an embodiment of the present disclosure. Resilient support 1524 is molded with a plurality of cantilevered projections 1526 extending into openings or recesses 1528. The abrasive members 1522 are bonded to the cantilevered projections 1526 at interfaces 1530.

Changing the geometry of the projections 1526 permits the pitch and roll stiffness to be modified for the particular application. In particular, increase the width of the projections 1526 increases roll stiffness. In one embodiment, additional projections 1526 are formed in the resilient support 1524 that engage with side edges of the abrasive members 1522 to enhance roll stiffness.

The abrasive members 1522 preferably have dimension 1532 in at least one direction that is less then corresponding dimension 1534 of the recess 1528. Consequently, during engagement with substrate 1536, only the resilience of the cantilevered projections 1526 resist displacement of the abrasive members 1522. Preload member 1538 is preferably embedded in layer 1540.

Figure 68:
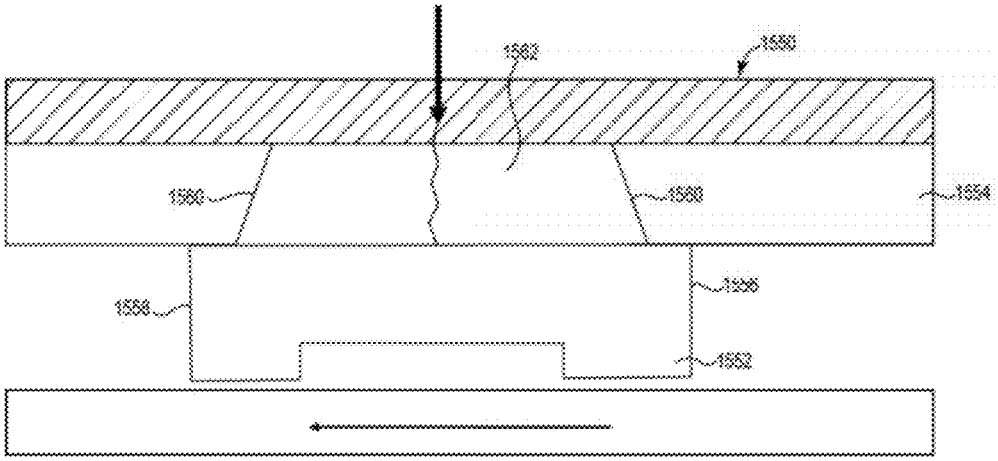
FIG. 68 is another alternate abrasive article with a discontinuous resilient polymeric support in accordance with an embodiment of the present disclosure.

FIG. 68 illustrates an abrasive article 1550 with an array of abrasive members 1552 on an alternate discontinuous resilient support 1554 in accordance with an embodiment of the present disclosure. In the illustrated embodiment, only leading and trailing edges 1556, 1558 of the abrasive members 1552 are bonded to the resilient support 1554. Side edges of the abrasive members 1552 are preferably free floating over recess 1562. Tapers 1560 formed in openings 1556 result in a steep increase in stiffness of the resilient support 1554 as a function of displacement of the abrasive members 1552.

Figure 69:
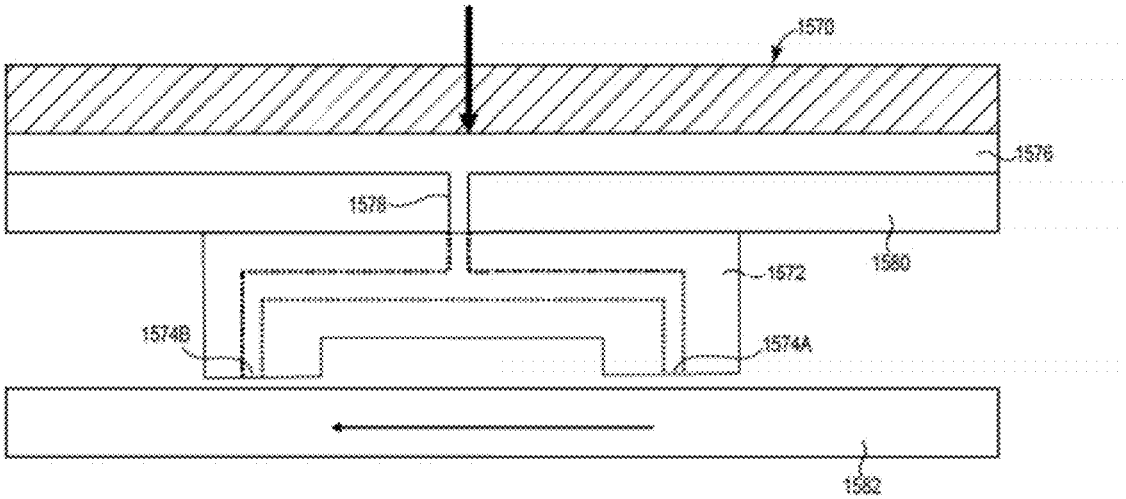
FIG. 69 is an abrasive article with pressure ports in accordance with an embodiment of the present disclosure.

FIG. 69 illustrates abrasive article 1570 having an array of abrasive members 1572 with hydrostatic pressure ports 1574A, 1574B (collectively "1574") in accordance with an embodiment of the present disclosure. Plenum 1576 is fluidly coupled by conduit 1578 that extends through resilient support 1580. The pressure generated by the hydrostatic pressure port 1574 contributes to forming pitch angle, z-height, and roll forces that counter the cutting forces emanating from surface defects interaction and potential contact with the substrate 1582.

A hydrostatic bearing may be used in combination with a hydrodynamic fluid bearing, such as during start-up rotation and/or ramp-down of the abrasive article 1570 relative to a substrate. The hydrostatic bearing controls the interface with the substrate 1582 until hydrodynamic air bearing is at least partially formed, as discussed above. Thereafter, the hydrostatic bearing is preferably reduced or terminated.

Figure 70:
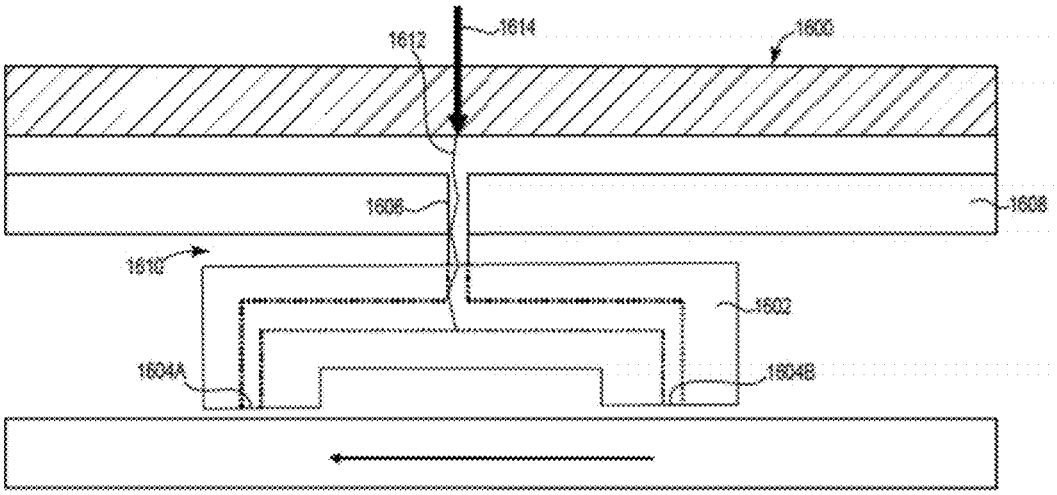
FIG. 70 is an alternate abrasive article with pressure ports in accordance with an embodiment of the present disclosure.

FIG. 70 illustrates abrasive article 1600 having an array of cantilevered abrasive members 1602 with hydrostatic pressure ports 1604A, 1604B (collectively "1604") in accordance with an embodiment of the present disclosure. Conduit 1606 extends above resilient support 1608 and into the abrasive members 1602, creating gap 1610. The conduit 1606 is preferably sufficiently resilient to permit the abrasive member 1602 to move through at least pitch and roll, but also acts as the preload member. In an alternate embodiment, separate preload member 1612 extends through conduit 1606 to provide the preload 1614, without interfering with the flow of pressurized air to the pressure ports 1604. In one embodiment, resilient support 1608 has increased stiffness to limit displacement of the abrasive members 1602. In alternate embodiment, layer 1608 is made from a resilient material to supplement the resilient of the conduit 1606.

Figure 71:
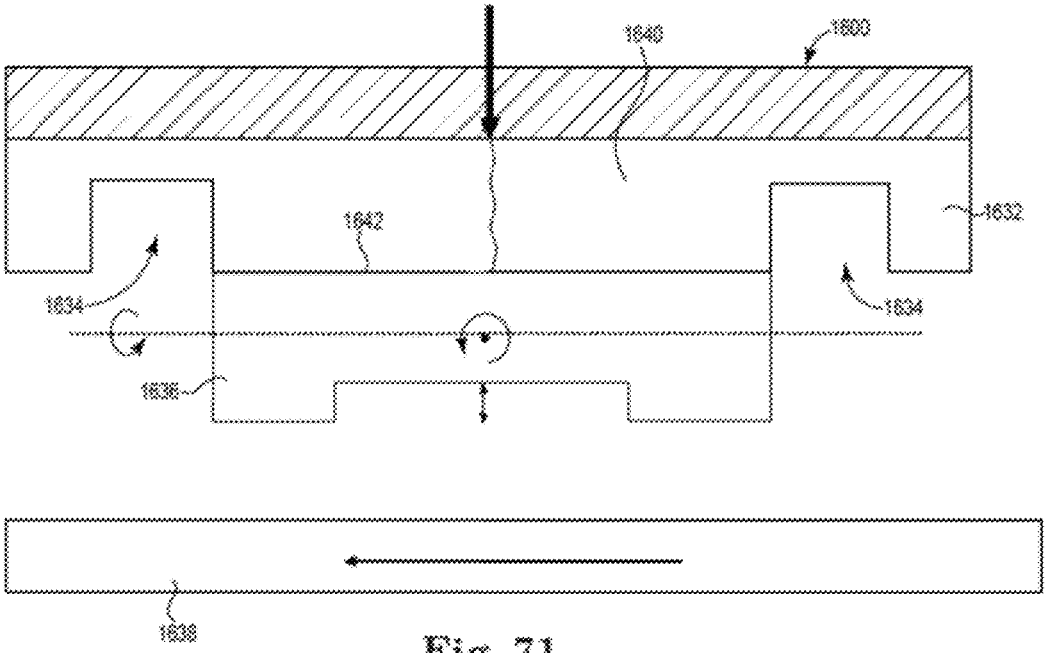
FIG. 71 is an alternate abrasive article with a structured elastomeric support in accordance with an embodiment of the present disclosure.

FIG. 71 illustrates an alternate abrasive article 1630 with structured elastomeric support 1632 in accordance with an embodiment of the present disclosure. Recesses 1634 surround and mechanically isolate abrasive members 1636 to facilitate articulation when subject to hydrodynamic forces and/or engagement with substrate 1638. In the illustrated embodiment, protrusions 1640 have generally the same dimensions as the second surface 1642 of the abrasive members 1636. In alternate embodiments, the protrusions 1640 can have cross sectional dimensions greater than or less then the second surface 1642 of the abrasive members 1636.

Where a range of values is provided, it is understood that each intervening value, to the tenth of the unit of the lower limit unless the context clearly dictates otherwise, between the upper and lower limit of that range and any other stated or intervening value in that stated range is encompassed within the present embodiments. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in this disclosure.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and describe the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. An abrasive article for polishing a substrate surface, the abrasive article comprising:

a flexible holder pad assembly;

an array of abrasive members held in place with respect to the flexible holder pad, the abrasive members further comprising:

a first surface engaged with the holder pad assembly, and a second surface including an abrasive;

a preload mechanism positioned to bias the second surfaces of the abrasive members toward the substrate surface; and one or more fluid bearing features on the second surface of the abrasive members comprising hydrodynamic bearing structures configured to generate lift forces during relative motion between the abrasive article and the substrate surface.

2. The abrasive article of claim 1 further comprising at least one abrasive features located on the second surface of the abrasive members, the at least one abrasive feature applying a cutting force to the substrate surface during relative motion between the abrasive article and the substrate surface.

3. The abrasive article of claim 2 wherein the at least one abrasive feature includes diamond like carbon.

4. The abrasive article of claim 2 wherein the at least one abrasive feature includes aluminum oxide.

5. The abrasive article of claim 2 wherein the at least one abrasive feature includes a shaped abrasive feature.

6. The abrasive article of claim 1 comprising hydrostatic bearing structures.

7. The abrasive article of claim 1 wherein the array of abrasive members comprises a cylindrical array.

8. A flexible abrasive article for polishing a substrate surface, the abrasive article comprising:

a preload assembly;

a flexible backing comprising foil held over the preload assembly, the flexible backing further comprising:

a first surface comprising one or more fluid bearings fabricated on the flexible backing to generate lift forces during motion of the abrasive article relative to the substrate surface;

a second surface engaging the preload assembly; and a mechanism that biases the second surface of the abrasive article toward the substrate surface.

9. The flexible abrasive article of claim 8 further comprising at least one abrasive feature located on the first surface of the flexible backing, the at least one abrasive feature applying cutting forces to the substrate surface during relative motion of the abrasive article and the substrate surface.

10. The flexible abrasive article of claim 8 wherein the preload assembly comprises a hydrostatic bearing structure.

11. The flexible abrasive article of claim 10 comprising sensors located on a hydrostatic bearing structure.

12. The flexible bearing abrasive article of claim 8 wherein the preload assembly is a gimbal assembly comprising negative suction force.

13. The flexible abrasive article of claim 8 wherein the fluid bearing comprises a hydrostatic bearing structure.

14. The flexible abrasive article of claim 8 wherein the fluid bearing comprises a hydrodynamic bearing structure.

15. A flexible abrasive article for polishing a substrate surface, the abrasive article comprising:

a flexible backing comprising foil under tension;

a preload comprising a plurality of closed form hydrostatic bearing structures separated by grooves connected to ambient pressure;

a first non-abrasive foil surface associated with the flexible backing;

a second abrasive foil surface associated with the flexible backing;

the first non-abrasive foil surface engaging the hydrostatic bearing structures to impart bearing surfaces on the abrasive second flexible foil bearing surface;

a mechanism that biases the second abrasive surface toward the substrate surface; and an abrasive feature located on the second surface of the flexible backing, the abrasive feature applying cutting forces to the substrate surface during motion of the abrasive article relative to the substrate surface.

16. The flexible abrasive article of claim 15 comprising sensors located at a closed form hydrostatic bearing structure.

17. The flexible abrasive article of claim 15 wherein the second abrasive surface includes a hydrostatic bearing structure.

18. The flexible abrasive article of claim 15 wherein the second abrasive surface comprises a hydrodynamic bearing structure.

19. The flexible abrasive article of claim 15 wherein the second abrasive surface includes diamond like carbon.

20. The flexible abrasive article of claim 15 wherein the second abrasive surface includes alumina.

21. A flexible abrasive article for polishing a substrate surface, the abrasive article comprising:

a flexible backing comprising foil with hydrodynamic bearing structures suspended by one or more ribs;

a mechanism that biases second surfaces of the abrasive article toward the substrate surface; and abrasive features located on a surface of the flexible backing nearest the substrate surface, the abrasive features applying cutting forces to the substrate during motion of the abrasive article relative to the substrate.

22. The flexible abrasive article of claim 21, wherein the flexible backing comprises hydrodynamic bearing structures suspended by a gimballing mechanism.

23. The flexible abrasive article of claim 21, wherein the backing comprises with hydrodynamic bearing structures suspended with a hydrostatic bearing structure.

24. The flexible abrasive article of claim 21 wherein the abrasive article is cylindrical.

* * * * *